US009834001B2

(12) United States Patent
Tanaka et al.

(10) Patent No.: US 9,834,001 B2
(45) **Date of Patent: *Dec. 5, 2017**

(54) RECORDING APPARATUS

(71) Applicant: SEIKO EPSON CORPORATION, Tokyo (JP)

(72) Inventors: Yoshiyuki Tanaka, Matsumoto (JP); Takaichi Wada, Matsumoto (JP); Tetsuya Takamoto, Matsumoto (JP); Katsumi Okamoto, Azumino (JP); Yasuhiro Matsuo, Matsumoto (JP); Isao Momose, Shiojiri (JP); Yoshisada Aoki, Azumino (JP); Tomohiro Yasufuku, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/722,960

(22) Filed: May 27, 2015

(65) Prior Publication Data

US 2015/0258800 A1 Sep. 17, 2015

Related U.S. Application Data

(62) Division of application No. 14/297,132, filed on Jun. 5, 2014.

(30) Foreign Application Priority Data

| | | |
|---|---|---|
| Jun. 5, 2013 | (JP) | 2013-118572 |
| Aug. 29, 2013 | (JP) | 2013-177663 |
| Sep. 30, 2013 | (JP) | 2013-203486 |

(51) Int. Cl.

| | |
|---|---|
| ***B41J 2/175*** | (2006.01) |
| ***B41J 29/13*** | (2006.01) |
| *B41J 13/10* | (2006.01) |

(52) U.S. Cl.
CPC ..... *B41J 2/1752* (2013.01); *B41J 2/175* (2013.01); *B41J 2/17509* (2013.01);
(Continued)

(58) Field of Classification Search
CPC ..... B41J 2/175; B41J 2/17503; B41J 29/02; B41J 347/106
See application file for complete search history.

(56) References Cited

U.S. PATENT DOCUMENTS

| | | | |
|---|---|---|---|
| 5,369,429 | A | 11/1994 | Erickson |
| 5,686,947 | A | 11/1997 | Murray et al. |

(Continued)

FOREIGN PATENT DOCUMENTS

| | | |
|---|---|---|
| CN | 2803705 | 8/2006 |
| CN | 102381042 | 3/2012 |

(Continued)

OTHER PUBLICATIONS

Machine generated English translation of JP 2012-096379 A, "Printing Method, Program, and Printer" to Urabe Yuichi. Generated via https://www4.j-platpat.inpit.go.jp/eng/tokujitsu/tkbs_en/TKBS_EN_GM101_Top.action on Sep. 28, 2015; 7pp.*

(Continued)

*Primary Examiner* — Shelby Fidler
(74) *Attorney, Agent, or Firm* — Workman Nydegger

(57) ABSTRACT

There is provided a recording apparatus including a recording head that can eject an ink onto a sheet, a transport unit that transports the sheet to the recording head, a housing that contains the recording head and the transport unit, a case that is arranged on an outer surface of the housing so that the bottom portion thereof is positioned higher than a bottom surface of the housing, and that serves as a holder which (Continued)

holds an ink container containing an ink, and a supply unit that supplies the ink from the ink container to the recording head.

9 Claims, 38 Drawing Sheets

(52) U.S. Cl.
CPC ..... *B41J 2/17553* (2013.01); *B41J 29/13* (2013.01); *B41J 13/103* (2013.01)

(56) References Cited

U.S. PATENT DOCUMENTS

| | | | | |
|---|---|---|---|---|
| 5,909,226 | A | 6/1999 | Takeda | |
| 6,353,899 | B1 | 3/2002 | Martin et al. | |
| 7,008,051 | B2 | 3/2006 | Akermalm | |
| 7,706,701 | B2 | 4/2010 | Wakide | |
| 7,789,487 | B2 | 9/2010 | Kawamura | |
| 7,866,810 | B2 * | 1/2011 | Campion | B41J 2/16552 347/104 |
| 7,891,657 | B2 | 2/2011 | Fujita | |
| 8,085,432 | B2 | 12/2011 | Hattori et al. | |
| 9,118,830 | B2 * | 8/2015 | Okazawa | H04N 1/2323 |
| 9,248,653 | B2 * | 2/2016 | Yoda | B41J 2/175 |
| 2002/0001499 | A1 * | 1/2002 | Hayashi | B41J 11/008 400/582 |
| 2004/0021751 | A1 * | 2/2004 | Steinmetz | B41J 2/17509 347/86 |
| 2004/0046842 | A1 | 3/2004 | Rhee | |
| 2005/0151782 | A1 | 7/2005 | Ishida et al. | |
| 2008/0030530 | A1 | 2/2008 | Ishida et al. | |
| 2008/0099982 | A1 * | 5/2008 | Yamanaka | B65H 1/027 347/104 |
| 2009/0201347 | A1 | 8/2009 | Hamano | |
| 2010/0091315 | A1 * | 4/2010 | Shiraki | G03G 15/5016 358/1.13 |
| 2010/0171799 | A1 * | 7/2010 | Takeuchi | B41J 2/17513 347/86 |
| 2010/0182365 | A1 | 7/2010 | Kayanaka | |
| 2010/0225726 | A1 | 9/2010 | Chan et al. | |
| 2012/0038719 | A1 | 2/2012 | Shimizu et al. | |
| 2013/0222457 | A1 | 8/2013 | Nakada et al. | |
| 2014/0043403 | A1 * | 2/2014 | Nakano | B41J 29/00 347/85 |
| 2014/0043408 | A1 * | 2/2014 | Kudo | B41J 2/17556 347/86 |
| 2014/0063147 | A1 | 3/2014 | Iwamuro et al. | |
| 2014/0253643 | A1 * | 9/2014 | Yoda | B41J 2/175 347/85 |

FOREIGN PATENT DOCUMENTS

| | | | | |
|---|---|---|---|---|
| JP | 09-156782 | A | | 6/1997 |
| JP | 11-180463 | A | | 7/1999 |
| JP | 2000153619 | A | * | 6/2000 |
| JP | 2000-313120 | A | | 11/2000 |
| JP | 2001-253448 | A | | 9/2001 |
| JP | 2002001993 | A | * | 1/2002 |
| JP | 2003-205624 | A | | 7/2003 |
| JP | 2005-191929 | | | 7/2005 |
| JP | 2006-192782 | A | | 7/2006 |
| JP | 2009-202346 | | | 9/2009 |
| JP | 2010-162812 | A | | 7/2010 |
| JP | 2012096379 | A | * | 5/2012 |
| JP | 2012-183830 | A | | 9/2012 |
| JP | 2013-082102 | A | | 5/2013 |
| JP | 2013-123846 | A | | 6/2013 |
| JP | 2013123846 | A | * | 6/2013 |
| JP | 2013-144413 | A | | 7/2013 |
| WO | WO 97/42035 | | * | 11/1997 |

OTHER PUBLICATIONS

Machine generated English translation of JP 2002-001993 A, "Ink Jet Image Forming Device" to Tatsumi et al. Generated via https://www4.j-platpat.inpit.go.jp/eng/tokujitsu/tkbs_en/TKBS_EN_GM101_Top.action on Sep. 28, 2015. 4pp.*

* cited by examiner

RECORDING APPARATUS

CROSS-REFERENCE TO RELATED APPLICATIONS

The present application is a Divisional of U.S. patent application Ser. No. 14/297,132 filed on Jun. 5, 2014, which claims priority to Japanese Patent Application No. 2013-118572, filed on Jun. 5, 2013, No. 2013-177663, filed on Aug. 29, 2013, and Japanese Patent Application No. 2013-203486, filed on Sep. 30, 2013, which applications are expressly incorporated by reference herein.

BACKGROUND

1. Technical Field

The present invention relates to a recording apparatus.

2. Related Art

In the related art, as one type of recording apparatus, an ink jet type printer has been known which performs printing by ejecting an ink onto a sheet through a recording head. In this ink jet type printer, in order to continuously and stably supply the ink to a printer head when a relatively large amount of printing is performed, a configuration has been proposed which includes an external ink supply device (liquid supply device) in a body separated from a main apparatus body of the ink jet type printer (for example, refer to JP-A-2009-202346).

This liquid supply device is provided with an ink pack (liquid container) having large containing capacity. The ink is supplied from the liquid supply device to an ink tank inside a main body of the printer, and the ink is supplied from the ink tank to the printer head.

However, since the external ink supply device as described above is arranged in the body completely separated from the main apparatus body of the ink jet type printer, there is a problem in that a large installation space is required. There is also a problem in that the ink pack of the external ink supply device is held in an unstable state.

SUMMARY

An advantage of some aspect of the invention is to provide a recording apparatus which can be installed without increasing an installation space thereof, even in a case of an ink jet type printer using an ink pack having large containing capacity, and which enables an external ink supply device to be installed in a stabilized posture.

The invention can be realized in the following forms or application examples.

Application Example 1

According to this application example, there is provided a recording apparatus including a recording head that can eject a liquid onto a recording medium, a transport unit that transports the recording medium to the recording head, a housing that contains the recording head and the transport unit, a liquid container that contains the liquid, a holder that is arranged on an outer surface of both sides which are adjacent to an outer surface having an insertion port of the housing, and a supply unit that supplies the liquid into the housing from the liquid container. Each holder has a bottom portion, and is arranged so that the bottom portion is positioned higher than a bottom surface of the housing.

According to the application example, the holders each have the bottom portion, and is arranged so that the bottom portion is positioned higher than the bottom surface of the housing. In this manner, it is possible to install even a recording apparatus using the liquid container having large containing capacity, without increasing an installation space for the recording apparatus.

Application Example 2

In the recording apparatus according to this application example, the same number of the liquid containers may be respectively held by the holder arranged on both sides.

According to the application example, the lateral weight balance of the recording apparatus is improved. Application Example 3

In the recording apparatus according to this application example, the liquid containers having different numbers may be respectively held by the holder arranged on both sides.

According to the application example, depending on types of the liquid, it is possible to change the containing capacity of the liquid which can be supplied to the recording head.

Application Example 4

In the recording apparatus according to this application example, the multiple liquid containers may be held, and at least one liquid container within the multiple liquid containers may have containing capacity different from that of the other liquid container.

According to the application example, depending on types of the liquid, it is possible to change the containing capacity of the liquid which can be supplied to the recording head.

Application Example 5

In the recording apparatus according to this application example, the multiple liquid containers may include a liquid container containing at least a black liquid, and the liquid container containing the black liquid may have containing capacity larger than that of the other liquid container.

According to the application example, it is possible to supply more of the black liquid which is frequently used.

Application Example 6

The recording apparatus according to this application example may further include a recording medium holding unit that is inserted into the housing and holds the recording medium, and the insertion port that is formed on an outer surface of the housing and into which the recording medium holding unit is inserted.

According to the application example, the recording medium holding unit is detachably attached to the housing.

Application Example 7

In the recording apparatus according to this application example, the liquid container may be a flexible container.

According to the application example, the liquid container contracts in response to the consumption of the liquid. Therefore, it is possible to prevent the liquid from not being supplied to the recording head side, which is caused by a negative pressure inside the container in response to the consumption of the liquid.

Application Example 8

The recording apparatus according to this application example may further include an image forming apparatus that is arranged on the housing and has a reading device having a reading surface for reading a medium. An upper surface of the holder may be arranged so as to be aligned with the reading surface of the image forming apparatus in height.

According to the application example, documents are supported on the holder without being partially caught by the side surface of the holder.

Application Example 9

According to this application example, there is provided a recording apparatus including a recording head that can eject a liquid onto a recording medium, a recording medium holding unit that holds the recording medium, a transport unit that transports the recording medium to the recording head, a housing that contains the recording head and the transport unit and into which the recording medium holding unit is inserted, an insertion port that is formed on an outer surface of the housing and into which the recording medium holding unit is inserted, a liquid container that contains the liquid, a holder that is arranged on at least one outer surface adjacent to an outer surface having the insertion port of the housing and that holds the liquid container, a supply unit that supplies the liquid into the housing from the liquid container, and an external recording medium holding unit that is arranged below the housing and is different from the recording medium holding unit. The holder has a bottom portion, and is arranged so that the bottom portion is positioned lower than a bottom surface of the housing.

According to the application example, the holder has the bottom portion, and the bottom portion is arranged so as to be positioned lower than the bottom surface of the housing. In this manner, even when the liquid container is increased in size or even when the number of the liquid containers is increased, it is possible to suppress an increase in size of the recording apparatus which is caused by the increased size of the holder for holding the liquid container.

Application Example 10

In the recording apparatus according to this application example, the bottom portion of the holder may be arranged so as to be positioned higher than a bottom surface of the external recording medium holding unit.

According to the application example, it is possible to decrease the installation area of the recording apparatus.

Application Example 11

In the recording apparatus according to this application example, the bottom portion of the holder may be arranged so as to be positioned by coinciding with a bottom surface of the external recording medium holding unit.

According to the application example, it is possible to increase a volume of the holder. Therefore, it is possible to provide a large liquid container or to increase the number of the liquid containers.

Application Example 12

In the recording apparatus according to this application example, the multiple external recording medium holding units may be provided, and the bottom portion of the holder may be arranged so as to be positioned higher than the bottom surface of the lowermost external recording medium holding unit.

According to the application example, it is possible to decrease the installation area of the recording apparatus.

Application Example 13

In the recording apparatus according to this application example, the multiple external recording medium holding units may be provided, and the bottom portion of the holder may be arranged so as to be positioned by coinciding with the bottom surface of the lowermost external recording medium holding unit.

According to the application example, it is possible to increase the volume of the holder. Therefore, it is possible to provide the large liquid container or to increase the number of the liquid containers.

Application Example 14

In the recording apparatus according to this application example, the holder may be arranged on an outer surface of both sides which are adjacent to an outer surface having the insertion port of the housing, and the bottom portion of at least any one holder may be arranged so as to be positioned lower than the bottom surface of the housing.

According to the application example, it is possible to increase the volume of the both side holders. Therefore, it is possible to provide the large liquid container or to increase the number of the liquid containers.

Application Example 15

In the recording apparatus according to this application example, a finger hooking portion which holds the recording apparatus may be formed on the bottom surface of the housing which is positioned below the holder, and the holder may not be arranged at a position of the finger hooking portion.

According to the application example, it is possible to grasp the finger hooking portion in a state where the holder is mounted on the housing.

Application Example 16

The recording apparatus according to this application example may further include a reading unit that reads an image drawn on a document mounted on a document table. The uppermost position of the holder may be lower than the position of the document table.

According to the application example, operability is good when a user mounts a document on the reading unit or when a document is removed from the reading unit.

Application Example 17

According to this application example, there is provided a recording apparatus including a recording head that can eject a liquid onto a recording medium, a recording medium holding unit that holds the recording medium, a transport unit that transports the recording medium to the recording head, a housing that contains the recording head and the transport unit, and into which the recording medium holding unit is inserted, an insertion port that is formed on a side surface of the housing and into which the recording medium holding unit is inserted, a liquid container that contains the liquid, a holder that is detachably attached to at least one side surface adjacent to the side surface having the insertion port of the housing, and that stores the liquid container, a support stand that is arranged below the housing and supports the housing; and a supply unit that supplies the liquid into the housing from the liquid container. The holder is arranged over the housing and the support stand.

According to the application example, the recording apparatus includes the support stand which is arranged below the housing and supports the housing, and the holder is arranged over the housing and the support stand. In this manner, it is possible to increase the vertical length of the holder. Therefore, it is possible to increase a liquid containing amount of the liquid container contained inside the holder, and it is possible to decrease the length of the width or the depth in the holder. Accordingly, it is possible to suppress the increase in size of the overall recording apparatus including the holder.

Application Example 18

In the recording apparatus according to this application example, an extension portion extending further outward from a position of the side surface of the housing may be integrally formed in the support stand, and the extension portion supports the holder.

According to the application example, the holder can be fixed to the housing via the extension portion. Therefore, the holder and the housing are integrated with each other.

Application Example 19

In the recording apparatus according to this application example, the holder may be arranged on both sides, the extension portion may extend further outward from the position of the side surface on both sides of the housing, and a bottom portion of the holder arranged on both sides may be supported by the extension portion.

According to the application example, both side holders can be fixed to the housing via the extension portion. Therefore, the holders and the housing are integrated with each other.

Application Example 20

In the recording apparatus according to this application example, the holder may be arranged on both sides, a bottom portion of one holder between the holders respectively arranged on both sides may be supported by the extension portion, and a support which supports the bottom portion of the other holder may be arranged on a lower side of the other holder.

According to the application example, one holder is supported by the extension portion in the support stand for supporting the housing. Therefore, one holder can be fixed to the housing, and the other holder is supported by the support to be installed in a stabilized posture.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, an embodiment of a recording apparatus will be described with reference to the drawings.

Figure 1:
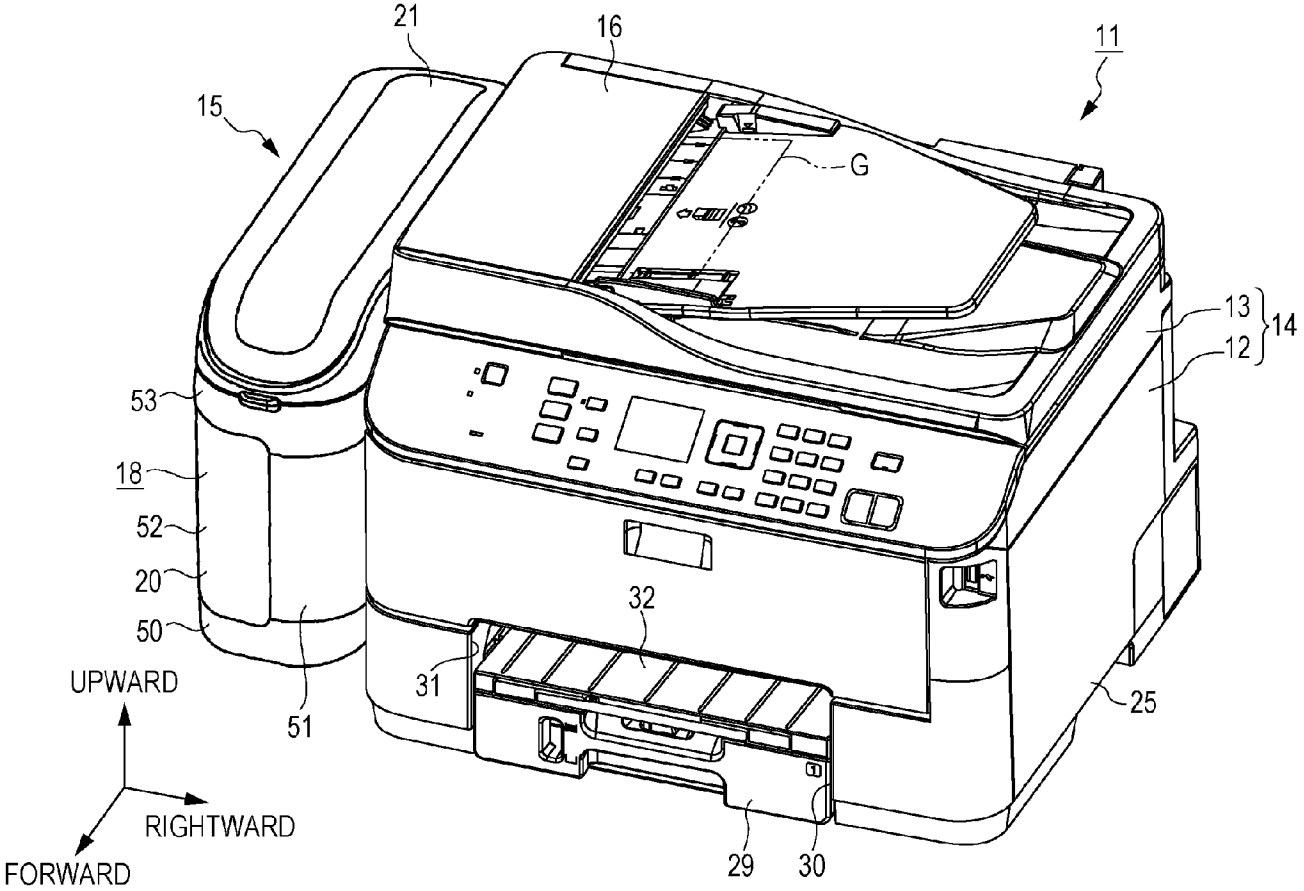
FIG. 1 is an external perspective view of a recording apparatus.
Figure 2:
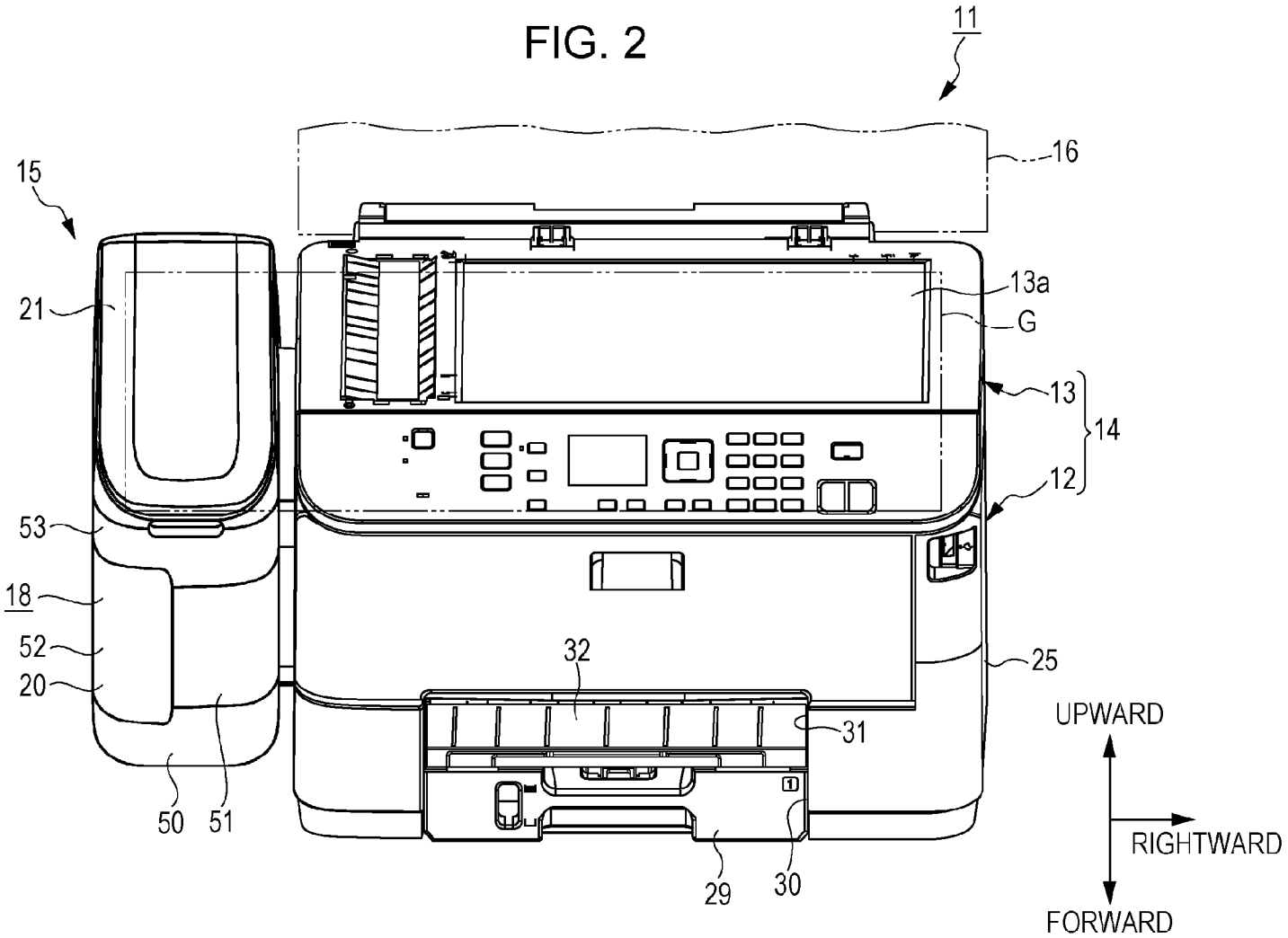
FIG. 2 is a perspective view illustrating a state where an automatic document feeder is opened in a recording apparatus.

As illustrated in FIGS. 1 and 2, an ink jet type printer (hereinafter, referred to as a printer) 11 serving as the recording apparatus includes a main apparatus body 14 having a printing unit 12 which forms an image by ejecting an ink (liquid) and a reading unit 13 serving as an image reading unit which reads a document G (medium), and an ink supply device 15 serving as an example of a liquid supply device which supplies the ink to the printing unit 12. The reading unit 13 is arranged on the printing unit 12.

The reading unit 13 has a reading surface 13*a* which reads the document G on an upper end thereof. An automatic document feeder 16 is arranged on the reading unit 13 so as to be capable of opening/closing the reading surface 13*a*. The automatic document feeder 16 sequentially feeds the multiple stacked documents G onto the reading surface 13*a* while reversing the documents G one by one.

Figure 3:
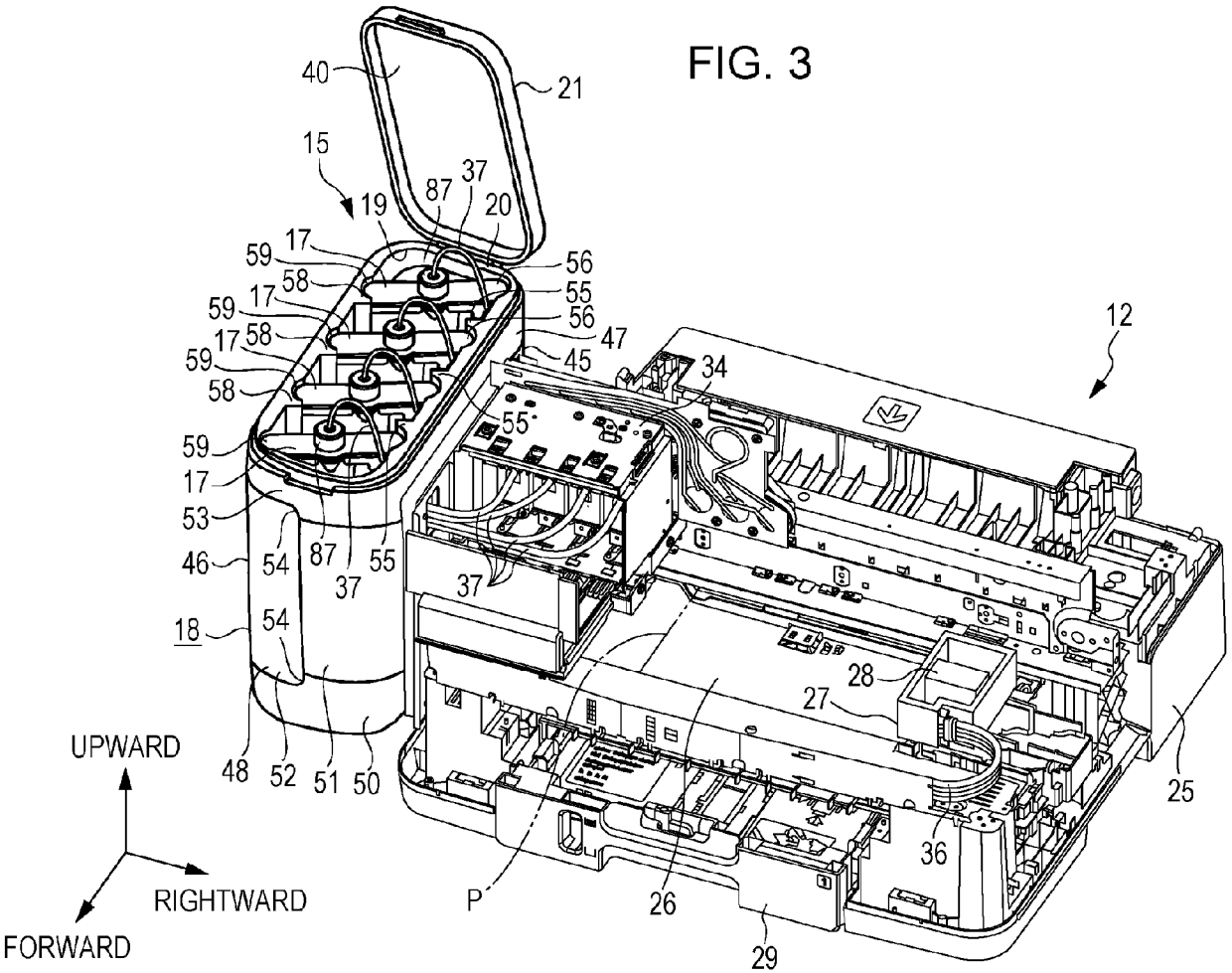
FIG. 3 is a perspective view illustrating an interior of a recording apparatus.

As illustrated in FIGS. 2 and 3, the ink supply device 15 is attached to a left side of the main apparatus body 14. The ink supply device 15 is attached to a left side wall of the main apparatus body 14 so that a bottom wall forming member 50 is positioned higher than a bottom surface of the main apparatus body 14. In this manner, the ink supply device 15 is arranged in a state where the bottom wall forming member 50 is separated from an installation surface. Therefore, there is no possibility that an installation area for the printer 11 may increase.

The ink supply device 15 includes multiple (four in the present embodiment) ink containers 17 having a substantially rectangular shape which serve as an example of a liquid container containing the ink, and a case 18 which serves as an example of a holder holding the respective ink containers 17. The case 18 includes a container body 20 having a bottomed rectangular box shape which has an opening 19 for containing the respective ink containers 17 on an upper end and is long in a longitudinal direction, and a lid body 21 covering the opening 19 so as to be openable and closeable. Both of the container body 20 and the lid body 21 are configured to have a synthetic resin material.

Four ink containers 17 are arranged side by side in the longitudinal direction inside the container body 20. These four ink containers 17 respectively contain a cyan ink, a magenta ink, a yellow ink and a black ink, sequentially from a rear side to a front side. In this case, the ink container 17 of the black ink frequently used is arranged on the front most side inside the container body 20.

The case 18 is detachably attached to a left side surface of the printing unit 12 (main apparatus body 14) so that an upper surface of the case 18 is aligned with the reading surface 13*a* in height in a state where the lid body 21 is closed. Here, in the specification, the description of "aligned in height" means that heights are the same as each other, and in addition, also includes a case where a difference in the heights falls within 2 cm. Then, in the embodiment, the height of the case 18 is lower than the height of the reading surface 13*a* by 5 mm.

As illustrated in FIGS. 1 and 3, the printing unit 12 includes a housing 25 having a substantially rectangular parallelepiped shape which is long in a lateral direction. A transport path 26 which supports a sheet P serving as an example of a target (to be described later) is disposed in a central portion inside the housing 25. A carriage 27 reciprocally movable in the lateral direction which is a main scanning direction is disposed above the transport path 26.

A recording head 28 ejecting the ink is supported inside the carriage 27 so as to be exposed from a lower surface of the carriage 27. The recording head 28 opposes the transport path 26. Then, the recording head 28 ejects the ink through multiple nozzles (not illustrated) onto the sheet P transported on the transport path 26 from a rear side to a front side while the carriage 27 moves in the lateral direction, thereby performing printing on the sheet P.

In a lower side of the transport path 26 inside the housing 25, an opening 30 is disposed in a central lower portion of a front surface of the housing 25. The opening 30 is an insertion port through which a sheet cassette 29 serving as a recording medium holding unit which can contain the multiple sheets P in a stacked state is detachably attached to the housing 25. The sheet P inside the sheet cassette 29 is fed on the transport path 26 from the rear side by a sheet feeding mechanism (not illustrated) while being reversed one by one.

Then, the sheet P printed on the transport path 26 is sequentially discharged through a sheet discharge port 31 which is configured to be positioned at a further upper side region than the sheet cassette 29 in the opening 30. On an upper side of the sheet cassette 29, a sheet discharge tray 32 which sequentially supports the sheet P sequentially discharged from the sheet discharge port 31 is disposed in a stretchable manner in the longitudinal direction.

Figure 4:
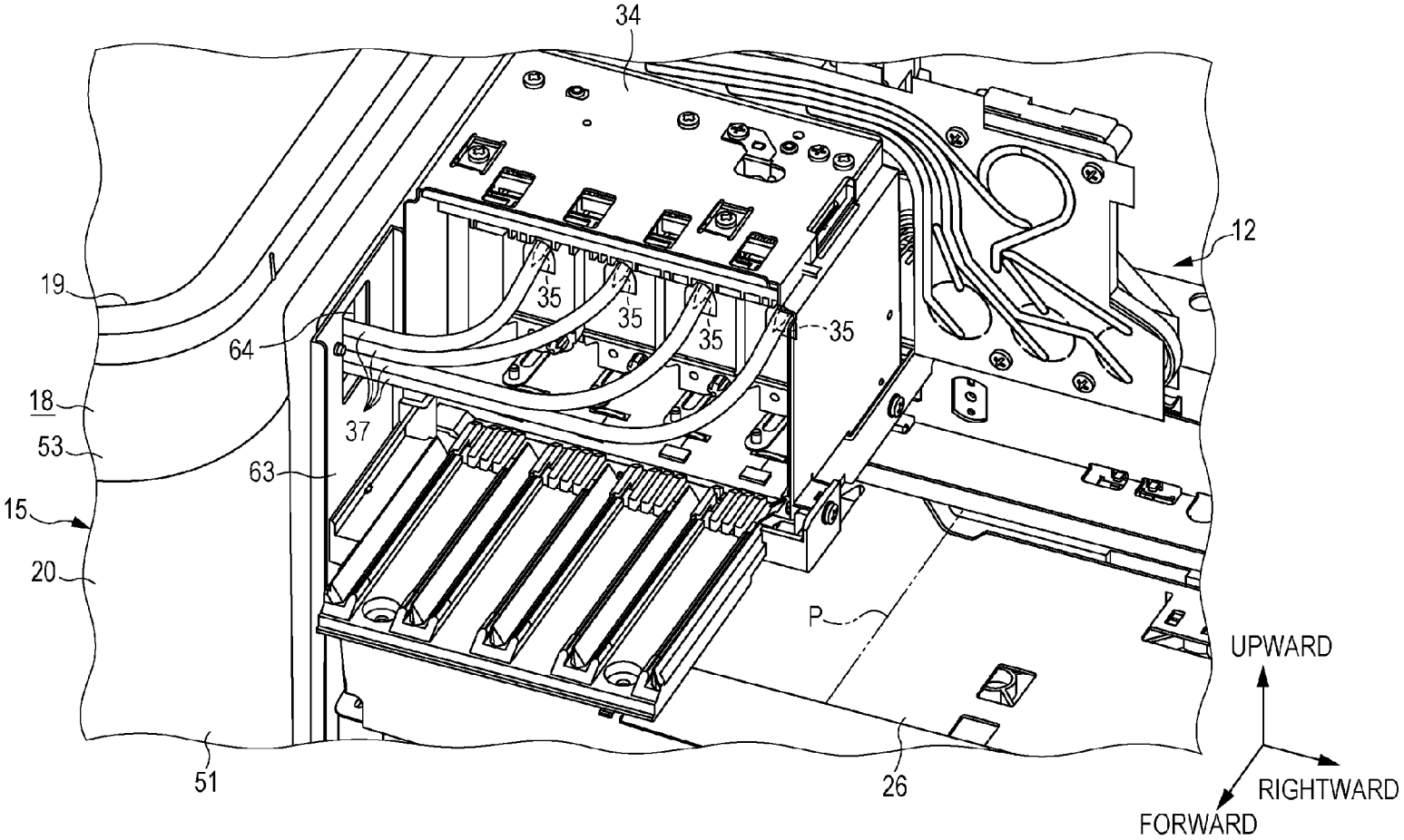
FIG. 4 is an enlarged view of a main portion in an interior of a recording apparatus.

As illustrated in FIGS. 3 and 4, a left end portion inside the housing 25 includes a holder case 34 having a rectangular box shape whose front side is opened, and multiple (four in the embodiment) hollow ink supply needles 35 which are disposed on a bottom wall (rear wall) inside the holder case 34 and are arranged side by side in the lateral direction.

The respective ink supply needles 35 extend in the longitudinal direction and penetrate a side wall of the holder case 34. One end side of a flexible ink supply tube 36 is connected to a rear end portion of each of the ink supply needles 35, and the other end side of the ink supply tube 36 is connected to the recording head 28. The printing unit 12 of the embodiment is configured so that the cyan ink, the magenta ink, the yellow ink, and the black ink are respectively supplied to these four ink supply needles 35 sequentially from the left side to the right side.

Then, based on colors of the ink, an arrangement order of the respective ink supply needles 35 from the left side to the right side in the holder case 34 is the same as an arrangement order of the respective ink containers 17 from the rear side to the front side inside the container body 20. Furthermore, the respective ink containers 17 and the respective ink supply needles 35 are connected to each other by flexible connection tubes 37 serving as an example of a flow path member configuring a portion of the ink supply device 15, so as to correspond to the supplied ink of each color.

A valve body (not illustrated) is disposed in an upper portion of the ink container 17. The valve body is operated by being rotated in a direction of pressing a cap 87 downward, thereby allowing a communicating state between an interior of the ink container 17 and the connection tube 37.

Therefore, the respective inks supplied to the respective ink supply needles 35 from the respective ink containers 17 of the ink supply device 15 via the respective connection tubes 37 are supplied to the recording head 28 via the ink supply tubes 36.

Next, a configuration of the case 18 will be described in detail.

As illustrated in FIGS. 2 and 3, the lid body 21 of the case 18 forms a lidded rectangular box shape which has an opening 40 on the container body 20 side, which is long in the longitudinal direction, and which is shallower than the container body 20. The lid body 21 is connected to an upper end portion on a rear surface of the container body 20 via a hinge portion 41 in FIG. 5. Therefore, when being operated for opening/closing, the lid body 21 is pivotally moved about a fulcrum of the hinge portion 41. That is, the lid body 21 is opened from the front side of the container body 20, and is closed on the front side of the container body 20. The lid body 21 is configured so that the opening 40 is aligned with the opening 19 in a state where the opening 19 of the container body 20 is closed.

Figure 5:
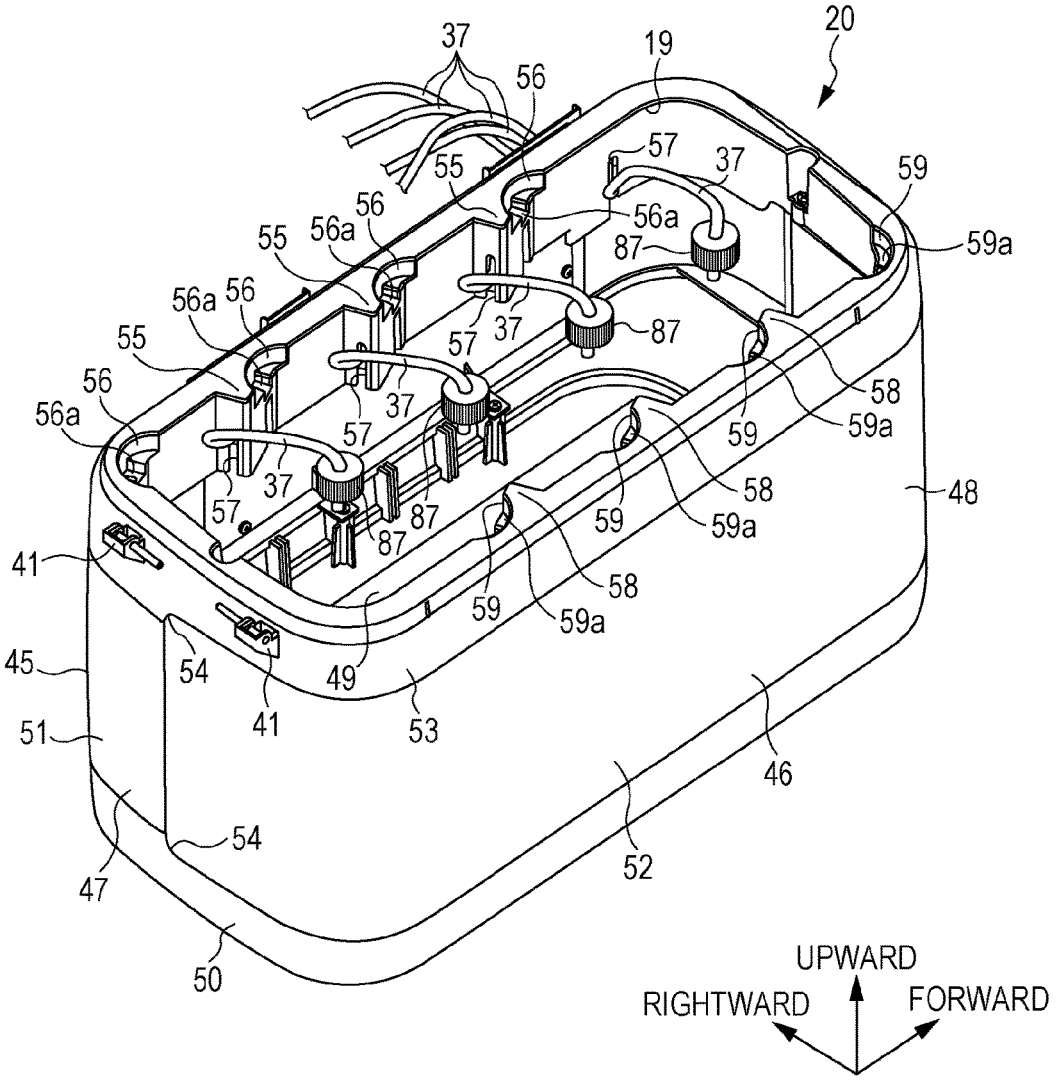
FIG. 5 is a perspective view illustrating an interior of a container body.

As illustrated in FIGS. 3 and 5, the container body 20 having a bottomed rectangular box shape includes a right side wall 45 serving as a wall opposing the printing unit 12, a left side wall 46 opposing the right side wall 45, a rear side wall 47 and a front side wall 48 which are orthogonal to the right side wall 45 and the left side wall 46, and a bottom wall 49 which is orthogonal to the right side wall 45, the left side wall 46, the rear side wall 47, and the front side wall 48.

Then, the opening 19 is disposed on a side opposing the bottom wall 49. That is, the opening 19 opposes the bottom wall 49, and is formed above the bottom wall 49 in a gravitational direction. Then, in the embodiment, the right side wall 45, the left side wall 46, the rear side wall 47, and the front side wall 48 respectively configure a first side wall, a second side wall, a third side wall, and a fourth side wall. A distance between the right side wall 45 and the left side wall 46 in the container body 20 is shorter than a width of an upper end side (one end side) of the ink container 17.

The container body 20 includes a bottom wall forming member 50 having a bottomed rectangular box shape which forms the bottom wall 49, a right side wall forming member 51 which forms the right side half of the side wall and has a plate shape curved in a substantially U-shape, a left side wall forming member 52 which forms the left side half of the side wall and has a plate shape curved in a substantially U-shape, and a rectangular frame-shaped edge member 53 where a lower side configuring an peripheral edge portion of the opening 19 is an opened hollow portion.

Then, the container body 20 is configured by combining the right side wall forming member 51 serving as an example of a division member, and the left side wall forming member 52 serving as an example of a division member. That is, the side wall of the container body 20 is configured by combining the right side wall forming member 51 and the left side wall forming member 52 which are two division members divided laterally.

A vertical width of the left side wall forming member 52 is slightly wider than a vertical width of the right side wall forming member 51. Therefore, steps 54 are respectively formed at a position corresponding to a contact portion between the left side wall forming member 52 and the right side wall forming member 51 in a lower end portion of the edge member 53 and an upper end portion of the bottom wall forming member 50.

The left side wall forming member 52 is configured to have a transparent synthetic resin material. Therefore, the respective ink containers 17 contained inside the container body 20 are visibly checked through the left side wall forming member 52 from the outside of the container body 20.

As illustrated in FIGS. 3 and 5, a right protruding portion 55 protruding inward (leftward) is formed corresponding to the number of the ink containers 17 on a right inner side surface of the edge member 53. In the embodiment, the ink has four colors, and the ink container 17 arranged on the rearmost side does not need the right protruding portion 55. Accordingly, three right protruding portions 55 are formed. The respective right protruding portions 55 are arranged so as to be equally spaced in the longitudinal direction. The respective right protruding portions 55 form a substantially lidded triangular box shape whose lower side is opened, so as to match with a shape of respective tongue-piece portions 70 to 72 (to be described later, refer to FIG. 6). In this case, the respective right protruding portions 55 form a substantially triangular shape when viewed from above. Between two sides of the protruding triangular shape, the rear side is shorter than the front side.

Right recesses 56 serving as an example of a support portion supporting the ink container 17 in a support member 92 (to be described later, refer to FIGS. 11A and 11B) are respectively formed at an overlapping position on a front side of the respective right protruding portions 55 on the upper surface of the edge member 53 and a right rear corner portion. These four right recesses 56 are arranged so as to be equally spaced in the longitudinal direction, and form a shape so as to match with a partial shape of the support member 92. A cut-out recess 56*a* is formed in a central portion on the bottom surface of the respective right recesses 56.

Cut-out portions 57 serving as an example of an insertion portion extending upward from the lower end are formed in the vicinity of a right front corner portion on the rear side surface in the respective right protruding portion 55 and the right inner side surface of the edge member 53. The connection tubes 37 of the respective ink containers 17 side can be respectively inserted into these four cut-out portions 57. The respective cut-out portions 57 are arranged so as to be equally spaced in the longitudinal direction.

A left protruding portion 58 protruding inward (rightward) is formed corresponding to the number of the ink containers 17 on a left inner side surface of the edge member 53. In the embodiment, the ink has four colors, and the ink container 17 arranged on the front most side does not need the left protruding portion 58. Accordingly, three left protruding portions 58 are formed. The respective left protruding portions 58 are arranged at positions slightly shifted forward from the respective right protruding portions 55 in the longitudinal direction. The respective left protruding portions 58 are arranged so as to be equally spaced in the longitudinal direction. The respective left protruding portions 58 form a substantially lidded triangular box shape whose lower side is opened. In this case, the respective left protruding portions 58 form a substantially triangular shape when viewed from above. Between two sides of the protruding triangular shape, the rear side is longer than the front side.

Left recesses 59 serving as an example of a support portion supporting the ink container 17 in the support member 92 (to be described later, refer to FIGS. 11A and 11B) are respectively formed at an overlapping position on a rear side of the respective left protruding portions 58 on the upper surface of the edge member 53 and a left front corner portion. These four left recesses 59 are arranged so as to be equally spaced in the longitudinal direction, and form a shape so as to match with a partial shape of the support member 92. A cut-out recess 59*a* is formed in a central portion on the bottom surface of the respective left recesses 59. Then, the respective left recesses 59 oppose the respective right recesses 56 in a direction intersecting the lateral direction by an angle of less than 90 degrees (30 degrees in the embodiment).

Figure 6:
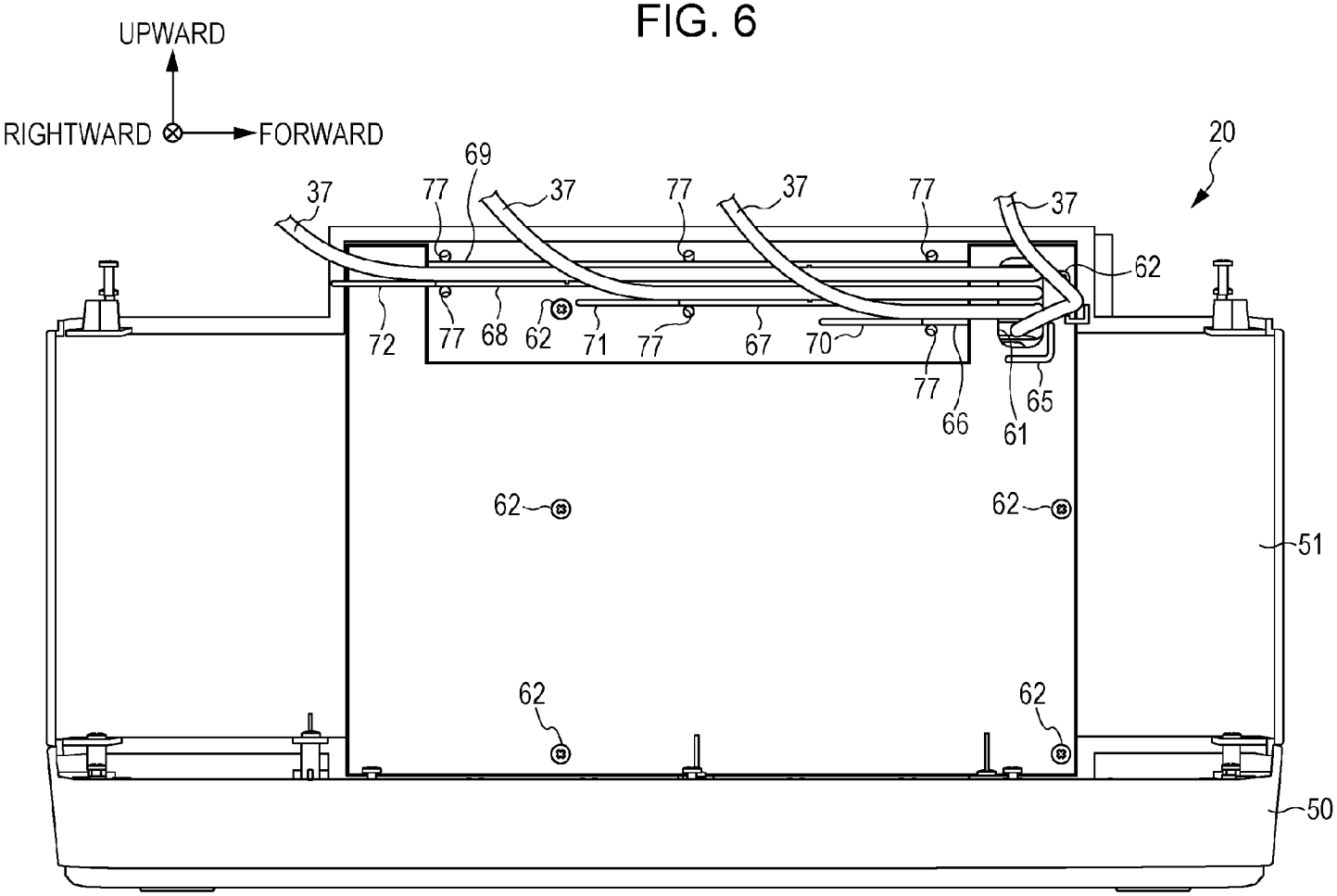
FIG. 6 is a side view when a right side wall forming member of a container body is viewed from the inside (left side).
Figure 7:
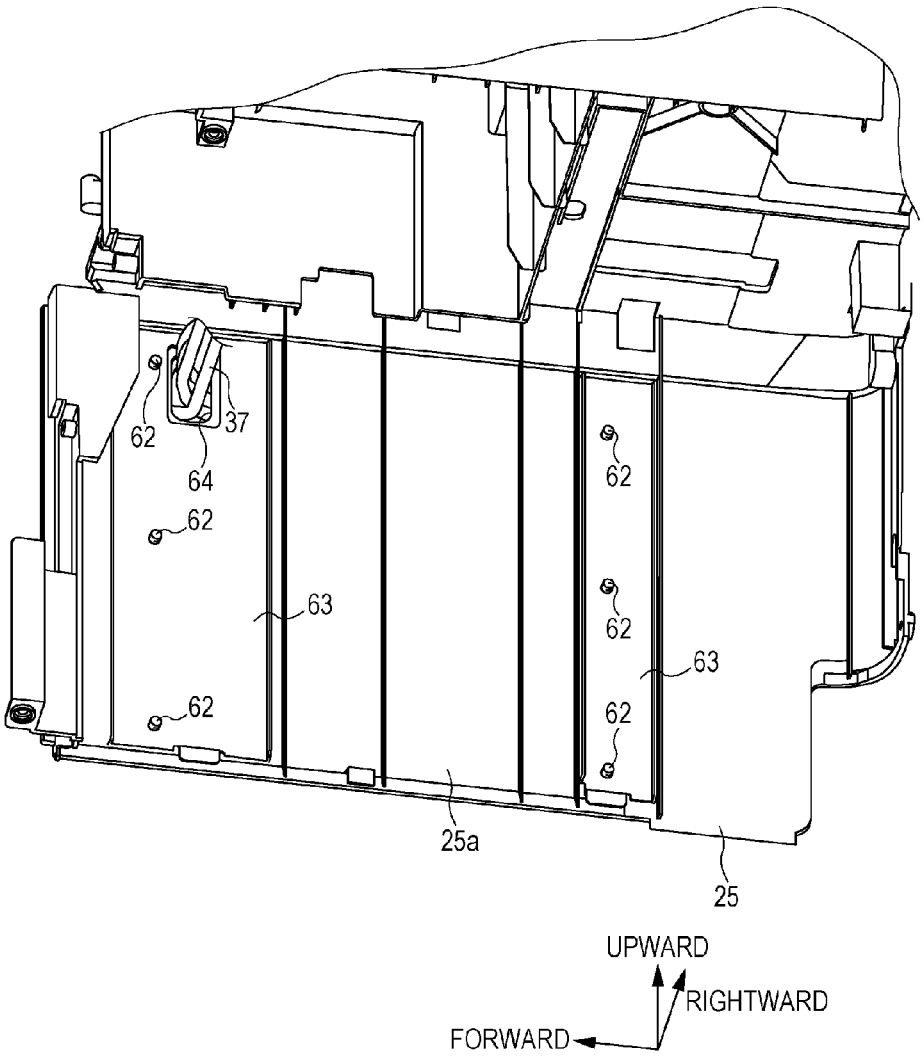
FIG. 7 is a perspective view when a left side wall of a housing is viewed from the inside (right side).

As illustrated in FIGS. 6 and 7, a container side insertion hole 61 serving as an example of an insertion portion into which the respective connection tubes 37 can be inserted is formed at a position near the front in an upper end portion on an inner side surface of the right side wall forming member 51. The right side wall forming member 51 is attached to a left side wall 25*a* of the housing 25 from the inner side of the container body 20 by using multiple (six in the embodiment) screws 62.

Figure 8:
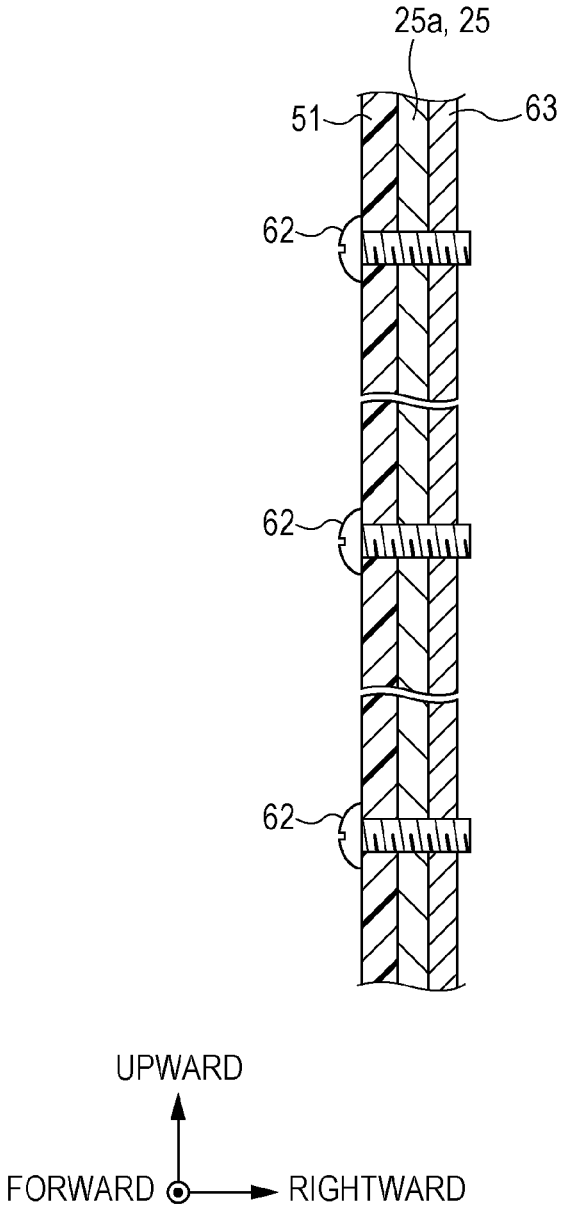
FIG. 8 is a schematic cross-sectional view illustrating a joining portion between an ink supply device and a housing.

In this case, as illustrated in FIGS. 7 and 8, the right side wall forming member 51 is fastened together with two rectangular-shaped sheet metal members 63 which are arranged in the left side wall 25*a* and inside the left side wall 25*a* so as to be equally spaced in the longitudinal direction, by using six screws 62, thereby being attached to the left side wall 25*a* of the housing 25.

Figure 9:
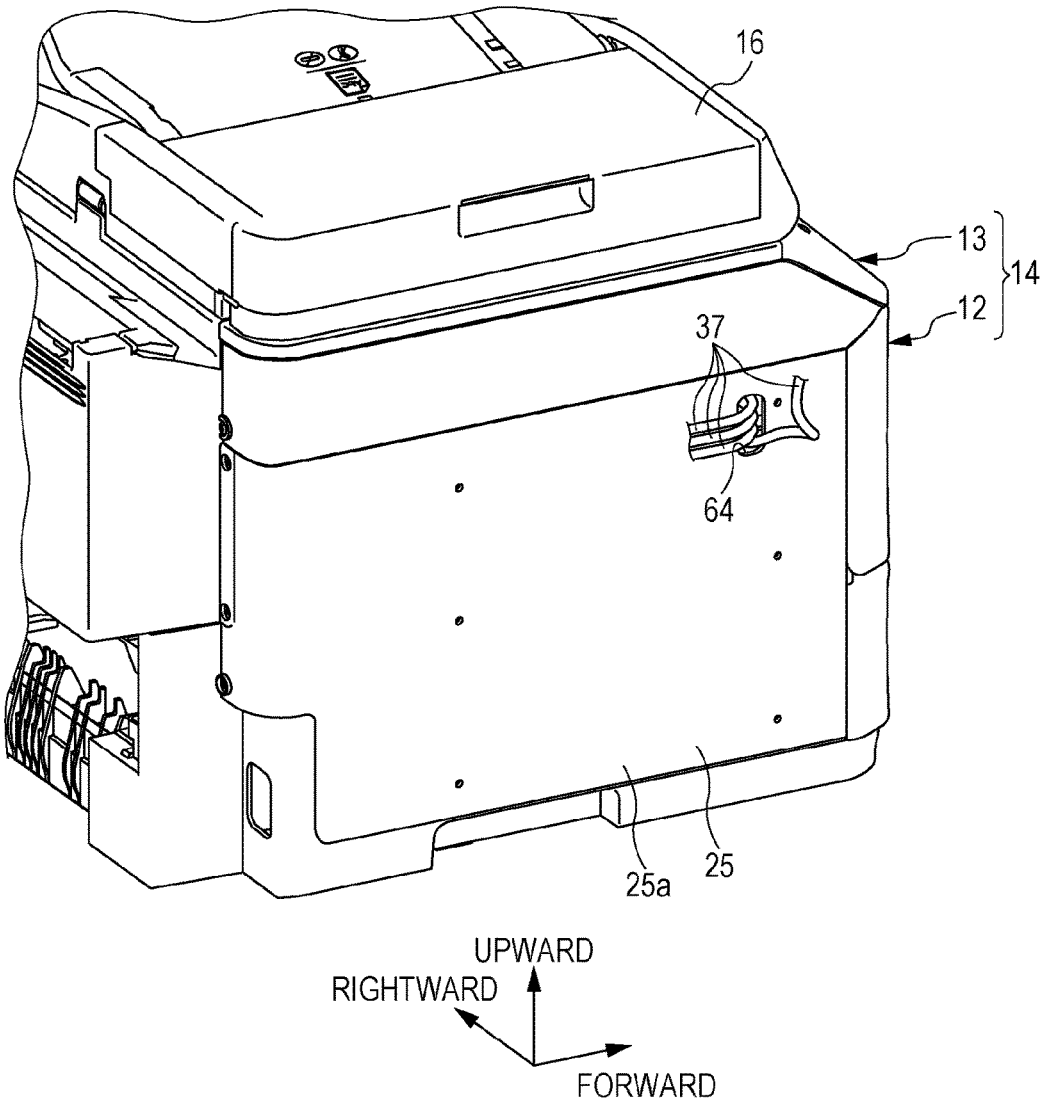
FIG. 9 is a perspective view when a recording apparatus is viewed from the left side.

As illustrated in FIG. 9, a housing side insertion hole 64 into which the respective connection tubes 37 are inserted is formed at a position corresponding to the container side insertion hole 61 on the left side wall 25*a* of the housing 25. Then, as illustrated in FIGS. 4 and 6, the respective connection tubes 37 whose downstream end side is connected to the respective ink supply needles 35 are inserted into the housing side insertion hole 64 and the container side insertion hole 61, and an upstream end side of the respective connection tubes 37 is arranged inside the container body 20.

In a state where the ink supply device 15 is attached thereto, the housing side insertion hole 64 is not exposed. Accordingly, it is possible to suppress degradation in appearance of the printer 11.

Figure 10:
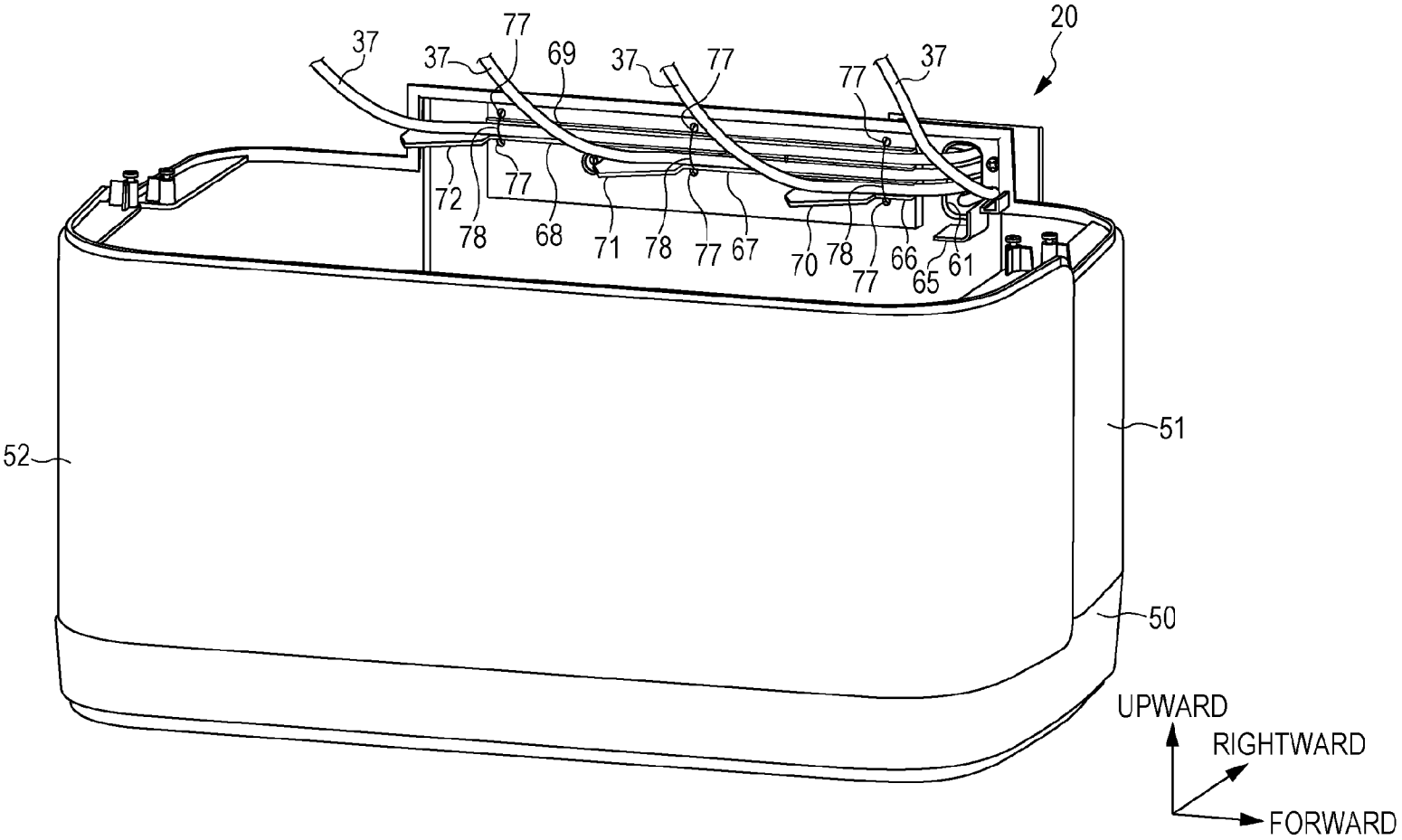
FIG. 10 is a perspective view when a container body is viewed from the left side.

As illustrated in FIG. 10, a first tube support portion 65 having an L-plate shape which supports one connection tube corresponding to the black ink out of the respective connection tubes 37 inserted into the container side insertion hole 61 is disposed at a position from the lower side over to the front side of the container side insertion hole 61 on an inner side surface of the right side wall forming member 51, so as to be adjacent to the container side insertion hole 61. On the rear side of the container side insertion hole 61 in the upper end portion on the inner side surface of the right side wall forming member 51, four plate-shaped ribs extending parallel to each other in the longitudinal direction are horizontally protruded leftward so as to be equally spaced in the vertical direction.

These four ribs are configured so that front ends thereof are aligned with each other, and serve as a first rib 66, a second rib 67, a third rib 68, and a fourth rib 69, sequentially from below to above. The length of the first rib 66 in the longitudinal direction is shorter than the length of the second rib 67, and the length of the second rib 67 in the longitudinal direction is shorter than the length of the third rib 68. The length of the third rib 68 in the longitudinal direction is the same as the length of the fourth rib 69.

In the rear end of the first rib 66, the second rib 67, and the third rib 68, the first tongue-piece portion 70, the second tongue-piece portion 71, and the third tongue-piece portion 72 which serve as an example of a plate-shaped support portion largely and horizontally protruding further inward (leftward) than these ribs 66 to 68 are respectively formed integrally with each other. The first to third tongue-piece portions 70 to 72 suppress the hanging-down of the respective connection tubes 37 by supporting the end portion of the respective ink containers 17 side in the respective connection tubes 37. The respective tongue-piece portions 70 to 72 are arranged so as to be equally spaced from each other in the longitudinal direction, and the width in the lateral direction becomes wider as it goes rearward. In this case, the respective tongue-piece portions 70 to 72 are arranged so as to correspond to the respective right protruding portions 55 (refer to FIG. 5) of the edge member 53. The respective tongue-piece portions 70 to 72 are covered by the above-described respective right protruding portions 55.

Between the first tongue-piece portion 70 and the container side insertion hole 61 in the longitudinal direction of the upper end portion of the inner side surface of the right side wall forming member 51, a pair of through-holes 77 serving as an example of a supplement portion is formed so as to interpose the first to fourth ribs 66 to 69 therebetween in the vertical direction. Between the first tongue-piece portion 70 and the second tongue-piece portion 71 in the longitudinal direction of the upper end portion of the inner side surface of the right side wall forming member 51, a pair of through-holes 77 is formed so as to interpose the second to fourth ribs 67 to 69 therebetween in the vertical direction.

Between the second tongue-piece portion 71 and the third tongue-piece portion 72 in the longitudinal direction of the upper end portion of the inner side surface of the right side wall forming member 51, a pair of through-holes 77 is formed so as to interpose the third rib 68 and the fourth rib 69 therebetween in the vertical direction. A wire 78 is caused to pass through the respective pair of through-holes 77 so as to form an annular shape, and end portions of the wire 78 are connected to each other. In this manner, the respective connection tubes 37 are reliably held.

Figure 11A:
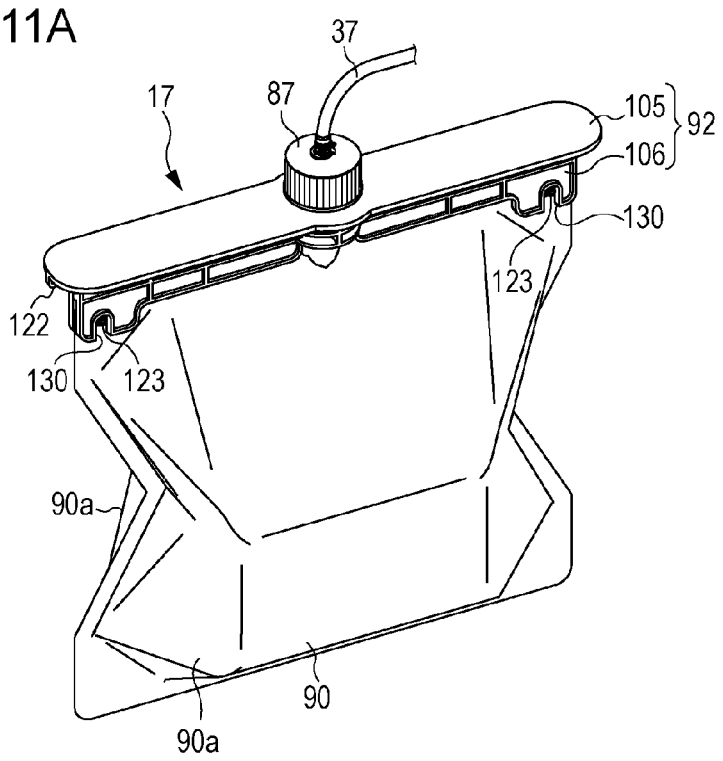
FIGS. 11A and 11B are perspective views of an ink container.

Next, a configuration of the ink container will be described in detail. As illustrated in FIG. 11A, the respective ink containers 17 include an ink bag 90 serving as an example of a liquid containing portion for containing the ink. A support member (hanger member) 92 configuring a liquid container support portion supported by the container body 20 (refer to FIG. 5) is attached to the upper end side (one end side) in the ink bag 90. That is, the ink bag 90 engages with the support member 92.

The ink bag 90 is formed by welding peripheral edges of two flexible films 90*a* in a state where a cylindrical ink outlet portion (not illustrated) is interposed between the outer peripheral edges of the two rectangular-shaped flexible films 90*a*. That is, the ink bag 90 is a bag body configured to have the flexible films 90*a* serving as two opposing flexible walls, and is formed so that the two opposing flexible films 90*a* are caused to come close to each other by consumption of the ink contained inside thereof. In the embodiment, a flexible portion is configured to have the two flexible films 90*a* configuring the ink bag 90.

In this manner, the ink bag 90 contracts in response to the consumption of the ink. Therefore, it is possible to prevent the ink from not being supplied to the recording head 28 side, which is caused by a negative pressure inside the ink bag 90 in response to the consumption of the ink.

The support member 92 of the respective ink containers 17 includes a first support member 105 and a second support member 106 which are attached to an upper end portion of the ink bag 90 so as to mutually interpose the upper end portion therebetween. Cylindrical-shaped convex portions 123 inserted into an ink bag through-hole (not illustrated) formed in the ink bag 90 are respectively protruded in both end portions in the second support member 106. An engagement cut-out recess 130 engaging with the convex portion 123 inserted into the ink bag through-hole is formed in the second support member 106.

Figure 12:
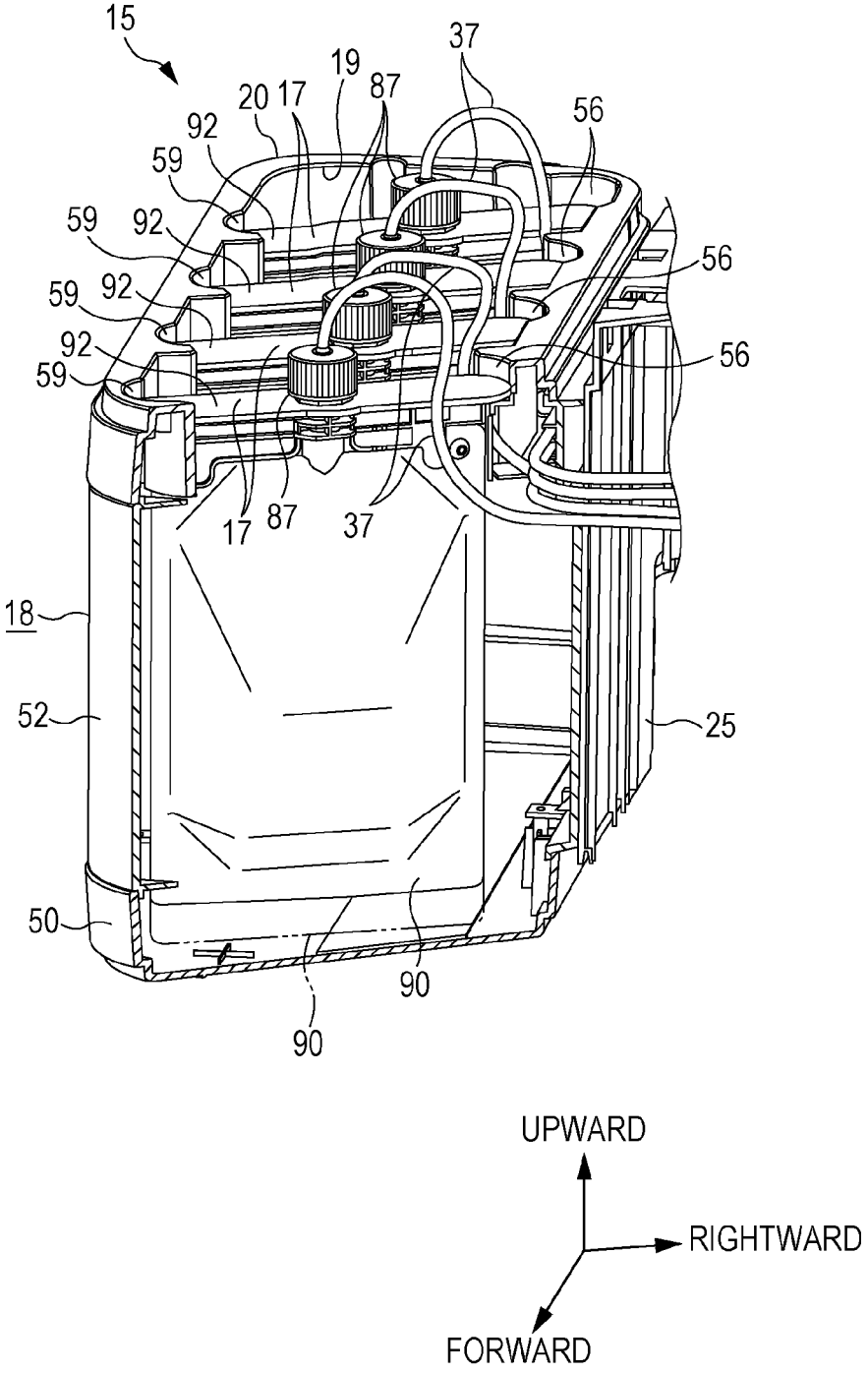
FIG. 12 is a partially cutaway perspective view illustrating a state when an interior of an ink supply device is viewed from the front side.

Next, an operation when the respective ink containers 17 internally filled with the ink are set in the case 18 will be described. As illustrated in FIGS. 3 and 12, when the respective ink containers 17 are set in the case 18, the lid body 21 is first opened, and then, the ink container 17 is contained inside the container body 20 via the opening 19 of the container body 20. At this time, a protruding-piece portion 122 disposed in both end portions of the first support member 105 of the respective ink containers 17 is supported by the right recess 56 and the left recess 59 which oppose each other in a direction obliquely intersecting the lateral direction by an angle of 30 degrees.

Then, both end portions of the first support member 105 are respectively inserted into the cut-out recess 56*a* (refer to FIG. 5) and the cut-out recess 59*a* (refer to FIG. 5). In this manner, the respective ink containers 17 are contained in the container body 20 mutually side by side in the longitudinal direction in a state of being detachably supported so as to obliquely intersect the lateral direction by an angle of 30 degrees. In this case, the respective ink containers 17 are in a state of being suspended by the right recess 56 and the left recess 59 of the container body 20 in the support member 92 positioned on the upper end side (one end side). Therefore, the respective ink containers 17 are in a state of floating from the inner bottom surface of the container body 20.

In the respective ink containers 17, the lower end of the ink bag 90 is lowered (illustrated by the two-dot chain line in FIG. 12) by a reduced thickness in response to the consumption of the ink inside the ink bag 90. However, even when the ink inside the ink bag 90 is consumed all, the state of floating from the inner bottom surface of the container body 20 is maintained.

Then, as illustrated in FIG. 2, setting work of the respective ink containers 17 into the case 18 is completed by closing the lid body 21. If the respective ink containers 17 are set into the case 18, the inks in the respective ink containers 17 are supplied to the recording head 28 via the respective connection tubes 37. The respective inks supplied to the recording head 28 are ejected onto the sheet P through the respective nozzles (not illustrated) of the recording head 28 to perform the printing.

Then, if the inks of the respective ink containers 17 are consumed by the printing of the sheet P, the ink bag 90 of the respective ink containers 17 is gradually deflated in response to the consumption of the inks. At this time, since the left side wall forming member 52 configuring the container body 20 of the case 18 is transparent, a deflated condition (displacement state) of the ink bag 90 of the respective ink containers 17 inside the case 18 is visibly checked from outside of the case 18 through the left side wall forming member 52 without opening the lid body 21.

In this case, in particular, the left side wall forming member 52 occupies not only the majority of the left side surface of the container body 20, but also the majority of the left half on the front side surface and the rear side surface of the container body 20. The respective ink containers 17 are arranged side by side in the longitudinal direction so as to be parallel to each other in a state of being tilted so that the left side ink container is positioned at the further front side than the right side ink container inside the case 18.

Therefore, the deflated condition of the ink bag 90 of all the ink containers 17 inside the case 18 is visibly checked from the front side of the case 18 (from outside of the case 18). Accordingly, it is possible to estimate the replacement time for the respective ink containers based on the deflated condition of the ink bag 90 in the respective ink containers 17.

The above-described printer 11 includes the recording head 28 which can eject the ink onto the sheet P, the transport unit which transports the sheet P to the recording head 28, the housing 25 which contains the recording head 28 and the transport unit, the case 18 which is arranged on the outer side surface of the housing 25 so that the bottom wall forming member 50 is positioned higher than the bottom surface of the housing 25, and which serves as the holder for holding the ink container 17 containing the ink, and the supply unit (connection tube 37) which supplies the ink from the ink container 17 to the recording head 28.

According to this configuration, there is provided the case 18 which is arranged on the outer side surface of the housing 25 so that the bottom wall forming member 50 is positioned higher than the bottom surface of the housing 25, and which holds the ink container 17 containing the ink. In this manner, it is possible to install even the printer 11 using the ink container 17 having the large containing capacity without increasing the installation space for the printer 11.

In the present embodiment, the ink supply device 15 having the case 18 is provided on the left side surface (one outer side adjacent to the outer side surface having the opening 30 which is the insertion port of the housing 25) of the main apparatus body 14. However, the ink supply device may be provided which has the case holding the ink container 17 on the right side surface (the other outer side adjacent to the outer side surface having the opening 30) of the main apparatus body 14.

At least one ink container 17 out of the multiple ink containers 17 may have the containing capacity different from that of the other ink container 17. According to this configuration, depending on types of the liquid, it is possible to change the containing capacity of the liquid which can be supplied to the recording head.

For example, the multiple ink containers 17 include the ink container 17 containing at least the black ink, and the ink container 17 containing the black ink has the containing capacity larger than that of the other ink container 17.

According to this configuration, it is possible to supply the recording head 28 with the more of the black ink frequently used.

The bottom wall forming member 50 of the case 18 may be arranged at a position higher than the bottom surface of the housing 25 by 50 mm. In this manner, in a state where the recording media such as the sheets are stacked one on another up to less than 50 mm, the recording media can be partially placed on the lower portion of the case 18 by being stacked thereon. Therefore, the installation area for the printer 11 including the recording media placed on the left side of the main apparatus body 14 can be reduced.

In the ink container 17, both end portions of the support member 92 are not necessarily supported and suspended by the right recess 56 and the left recess 59 of the case 18. That is, the ink container 17 may be contained in a state of being placed on the inner bottom surface of the case 18. In this case, the inner bottom surface (bottom wall 49) of the case 18 functions as a support portion for supporting the ink container 17.

A hard support portion having a shape which can be supported by the right recess 56 and the left recess 59 of the case 18 may be disposed in the upper end portion (one end side which is the cap 87 side) of the ink bag 90 of the ink container 17, as a liquid container support portion instead of the support member 92. According to this configuration, the ink container 17 can be handled by gripping the support portion. Therefore, it is possible to easily attach and detach the ink container 17 to and from the right recess 56 and the left recess 59 of the case 18.

The ink container 17 is not necessarily supported by the right recess 56 and the left recess 59 of the case 18 via the support member 92. The distance between the right side wall 45 and the left side wall 46 in the case 18 is not necessarily shorter than the width of the ink container 17.

The case 18 holds the multiple ink containers 17 so as not to be overlapped with each other in the height direction of the housing 25. In this manner, the ink containers 17 do not get affected by each other, and the ink can be fully used up.

The case 18 does not necessarily have the transparent left side wall forming member 52 through which the deflated condition of the ink bag 90 in response to the consumption of the ink inside the ink container 17 is visibly checked. The opening 19 of the case 18 is not necessarily disposed in the upper end of the container body 20, and may be disposed on a side surface of the container body 20.

The lid body 21 of the case 18 may be omitted. The ink bag 90 is not necessarily configured to entirely have the flexible film 90*a*. That is, the ink bag 90 may be configured to have a flexible portion, a portion of which is formed of a flexible material. The material configuring the flexible portion of the ink bag 90 may be transparent or opaque.

The side wall of the container body 20 of the case 18 is not necessarily configured by assembling the right side wall forming member 51 and the left side wall forming member 52 which are laterally divided. That is, the side wall of the container body 20 may be configured by assembling three or more divided members, or may be configured to have one undivided member.

The through-hole 77 formed in the container body 20 of the case 18 may be omitted. The cut-out portion 57 disposed in the edge member 53 of the case 18 may be omitted. Instead of the cut-out portion 57, a hole into which the connection tube 37 can be inserted may be disposed in the edge member 53 of the case 18 as an insertion portion. The right side wall forming member 51 and the left side wall forming member 52 which configure the container body 20 may have a plate shape which is bent in an L-shape.

The color of the respective caps 87 may be matched with the color of the ink contained in the respective ink containers 17 corresponding to the respective caps 87. According to this configuration, it is possible to prevent the cap 87 from being erroneously connected to the ink container 17.

In the printer 11, the case 18 is not necessarily detachably attached to the printing unit 12 of the main apparatus body 14. That is, the case 18 may be fixedly attached to the printing unit 12 of the main apparatus body 14.

In the printer 11, the height of the case 18 is not necessarily set to be lower than the height of the reading surface 13*a*. That is, the height of the case 18 may be set to be the same as the height of the reading surface 13*a*, or may be set to be higher than the height of the reading surface 13*a*.

Next, an operation when the document G larger than the reading surface 13*a* is read by the reading unit 13 of the printer 11 will be described.

As illustrated in FIG. 2, when the document G larger than the reading surface 13*a* is read by the reading unit 13, the automatic document feeder 16 is first opened to expose the reading surface 13*a*. Subsequently, the document G is mounted on the reading surface 13*a* so that a region to be read in the document G fits the reading surface 13*a* and a portion of the document G which protrudes from the reading surface 13*a* is partially positioned on the case 18 (on the lid body 21).

At this time, the height of the case 18 is aligned with the height of the reading surface 13*a*. That is, the height of the case 18 is lower than the height of the reading surface 13*a* by 5 mm.

Therefore, the document G is supported on the case 18 without being partially caught on the side surface of the case 18. Then, if the reading unit 13 is operated in a state where the automatic document feeder 16 is closed, the region on the reading surface 13*a* in the document G is read.

In this manner, the portion of the document G which protrudes from the reading surface 13*a* is partially supported by the case 18. Accordingly, the position of the document G is stabilized, thereby enabling the reading unit 13 to accurately read the document G.

Modification Example

The above-described embodiment may be modified to another embodiment as follows.

Figure 13:
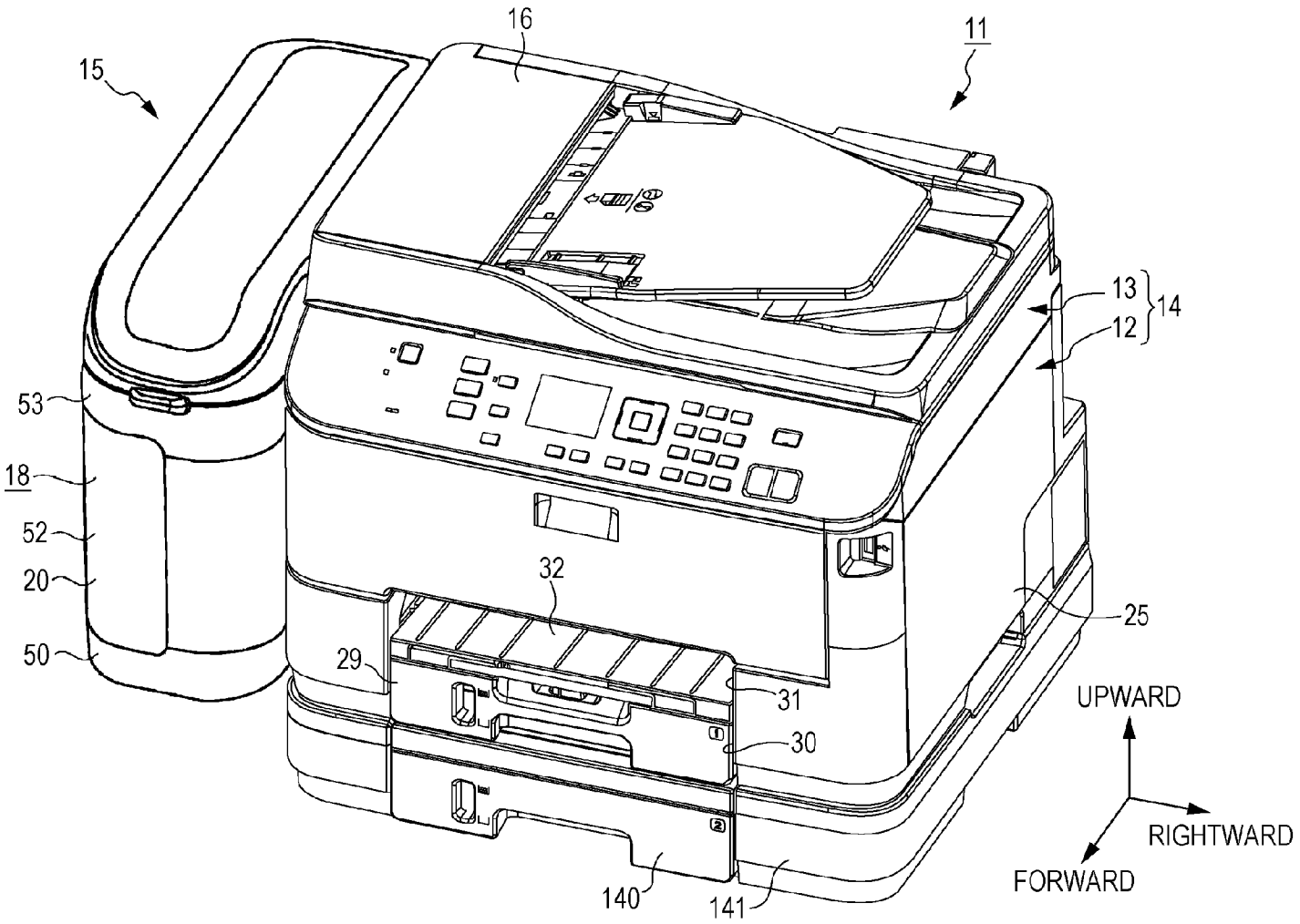
FIG. 13 is an external perspective view of a recording apparatus where an additional cassette unit is mounted on a lower portion of a main apparatus body.

FIG. 13 is a perspective view of the printer 11 where an additional cassette unit 141 is mounted on a lower portion of the main apparatus body 14. As illustrated in FIG. 13, in the printer 11, the additional cassette unit 141 having an additional sheet cassette 140 may be mounted on the lower portion of the main apparatus body 14.

Figure 14:
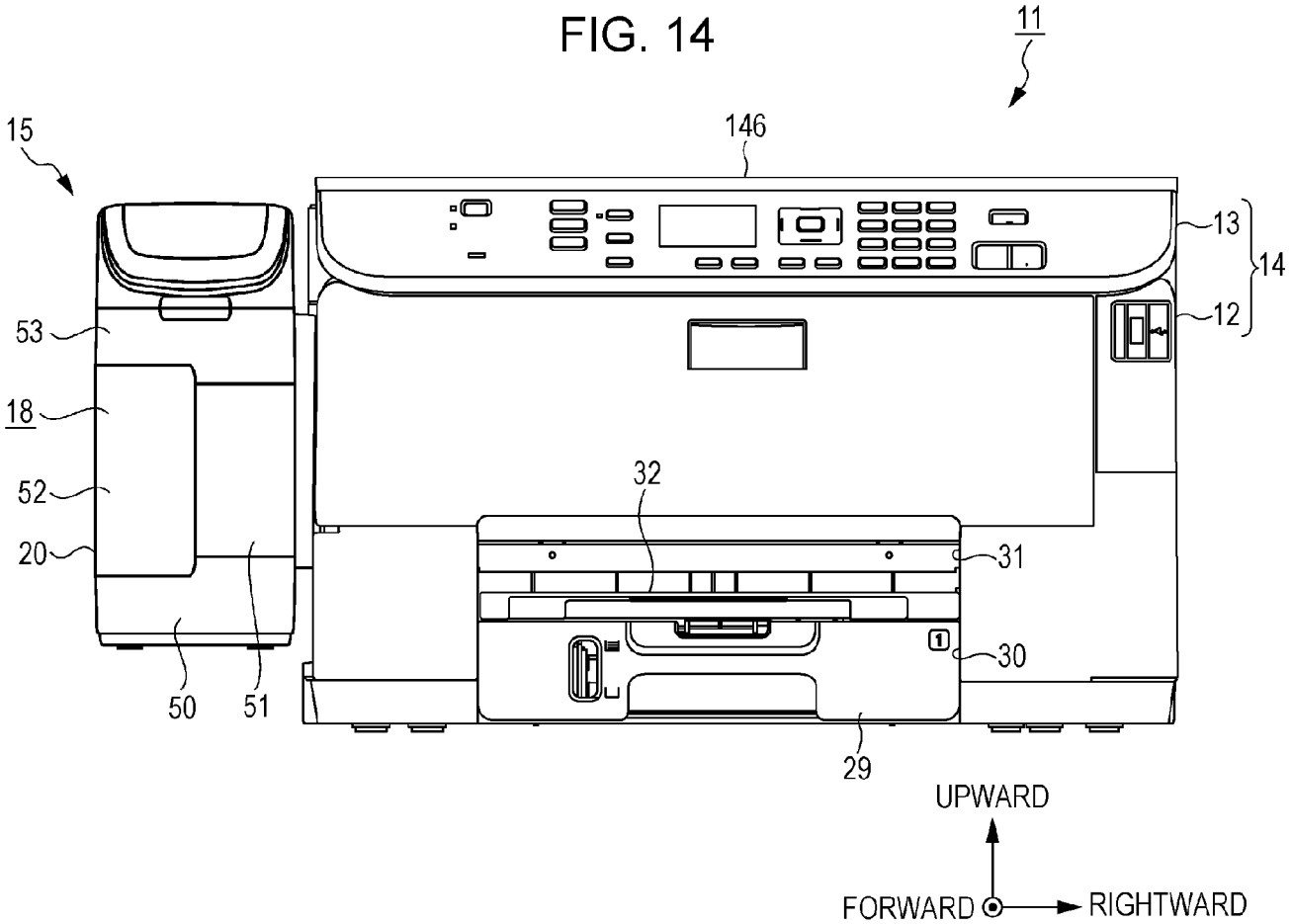
FIG. 14 is a view illustrating a recording apparatus including a lid member in a reading unit.

FIG. 14 is a view when the printer 11 including a lid member 146 in the reading unit 13 is viewed from the front. As illustrated in FIG. 14, in the printer 11, the automatic document feeder 16 may be replaced with the lid member 146 which can open and close the reading surface 13*a*. The reading unit 13 may be omitted, and the lid member 146 may be configured so that the upper surface of the printing unit 12 is opened.

Figure 11B:
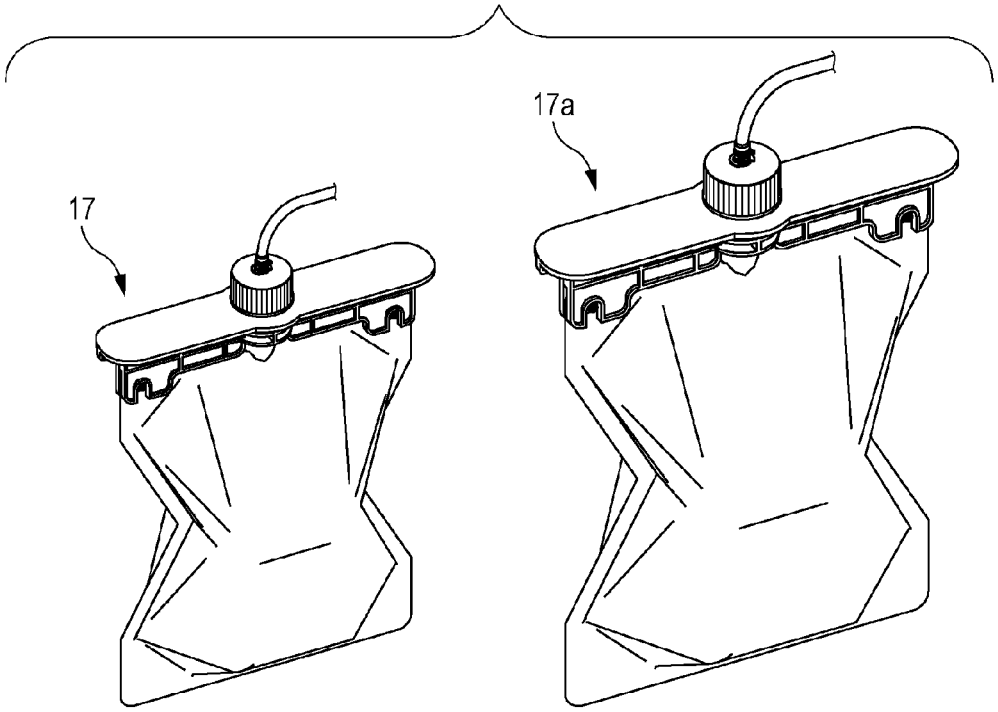
Figure 15:
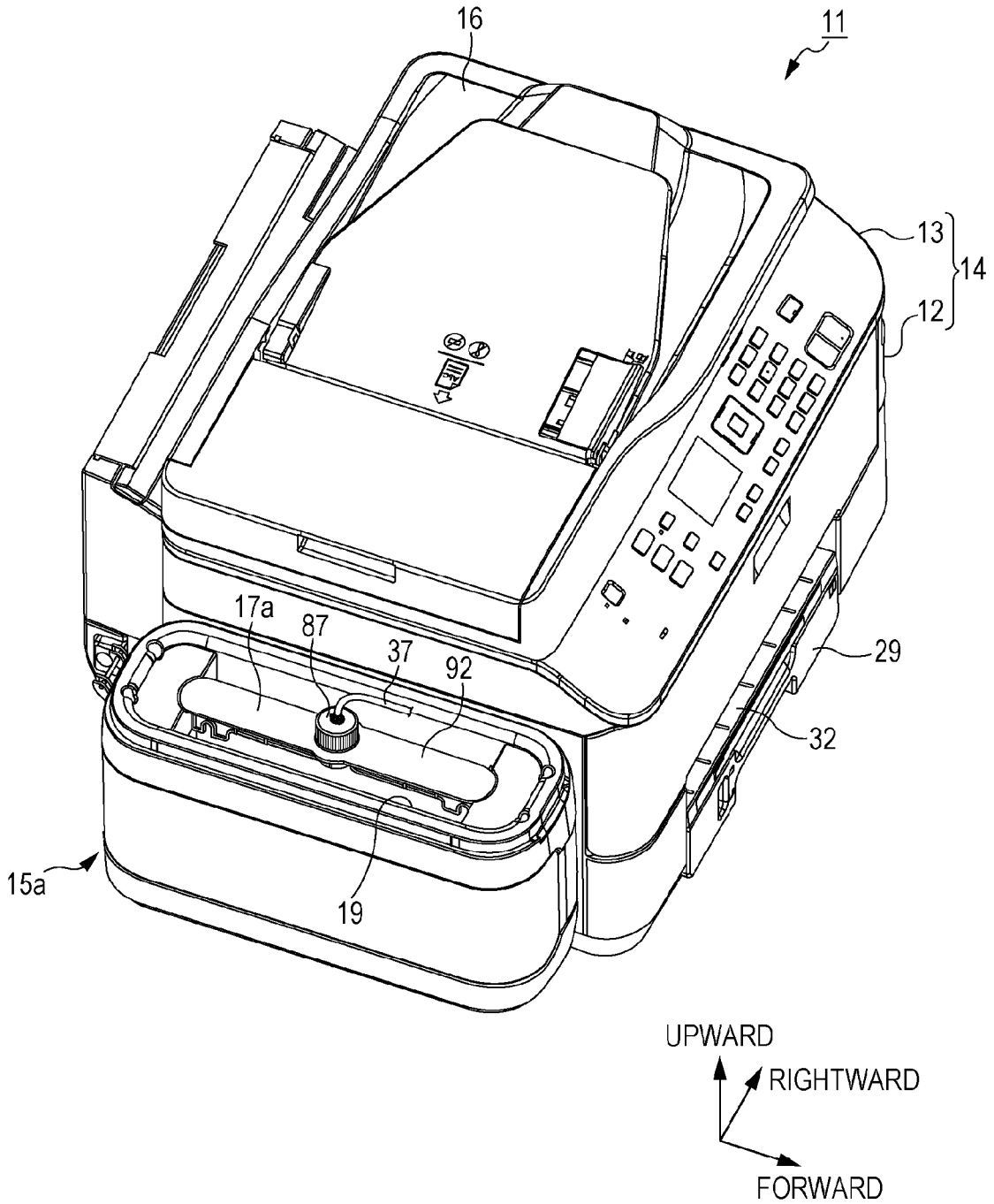
FIG. 15 is a perspective view of a recording apparatus including an ink supply device which contains one ink container.

FIG. 15 is a perspective view of the printer 11 including an ink supply device 15*a* containing one ink container 17*a*. FIG. 11B illustrates the ink container 17 in FIG. 3 and the ink container 17*a* having a size larger than that of the ink container 17. The configuration of the ink container 17*a* is the same as the configuration of the ink container 17 having a different size.

As illustrated in FIG. 15, if the printer 11 is a monochromatic printer in which the printing unit 12 uses only the black ink, the printer 11 may include the ink supply device 15*a* in which one ink container 17*a* containing the black ink is arranged. In this case, the ink container 17*a* is contained so that the width direction thereof becomes the longitudinal direction. In FIG. 15, the lid body 21 which covers the opening 19 so as to be openable and closeable is omitted.

Figure 16:
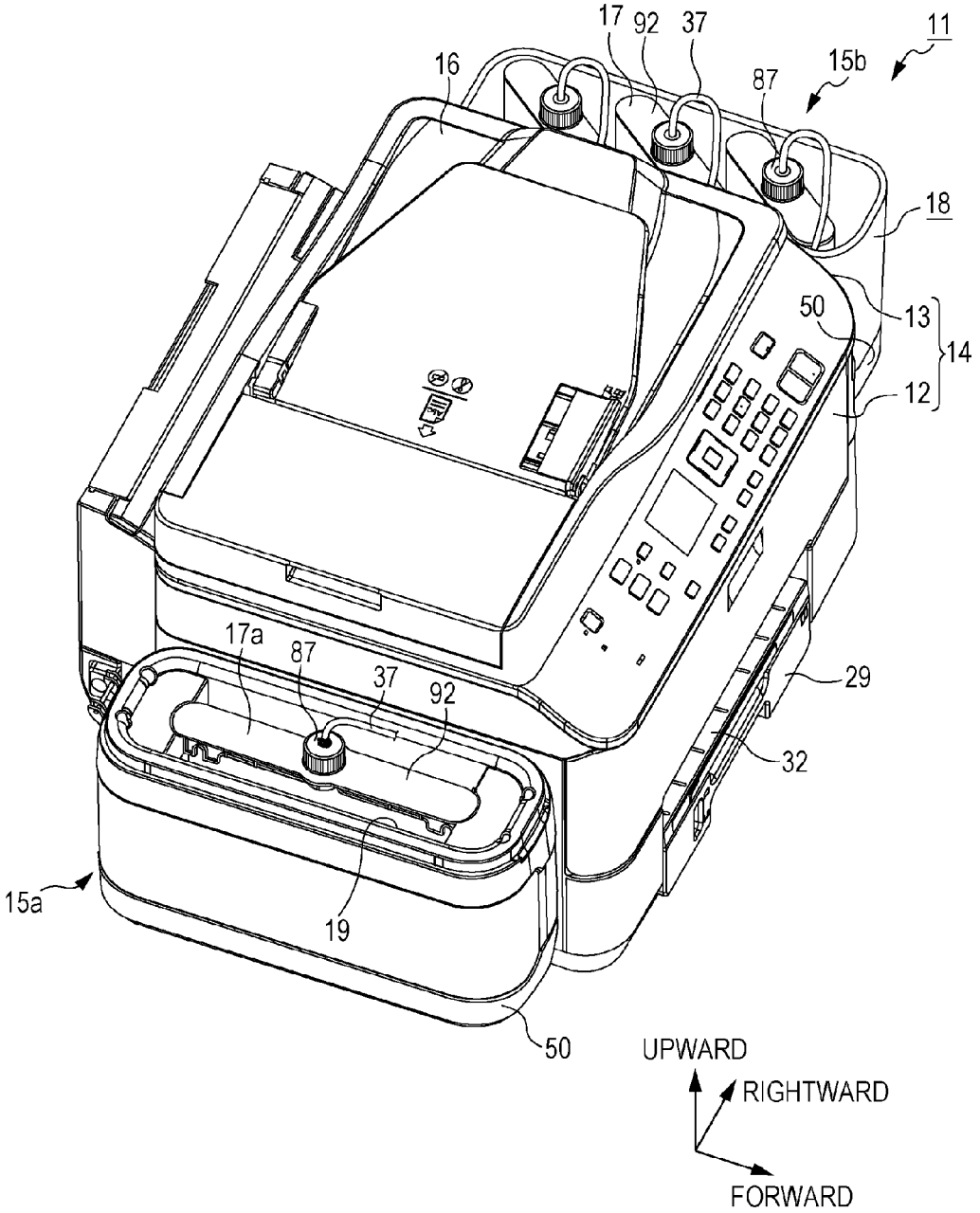
FIG. 16 is a perspective view of a recording apparatus including an ink supply device on both side outer surfaces of a main apparatus body.

FIG. 16 is a perspective view of the printer 11 including respective ink supply devices 15*a* and 15*b* on both side outer surfaces in the lateral direction of the main apparatus body 14. As illustrated in FIG. 16, the ink supply devices 15*a* and 15*b* may be configured to be respectively arranged on the left side surface and the right side surface of the main apparatus body 14. In this case, the ink container 17*a* containing the black ink is arranged in the ink supply device 15*a* arranged on the right side surface of the main apparatus body 14, and the ink containers 17 respectively containing the cyan ink, the magenta ink, and the yellow ink are arranged in the ink supply device 15*b* arranged on the right side surface of the main apparatus body 14. Similar to the ink supply device 15*a*, the connection tube 37 for supplying the ink from the ink supply device 15*b* to the recording head 28 is arranged.

According to this configuration, it is possible to increase the containing capacity of the respective ink containers 17 containing the cyan ink, the magenta ink, and the yellow ink which are contained in the right side ink supply device 15*b*. The ink container 17*a* containing only the black ink is arranged in the left side ink supply device 15*a*. Accordingly, it is possible to increase the containing capacity of the ink container 17*a* containing the black ink which is frequently used.

On the other hand, the ink supply device containing the ink containers 17 respectively containing the cyan ink, the magenta ink, and the yellow ink may be arranged on the left side, and the ink supply device containing the ink container 17*a* containing the black ink may be arranged on the right side. The outer diameter dimensions in the ink supply device 15*a* and the ink supply device 15*b* may be substantially the same as each other, or may be different from each other.

The ink supply devices 15*a* and 15*b* are respectively attached to the left side wall and the right side wall of the printing unit 12 so that the bottom wall forming member 50 is positioned higher than the printing unit 12. In this manner, the ink supply devices 15*a* and 15*b* are arranged in a state where similar to the bottom wall forming member 50 in FIG. 1, the bottom wall forming member is away from the installation surface. Accordingly, even in a configuration where the ink supply devices 15*a* and 15*b* are respectively arranged on both sides of the printing unit 12, the installation area (ground contact area) for the printer 11 is not increased.

Figure 17:
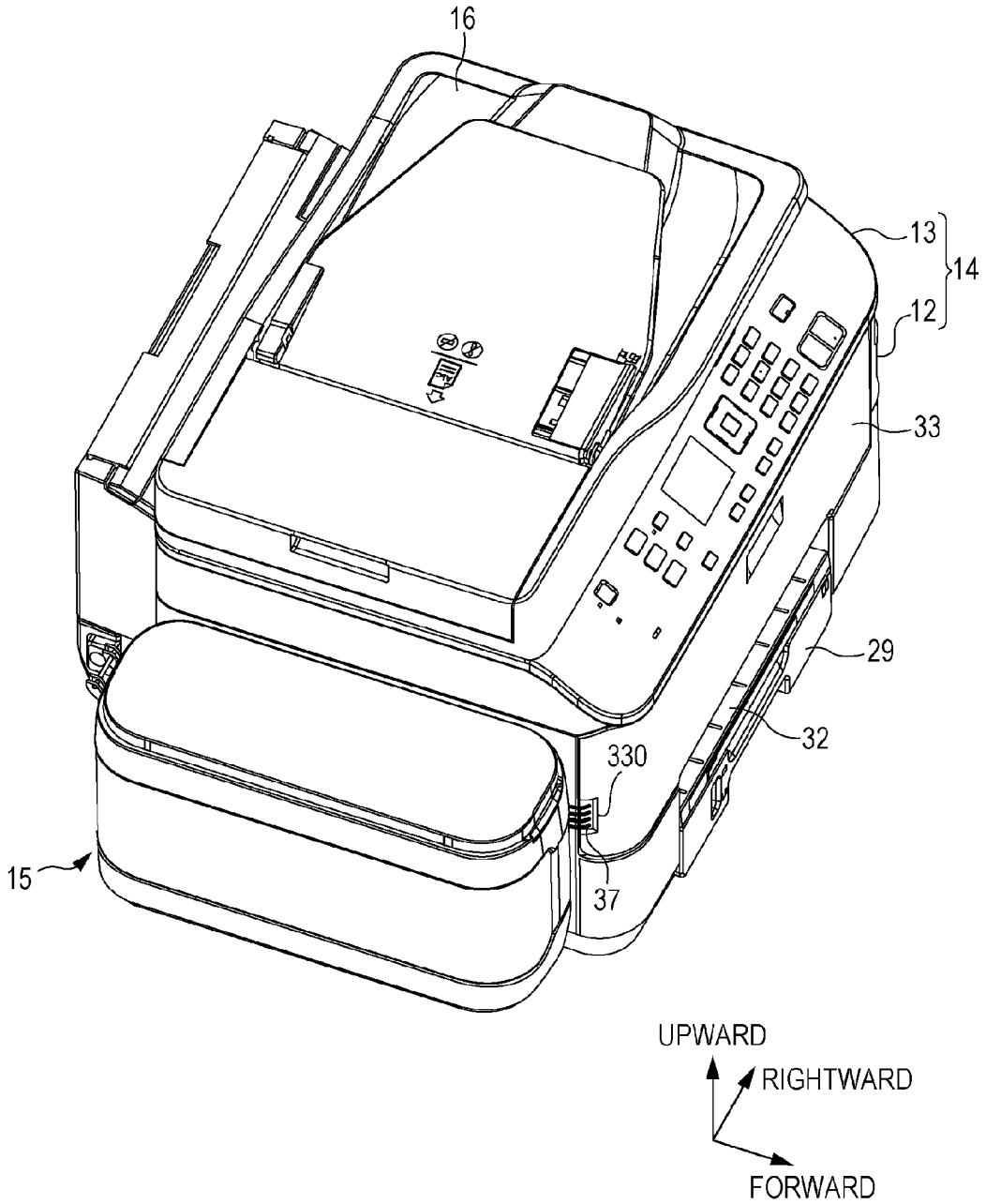
FIG. 17 is a perspective view of a recording apparatus where a cut-out portion is disposed in a cover of a printing unit.

FIG. 17 is a perspective view of the printer 11 in which a cut-out portion 330 is disposed in a cover 33 of the printing unit 12. As illustrated in FIG. 17, the cut-out portion 330 is disposed in a left side end portion of the cover 33. The cover 33 is provided above the sheet discharge tray 32 so as to be pivotally movable.

Figure 18:
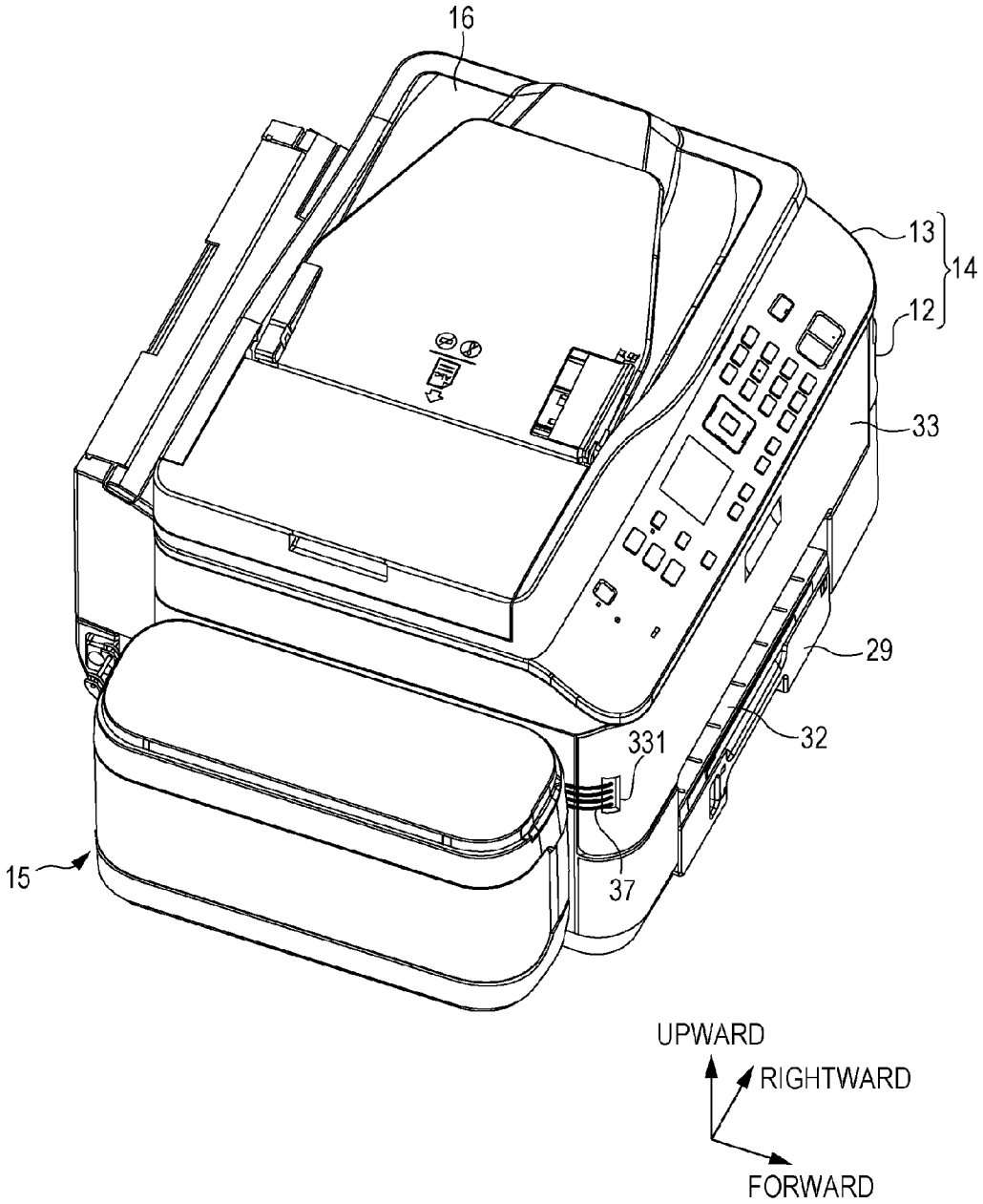
FIG. 18 is a perspective view of a recording apparatus where a through-hole is disposed in a cover of a printing unit.

The ink may be supplied from the ink supply device 15 to the recording head 28 contained inside the housing of the printing unit 12 via the connection tube 37 passing through a gap formed by the cut-out portion 330. FIG. 18 is a perspective view of the printer 11 in which a through-hole 331 is disposed in the cover 33 of the printing unit 12.

As illustrated in FIG. 18, the through-hole 331 is disposed in the left side end portion of the cover 33. The cover 33 is provided so as to be pivotally movable in a state where the connection tube 37 passes through the through-hole 331. The ink may be supplied from the ink supply device 15 to the recording head 28 contained inside the housing of the printing unit 12 via the connection tube 37 passing through a gap formed by the through-hole 331.

Figure 19:
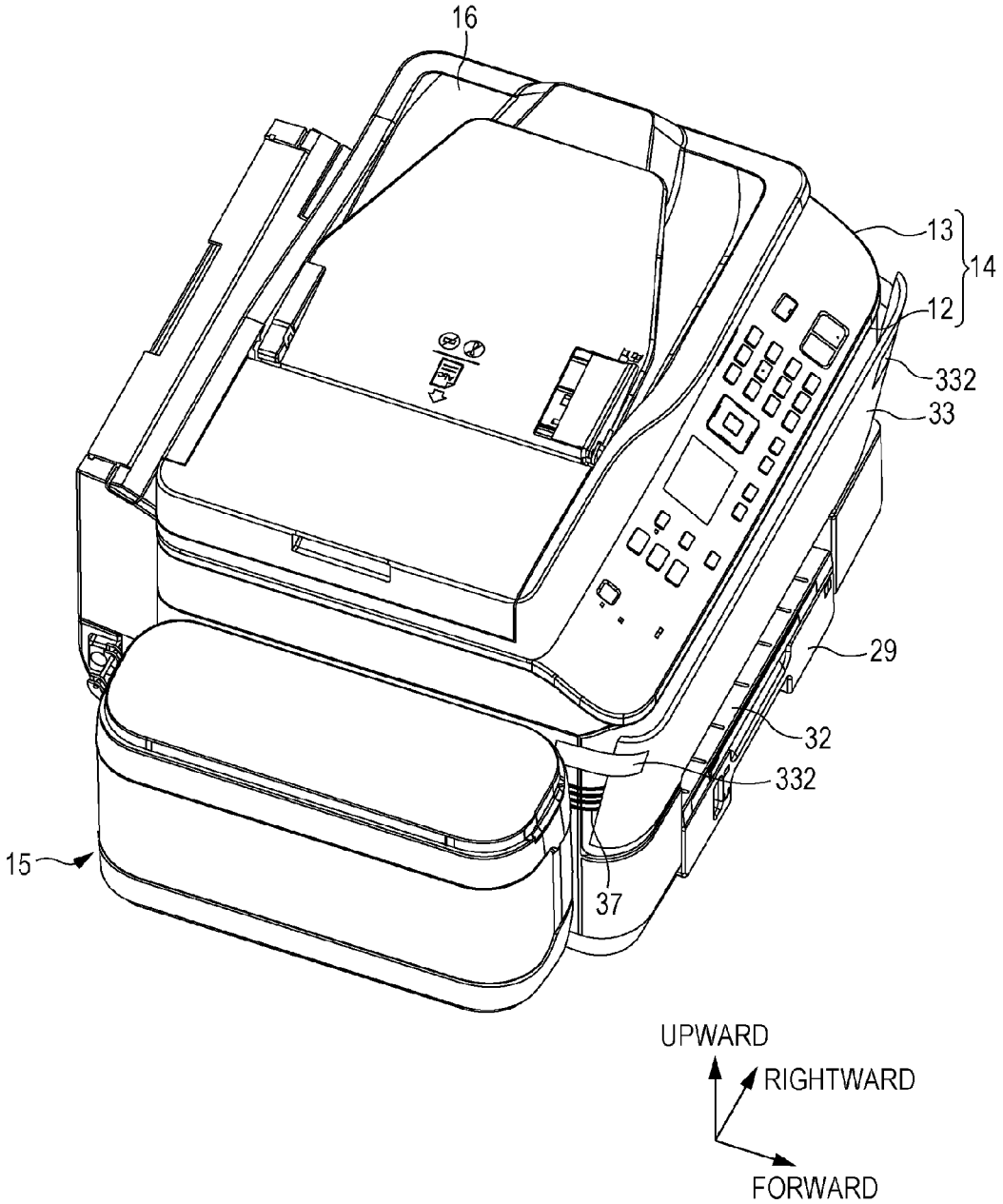
FIG. 19 is a perspective view of a recording apparatus where a connection tube passes through a portion between a cover of a printing unit and a housing.

FIG. 19 is a perspective view of the printer 11 in which the connection tube 37 passes between the cover 33 and the housing of the printing unit 12. As illustrated in FIG. 19, the cover 33 which is an openable and closeable member is fixed by a tape-like adhesive member 332 serving as a fixing member, in a state of being slightly opened and interposing the connection tube 37 between the housing of the printing unit 12 and the cover 33. The ink may be supplied from the ink container 17 to the recording head 28 contained inside the housing 25 via the connection tube 37 passing through a gap between the cover 33 and the housing of the printing unit 12.

According to this configuration, the housing 25 or the cover 33 does not need to be processed. The ink is supplied from the ink container 17 arranged outside the housing 25 to the recording head 28 contained inside the housing 25.

Figure 20:
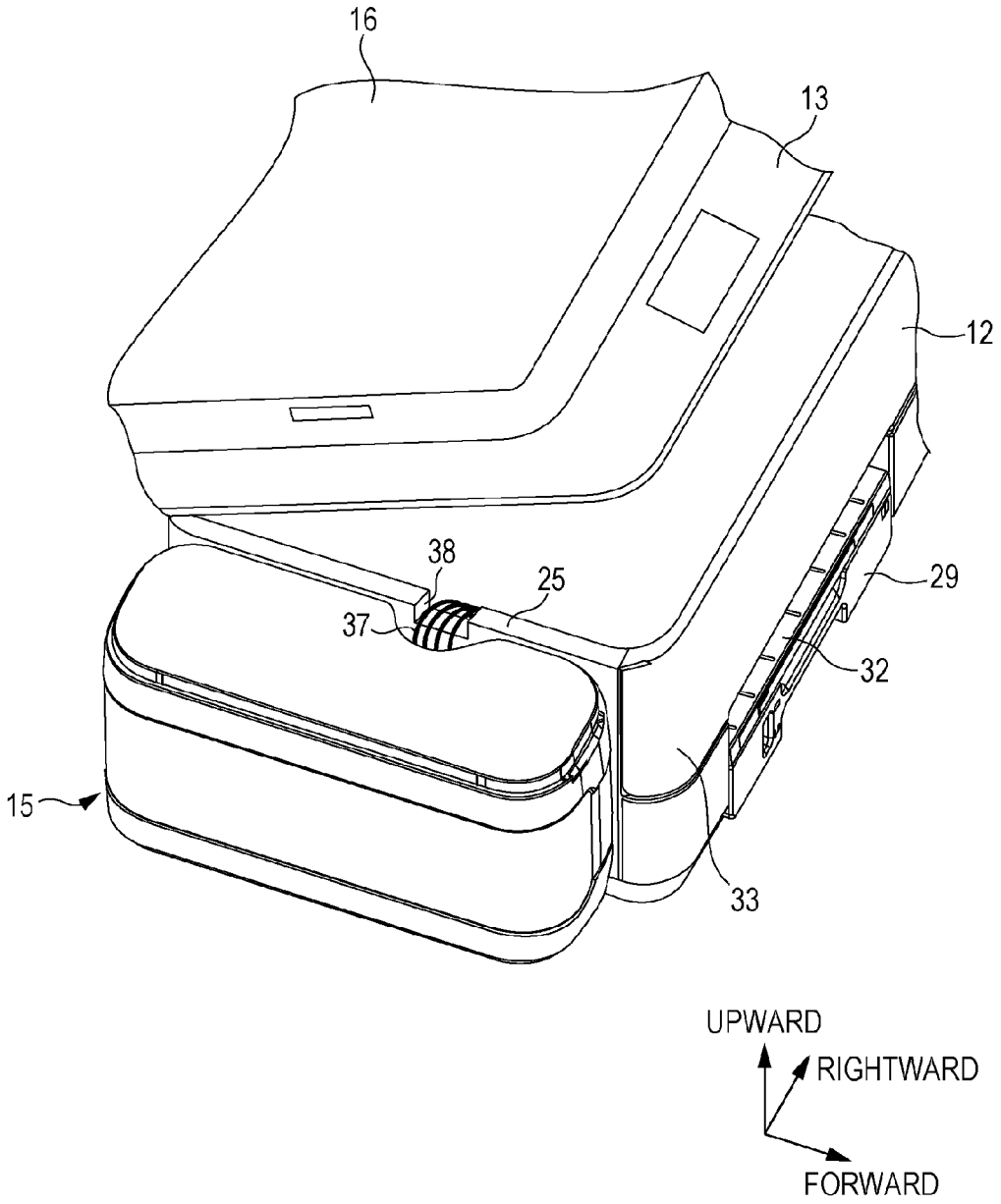
FIG. 20 is a perspective view illustrating a portion of a connection tube which passes through a cut-out portion disposed between a reading unit and a printing unit.

FIG. 20 is a perspective view illustrating a portion of the connection tube 37 passing through a cut-out portion 38 disposed between the reading unit 13 and the printing unit 12. The reading unit 13 is provided so as to be pivotally movable with respect to the printing unit 12, and also functions as a lid portion of the printing unit 12. In the embodiment, the reading unit 13 also serves as the lid portion of the printing unit 12, but the lid portion may be a simple lid having no function as the reading unit.

As illustrated in FIG. 20, the cut-out portion 38 is disposed in a left side upper end portion of the housing 25 of the printing unit 12. In a state where the reading unit 13 closes the printing unit 12, a gap is formed by the cut-out portion 38. The connection tube 37 passes through the cut-out portion 38, and the ink is supplied from the ink supply device 15 to the recording head 28 via the connection tube 37.

Figure 21:
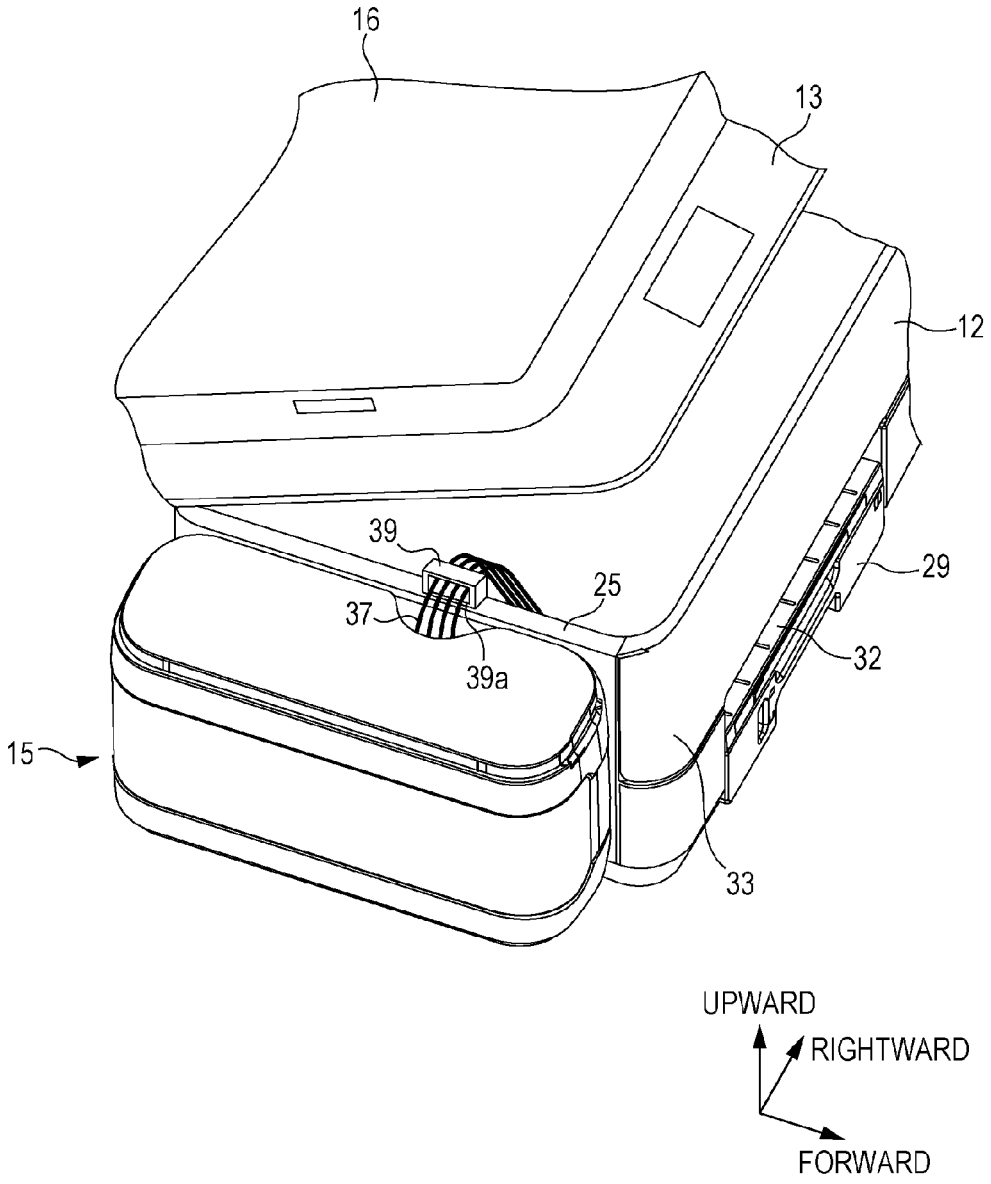
FIG. 21 is a perspective view illustrating a portion of a connection tube which passes through a gap forming member disposed between a reading unit and a printing unit.

FIG. 21 is a perspective view illustrating a portion of the connection tube 37 passing through a gap forming member 39 disposed between the reading unit 13 and the printing unit 12. The reading unit 13 is provided so as to be pivotally movable with respect to the printing unit 12.

As illustrated in FIG. 21, the gap forming member 39 is disposed in the left side upper end portion of the housing 25 of the printing unit 12. In a state where the reading unit 13 closes the printing unit 12, a gap is formed by the gap forming member 39. The connection tube 37 passes through a through-hole 39*a* of the gap forming member 39, and the ink is supplied from the ink supply device 15 to the recording head 28 via the connection tube 37.

In this manner, there is no possibility that the connection tube 37 may be deformed by being interposed and pressed between the reading unit 13 and the housing 25. Accordingly, there is no possibility that the flow of the ink inside the connection tube 37 may be suppressed.

Figure 22:
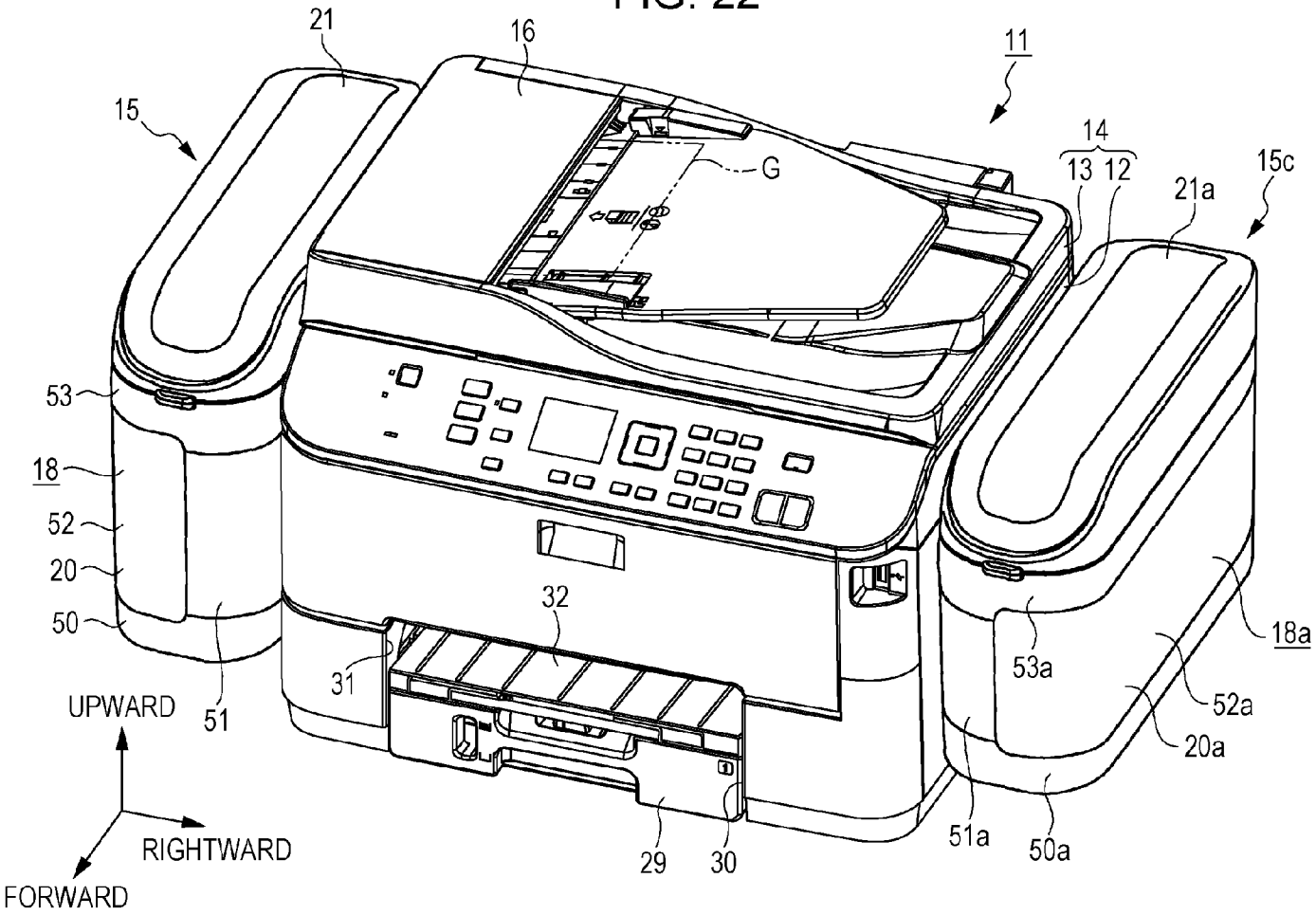
FIG. 22 is an external perspective view of a recording apparatus including an ink supply device on both right side and left side of a main apparatus body.

FIG. 22 is a perspective view of the printer 11 including ink supply devices 15 and 15*c* on both lateral sides of the main apparatus body 14. As illustrated in FIG. 22, the ink supply device 15 may be provided on the left side of the main apparatus body 14, and the ink supply device 15*c* may be provided on the right side of the main apparatus body 14.

Similar to the ink supply device 15, the multiple ink containers 17 are contained inside a case 18*a* of the ink supply device 15*c*.

A lid body 21*a* and a container body 20*a* which configure the case 18*a* are configured to be laterally symmetric with the lid body 21 and the container body 20 which configure the case 18. That is, a left side wall forming member 51*a*, a right side wall forming member 52*a*, and a bottom wall forming member 50*a* which configure the container body 20*a* are configured to be laterally symmetric with the right side wall forming member 51, the left side wall forming member 52, and the bottom wall forming member 50 which configure the container body 20.

Similar to the left side wall forming member 52, the right side wall forming member 52*a* is configured to have a transparent synthetic resin material. Therefore, the respective ink containers 17 contained inside the container body 20*a* are visibly checked from outside of the container body 20*a* through the right side wall forming member 52*a*.

Similar to the ink supply device 15, the ink supply device 15*c* is attached to the right side wall of the main apparatus body 14 so that the bottom wall forming member 50*a* is positioned higher than the bottom surface of the main apparatus body 14.

The configuration of arranging the container bodies 20 and 20*a* on both sides of the main apparatus body 14 can increase the number of the ink containers 17. Accordingly, it is possible to increase the containing capacity for the ink. Furthermore, since the ink containers 17 containing the ink with the ink colors of light cyan and light magenta can be arranged, it is possible to increase the number of the ink colors.

The ink containers 17 may be held in the container bodies 20 and 20*a* arranged on both sides of the main apparatus body 14 so as to respectively have the same number of the ink containers 17. According to this configuration, the lateral weight balance of the printer 11 is improved.

Multiple ink containers 17 may be held in one container body 20 (20*a*), and the containing capacity of at least one ink container 17 out of the multiple ink containers 17 may be different from that of the other ink container 17. According to this configuration, depending on each color of the ink (types of the liquid), it is possible to change the containing capacity of the ink which can be supplied to the recording head 28.

Figure 23:
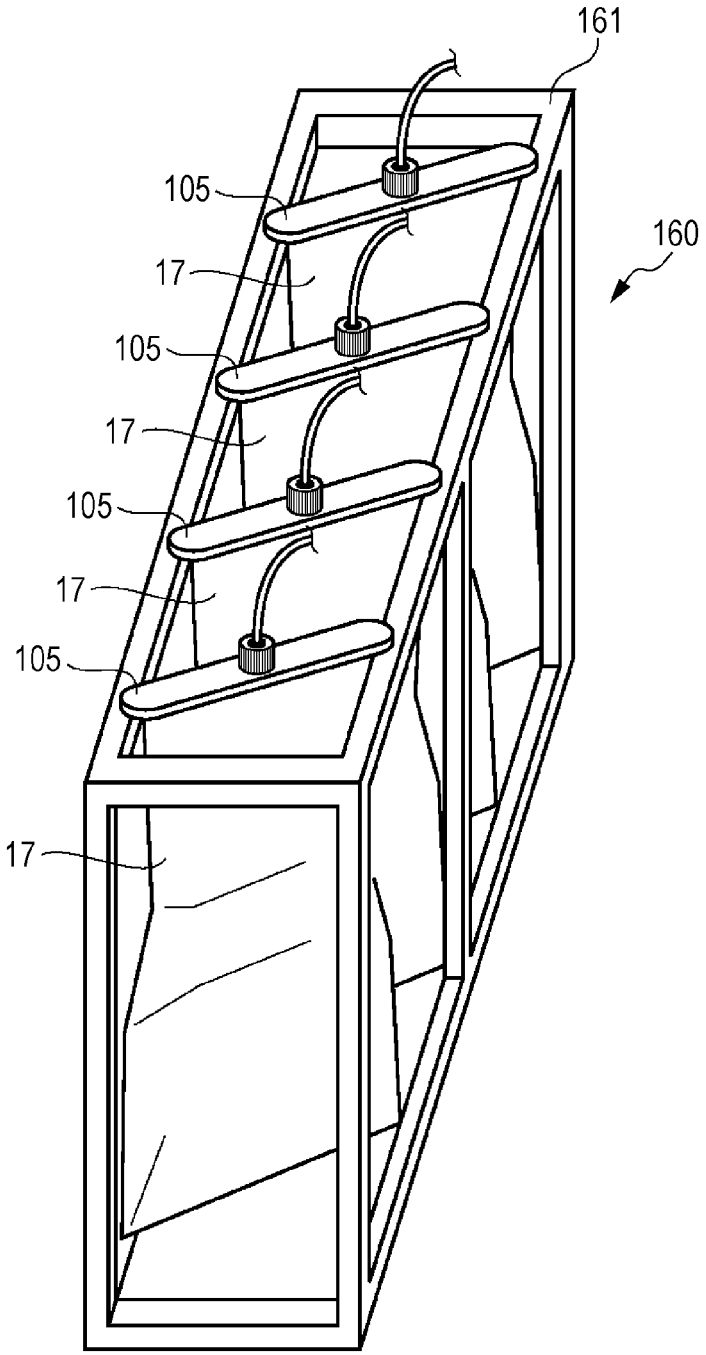
FIG. 23 is a perspective view illustrating an ink container contained in a frame.

FIG. 23 is a perspective view illustrating the ink container 17 contained in a frame 160. Both end portions of a first support member 105 disposed in the upper portion of the ink container 17 are supported by an upper end surface 161 of the frame 160. The frame 160 is attached to a side surface of the main apparatus body 14. As described above, a holder for holding the ink container 17 may be configured to have the frame 160.

Figure 24A:
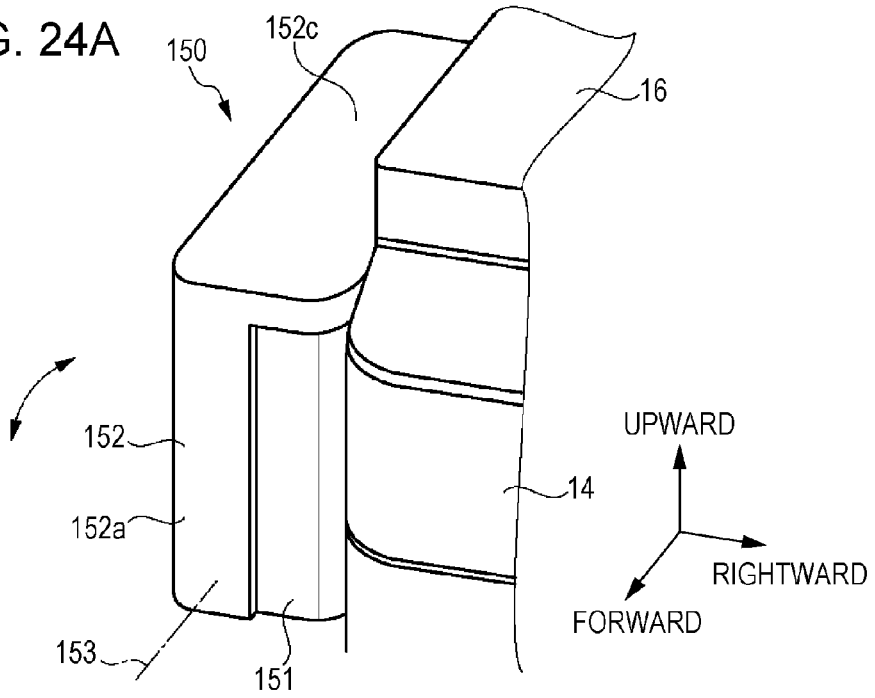
FIGS. 24A and 24B are perspective views of an ink supply device including a cover where an upper portion, a side surface portion, a front surface portion and a rear surface portion are partially integrated.
Figure 24B:
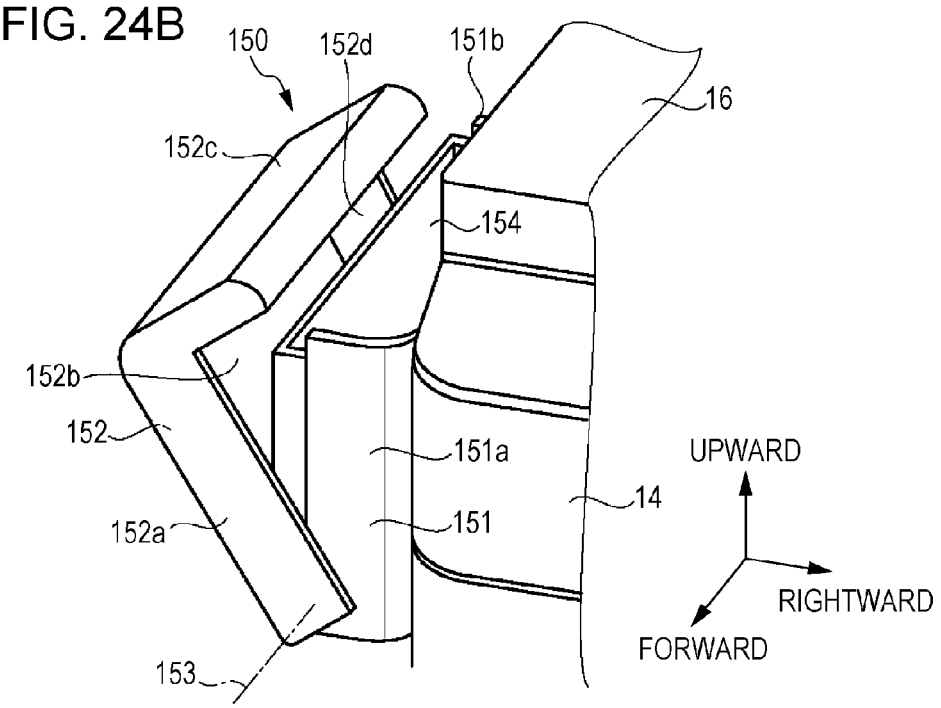

FIGS. 24A and 24B are perspective views of an ink supply device 150 including a cover 152 where an upper portion and a side surface portion are integrated with each other. The ink supply device 150 in FIG. 24A is provided so as to be pivotally movable in an arrow direction about a fulcrum 153 serving as a pivotal movement fulcrum with respect to a containing box 154. FIG. 24A illustrates a closed state of the cover 152, and FIG. 24B illustrates an opened state of the cover 152. In FIG. 24B, the ink container 17 is not illustrated.

In the cover 152 of FIG. 24B, an upper portion 152*c*, a side surface portion 152*b*, a front surface portion 152*a*, and a rear surface portion 152*d* are integrated with one another. That is, the upper portion 152*c* is connected to the side surface portion 152*b*. The side surface portion 152*b* is connected to the front surface portion 152*a* formed from the center to the left side in the front surface section. The side surface portion 152*b* is connected to the rear surface portion 152*d* formed from the center to the left side in the rear surface section. The upper portion 152*c*, the side surface portion 152*b*, the front surface portion 152*a*, and the rear surface portion 152*d* may be configured by connecting separate members.

The front surface portion 151*a* of the cover 151 covers the right half of the front surface of the containing box 154, and the rear surface portion 151*b* of the cover 151 covers the right half of the rear surface of the containing box 154. The containing box 154 having a rectangular box shape which contains the ink container 17 is disposed inside the covers 151 and 152. The containing box 154 functions as a holder for holding the ink container 17.

The cover 152 has the upper portion 152*c* of the containing box 154 in a closed state, the side surface portion 152*b* which is connected from the upper portion 152*c* to the lower portion, the front surface portion 152*a*, and the rear surface portion 152*d*, and is provided so as to be pivotally movable with respect to the containing box 154.

According to this configuration, when the cover 152 is in an opened state, a range for exposing the containing box 154 is increased. In this manner, the relevant work is facilitated when the ink container 17 is contained in the containing box 154 or when the ink container 17 is removed from the containing box 154.

Embodiment 2

Figure 25:
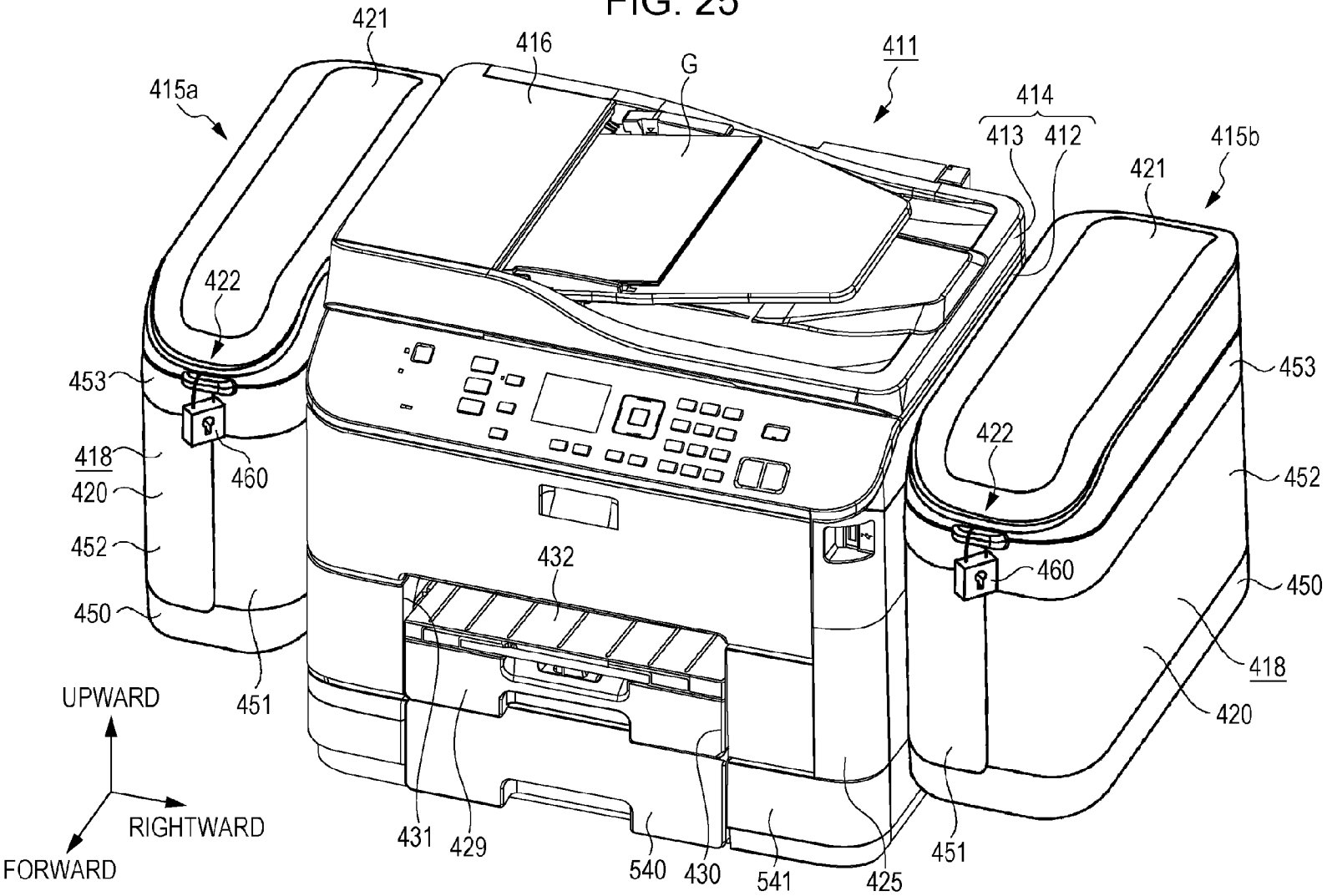
FIG. 25 is an external perspective view of a recording apparatus in Embodiment 2.

Embodiment 2 will be described with reference to the drawings. FIG. 25 is an external perspective view of an ink jet type printer (hereinafter, referred to as a printer) 411 serving as a recording apparatus in Embodiment 2. The printer 411 includes a main apparatus body 414 having a printing unit 412 which forms an image by ejecting the ink (liquid) and a reading unit 413 which reads the document G (medium), and ink supply devices 415*a* and 415*b* which supply the ink to the printing unit 412. The ink supply device 415*a* is attached to the left side of the main apparatus body 414, and the ink supply device 415*b* is attached to the right side of the main apparatus body 414.

The reading unit 413 is arranged on the printing unit 412. A document table (not illustrated) formed of a transparent plate-shaped member such as glass is provided in the reading unit 413, and thus, it is possible to read the document G mounted on the document table. An automatic document feeder 416 connected to an upper end portion on a rear surface of the reading unit 413 via a hinge portion (not illustrated) is arranged on the reading unit 413. The automatic document feeder 416 can read the document G by sequentially feeding the document G onto a reading window (not illustrated) formed of a transparent plate-shaped member such as the glass while reversing multiple stacked documents G one by one.

A sheet cassette 429 is disposed in an opening 430 formed on the front surface side of the housing 425 so as to be inserted and removed in the longitudinal direction. The opening 430 is an insertion port through which the sheet cassette 429 is detachably attached to the housing 425. A sheet discharge tray 432 is disposed on an upper side of the sheet cassette 429 so as to be stretchable in the longitudinal direction.

Multiple sheets in a stacked state are mounted on the sheet cassette 429. The sheets mounted on the sheet cassette 429 are supplied into the housing 425 one by one, and the printed sheet is discharged from a sheet discharge port 431 to be mounted on the sheet discharge tray 432.

An additional cassette unit 541 is provided under the housing 425. A sheet cassette 540 which can be inserted and removed in the longitudinal direction is disposed in the additional cassette unit 541.

A configuration of a case 418 of the ink supply devices 415*a* and 415*b* will be described in detail. A lid body 421 of the case 418 is configured so that a container body 420 side is open, and forms a bottomed rectangular box shape which is long in the longitudinal direction and is shallower than the container body 420. The lid body 421 is connected to an upper end portion on a rear surface of the container body 420 via a hinge portion (not illustrated). Therefore, when opened and closed, the lid body 421 is pivotally moved about the hinge portion serving as the fulcrum. That is, the lid body 421 is opened from the front side of the container body 420, and is closed on the front side of the container body 420.

The container body 420 includes a bottom wall forming member 450 having a bottomed rectangular box shape, an inner side wall forming member 451 which forms the inner half of the side wall (half of the main apparatus body 414 side in the lateral direction) and has a plate shaped bent in a substantially U-shape, an outer side wall forming member 452 which forms the outer half of the side wall (half opposite side to the main apparatus body 414 side in the lateral direction) and has a plate shaped bent in a substantially U-shape, and an edge member 453 which configures a peripheral edge portion of the opening, is hollow, and forms a rectangular frame shape.

The container body 420 is configured by combining the inner side wall forming member 451 serving as an example of a divided member and the outer side wall forming member 452 serving as an example of a divided member. That is, the side wall of the container body 420 is configured by combining the inner side wall forming member 451 and the outer side wall forming member 452 which are two divided members.

A locking mechanism 422 is disposed on the front surface side of the lid body 421 and the edge member 453 of the ink supply devices 415*a* and 415*b*. The locking mechanism 422 can maintain a closed state of the lid body 421 with respect to the container body 420 by using a so-called padlock 460.

Figure 26:
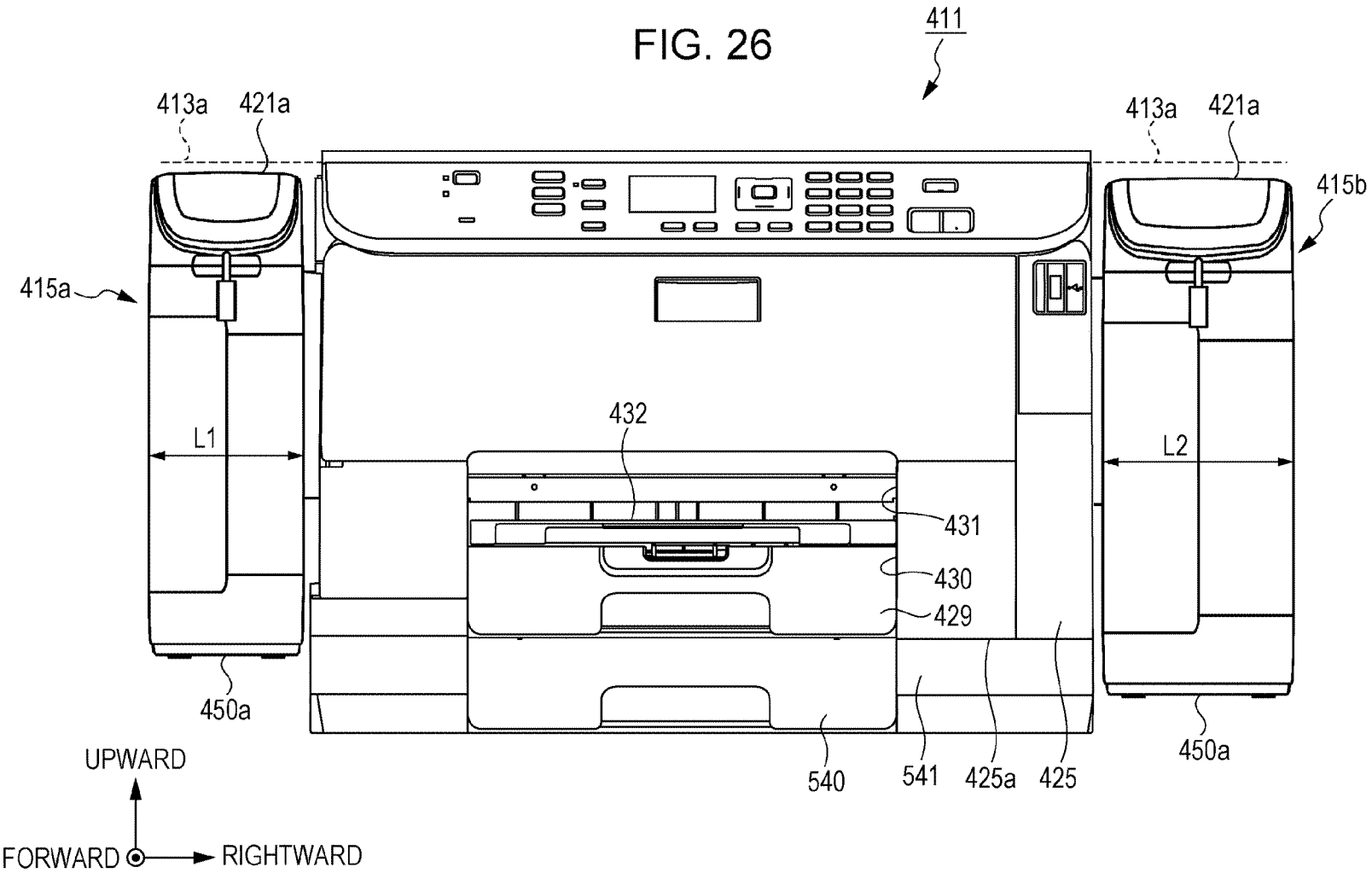
FIG. 26 is a view when a recording apparatus is viewed from a front surface side in a state where an automatic document feeder is detached therefrom.

FIG. 26 is a view when the printer 411 is viewed from the front surface side in a state where the automatic document feeder 416 is removed from the state illustrated in FIG. 25.

A broken line 413*a* indicates a position in the height direction of the document table on which the document G is mounted. In a closed state of the lid body 421, the ink supply devices 415*a* and 415*b* are provided so that a position of an upper end 421*a* of the lid body 421 is the same as a position of the broken line 413*a* of a reading surface (document table) in the height direction, or is lower than a position of the broken line 413*a*.

This configuration allows a user to enjoy good operability in an operation where the user lifts up and pivotally moves the automatic document feeder 416 in FIG. 25, opens the document table, mounts the document G on the document table, causes the reading unit 413 to read the image of the document G, and then removes the document G from the document table. If the size of the document G is so big as to protrude from the document table, the document G protruding particularly in the lateral direction of the document table does not interfere with the ink supply devices 415*a* and 415*b*, thereby providing the good operability. If the height of the upper surface of the ink supply devices 415*a* and 415*b* is set to be substantially the same as the height of the document table, the protruding document G can be supported, and thus, it is possible to prevent the damage of the document G which is caused by the document G being bent.

Figure 27:
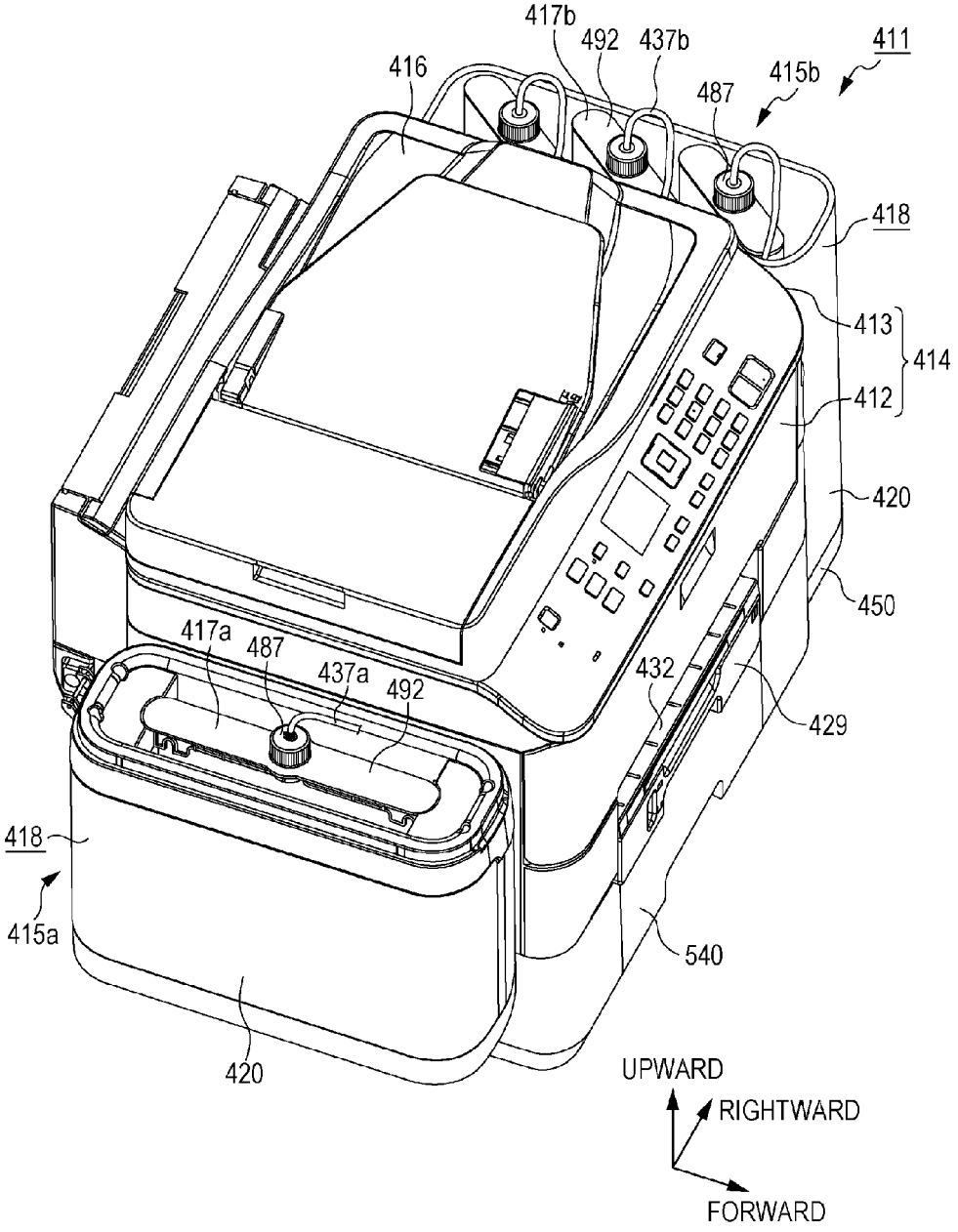
FIG. 27 is a perspective view of a recording apparatus in a state where a lid body of an ink supply device is detached therefrom.

FIG. 27 is a perspective view of the printer 411 in a state where the lid body 421 of the ink supply devices 415*a* and 415*b* is removed. One ink container 417*a* containing a monochrome ink is provided in the ink supply device 415*a* so as to be attachable thereto and detachable therefrom. Three ink containers 417*b* respectively containing the yellow, magenta, and cyan inks are provided in the ink supply device 415*b* so as to be attachable thereto and detachable therefrom. The ink containing capacity of the ink which can be contained in the ink container 417*a* is larger than the ink containing capacity of the ink which can be contained in the ink container 417*b*. The three ink containers 417*b* have substantially the same ink containing capacity.

Figure 28:
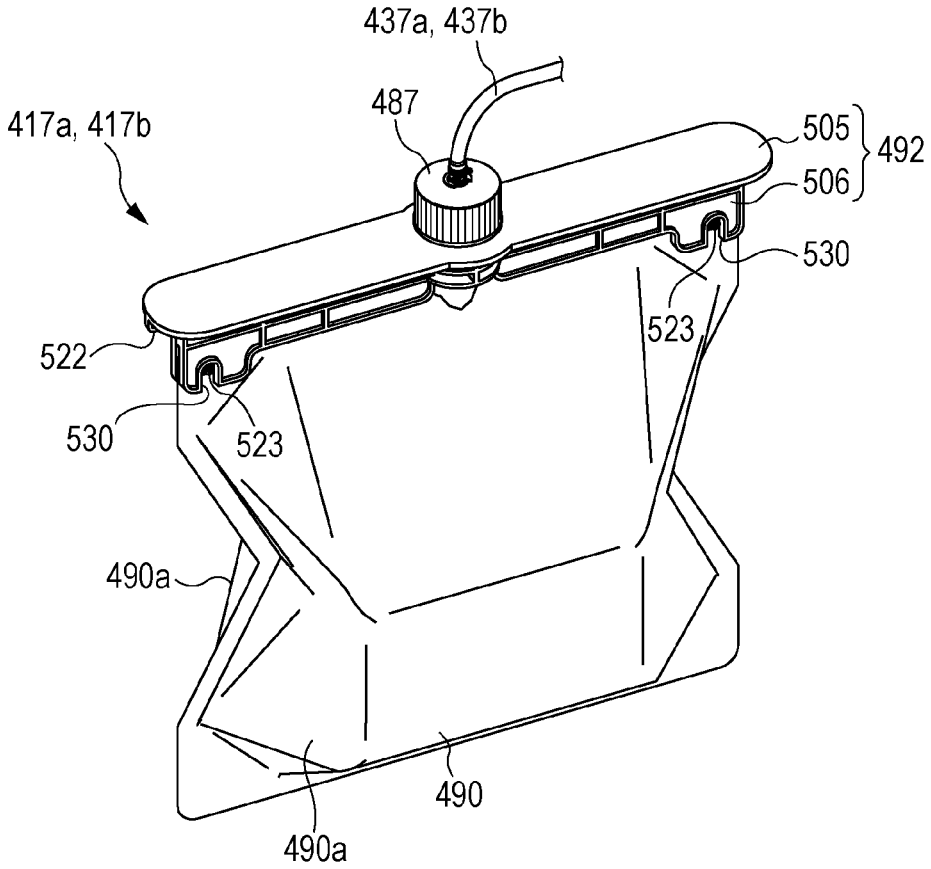
FIG. 28 is a perspective view of an ink container.

FIG. 28 is a perspective view of the ink containers 417*a* and 417*b*. The ink containers 417*a* and 417*b* include an ink bag 490 for containing the ink. A support member (hanger member) 492 is fixedly attached to an upper end side in the ink bag 490. That is, the ink bag 490 engages with the support member 492.

The ink bag 490 is formed by welding peripheral edges of two flexible films 490*a* in a state where a cylindrical ink outlet portion (not illustrated) is interposed between the peripheral edges of the two rectangular flexible films 490*a*.

The support member 492 of the ink containers 417*a* and 417*b* includes a first support member 505 and a second support member 506 which are attached to an upper end portion of the ink bag 490 so as to mutually interpose the upper end portion therebetween. Cylindrical convex portions 523 inserted into an ink bag through-hole (not illustrated) formed in the ink bag 490 are respectively protruded in both end portions in the second support member 506. Engagement cut-out recesses 530 respectively engaging with the convex portions 523 inserted into the ink bag through-hole are formed in the second support member 506.

The three ink containers 417*b* hold a protruding piece 522 in a recess (not illustrated) inside the container body 420 in a posture where the longitudinal direction of the first support member 505 is tilted to the lateral direction by a certain angle (for example, 30 degrees).

A valve body (not illustrated) is disposed in the upper portion of the ink containers 417*a* and 417*b*, the valve body is operated by rotating a cap 487 in a pressing-downward direction, thereby allowing a communication state between the inside of the ink containers 417*a* and 417*b* and connection tubes 437*a* and 437*b*.

A depth length in the case 418 of the ink supply device 415*a* is shorter than a depth length in the case 418 of the ink supply device 415*b*. Positions of the front surface side end portion of the ink supply device 415*a* and the ink supply device 415*b* are substantially the same as each other in the longitudinal direction. However, a position of the rear surface side of the ink supply device 415*a* is in front of a position of the rear surface side of the ink supply device 415*b*. Therefore, the ink supply device 415*a* is not arranged in the left side rear surface portion of the housing 425.

According to this configuration, a user can easily carry out connection work when a plug (not illustrated) for supplying AC power which is connected to a power code is connected to a plug receiver (not illustrated) disposed in the left side rear surface portion of the housing 425.

A width length L1 in the case 418 of the ink supply device 415*a* is shorter than a width length L2 in the case 418 of the ink supply device 415*b*, and a height dimension in the case 418 of the ink supply device 415*a* is shorter than a height dimension in the case 418 of the ink supply device 415*b*. In this way, the case 418 of the ink supply device 415*a* has a size different from that of the case 418 of the ink supply device 415*b*.

Figure 29:
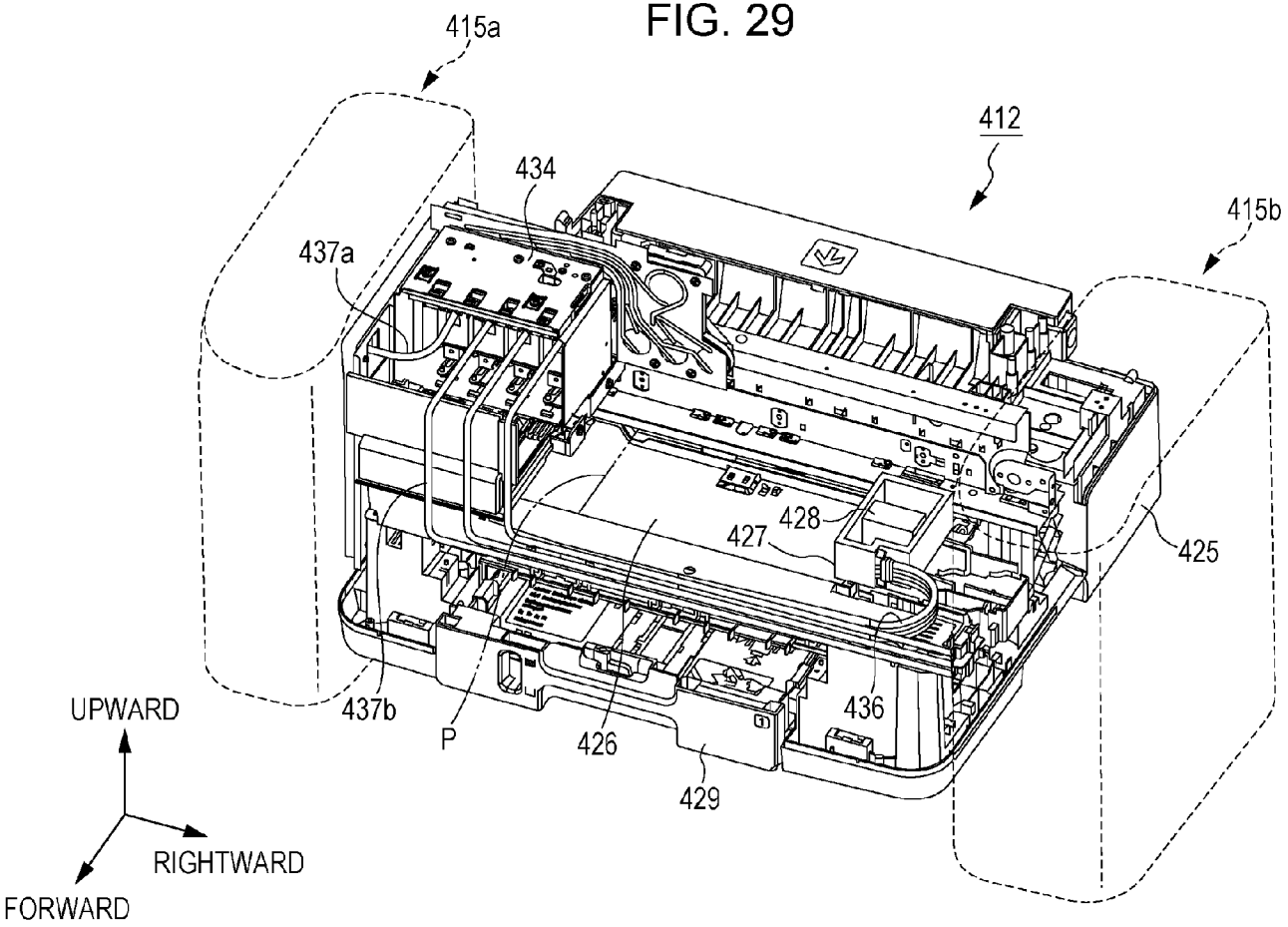
FIG. 29 is a perspective view of a recording apparatus in a state where an upper portion of a housing is detached therefrom.

FIG. 29 is a perspective view of the printer 411 in a state where an upper portion of the housing 425 is removed. The printing unit 412 includes the housing 425 which is laterally long and has a substantially rectangular shape. A transport path 426 supporting the sheet P serving as the recording medium is disposed in a central portion inside the housing 425. A carriage 427 reciprocally movable in the lateral direction which is a main scanning direction is disposed above the transport path 426.

A recording head 428 ejecting the ink is supported inside the carriage 427 so as to be exposed from a lower surface of the carriage 427. The recording head 428 opposes the transport path 426. The recording head 428 ejects the ink through multiple nozzles (not illustrated), onto the sheet P which is transported from the rear side to the front side on the transport path 426 while the carriage 427 is moved in the lateral direction, thereby performing the printing on the sheet P.

A sheet cassette 429 is provided on the lower side of the transport path 426 inside the housing 425. The sheet P inside the sheet cassette 429 is fed from the rear side onto the transport path 426 by a sheet feeding mechanism (not illustrated) while being reversed one by one.

The sheet P printed on the transport path 426 is sequentially discharged from the sheet discharge port 431 in FIG. 25, which is configured to be positioned in a further upper side region than the sheet cassette 429 in an opening 430.

A holder case 434 whose front side is open and which forms a rectangular box shape is disposed in a left end portion inside the housing 425. Four hollow ink supply needles (not illustrated) juxtaposed in the lateral direction are provided inside the holder case 434.

Each ink supply needle extends in the longitudinal direction and passes through a side wall of the holder case 434. One end side of a flexible ink supply tube 436 is connected to a rear end portion of each ink supply needle, and the other end side of the ink supply tube 436 is connected to the recording head 428.

One end side of one flexible connection tube 437*a* is connected to a front end portion of the ink supply needle, and the other end side of the connection tube 437*a* is connected to an ink container 417*a* contained in the ink supply device 415*a* (refer to FIG. 27).

One end side of three flexible connection tubes 437*b* is connected to the front end portion of each ink supply needle, and the other end side of the connection tubes 437*b* is connected to each ink container 417*b* contained in the ink supply device 415*b* (refer to FIG. 27).

A valve body (not illustrated) is disposed in an upper portion of the ink containers 417*a* and 417*b*. The valve body is operated by rotating a cap 487 in a pressing-down direction, thereby allowing a communication state between the inside of the ink containers 417*a* and 417*b* and the connection tubes 437*a* and 437*b*.

Therefore, a monochrome ink is supplied to the recording head 428 from the ink container 417*a* contained in the ink supply device 415*a* via the connection tube 437*a*, the ink supply needle, and the ink supply tube 436.

The color inks of the yellow ink, the magenta ink, and the cyan ink are respectively supplied to the recording head 428 from the ink containers 417*b* contained in the ink supply device 415*b* via the connection tube 437*b*, the ink supply needle, and the ink supply tube 436.

The sheet cassette 429 in the embodiment configures a recording medium holding unit, the ink containers 417*a* and 417*b* configure a liquid container, the case 418 configures a holder, and an additional cassette unit 541 configures an external recording medium holding unit.

As described above, the printer 411 of the embodiment includes the recording head 428 which can eject the ink onto the sheet P, the sheet cassette 429 which holds the sheet P, the transport unit which transports the sheet P to the recording head 428, the housing 425 which contains the recording head 428 and the transport unit and into which the sheet cassette 429 is inserted, the insertion port (opening 430) which is formed on the outer side surface of the housing 425 and into which the sheet cassette 429 is inserted, the ink containers 417*a* and 417*b* which contain the ink, the case 418 which is arranged on at least one outer side surface adjacent to the outer side surface having the opening 430 of the housing 425 and holds the ink container, and the supply unit (including at least the connection tubes 437*a* and 437*b*) which supplies the ink into the housing 425 from the ink container. The case 418 has a bottom portion 450*a* in FIG. 26, and the bottom portion 450*a* is arranged to be positioned lower than a bottom surface 425*a* of the housing 425.

According to this configuration, even when the ink containers 417*a* and 417*b* are increased in size or the number of the ink containers 417*a* and 417*b* is increased, it is possible to suppress the increase in the size of the case 418 holding the ink containers 417*a* and 417*b*, and to suppress the increase in the size of the printer 411.

The bottom portion 450*a* of the case 418 is arranged so as to be positioned higher than the bottom surface of the additional cassette unit 541. This can decrease the installation area of the printer 411.

Figure 31A:
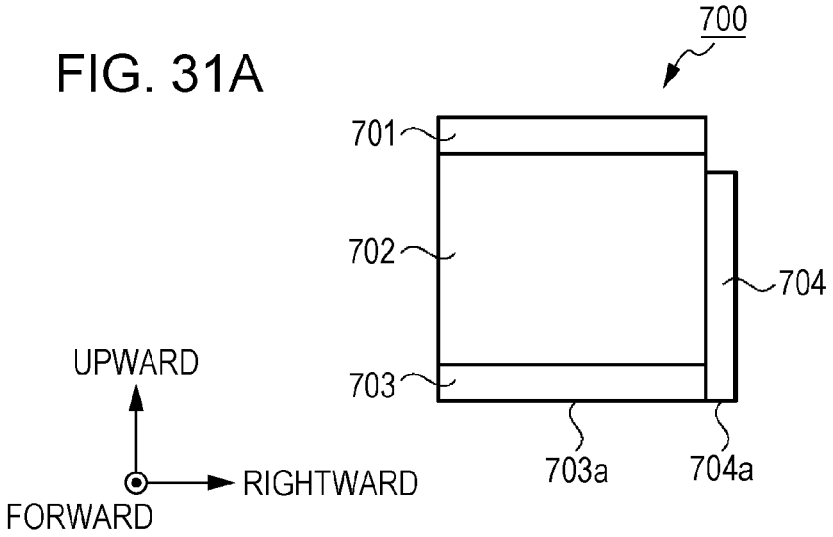
FIGS. 31A to 31C are schematic views for illustrating a position of a case.
Figure 31B:
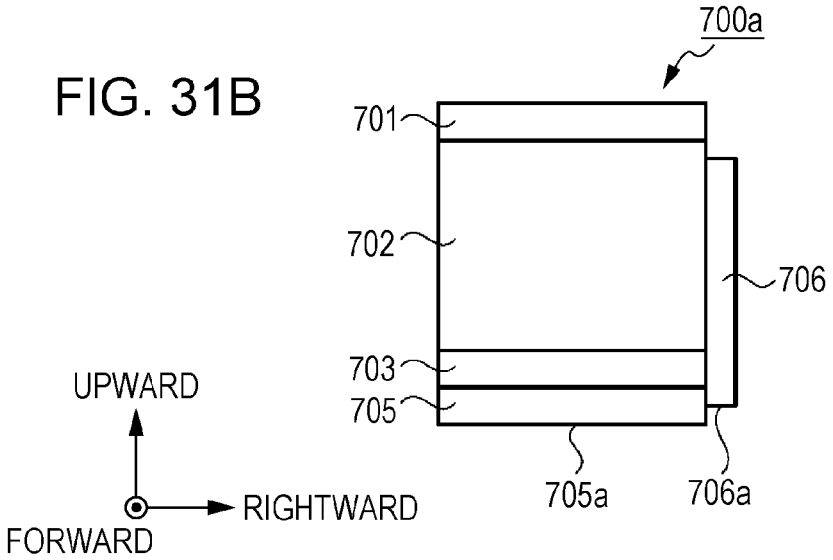
Figure 31C:
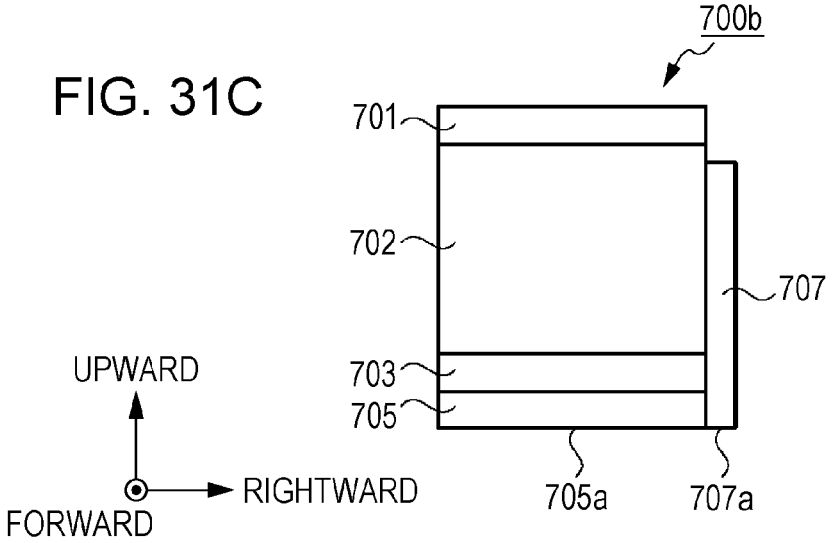

FIGS. 31A to 31C are views when printers 700, 700*a*, and 700*b* are viewed from the front surface side, and are schematic views for illustrating positions of the case. The printer 700 in FIG. 31A has a reading unit 701 and a printing unit 702. A bottom portion 704*a* of a case 704 (holder) may be arranged at a position coincident with a bottom surface 703*a* of an additional cassette unit 703 (external recording medium holding unit).

This can increase the containing capacity of the case 704. Accordingly, it is possible to provide the printer 700 with larger ink containers 417*a* and 417*b* (liquid containers), or to increase the number of the ink containers 417*a* and 417*b*.

As illustrated in FIG. 31B, the printer 700*a* may have multiple additional cassette units 703 and 705, and a bottom portion 706*a* of a case 706 may be arranged so as to be positioned higher than a bottom surface 705*a* of the lowermost additional cassette unit 705. This configuration can decrease the installation area of the printer 700*a*.

As illustrated in FIG. 31C, the printer 700*b* has the multiple additional cassette units 703 and 705, and a bottom portion 707*a* of a case 707 may be arranged at a position coincident with the bottom surface 705*a* of the lowermost additional cassette unit 705.

This configuration can increase the containing capacity of the case 707. Accordingly, it is possible to provide the printer 700*b* with larger ink containers 417*a* and 417*b*, or to increase the number of the ink containers 417*a* and 417*b*.

In the embodiment, the bottom portion 450*a* of both side cases 418 is arranged so as to be positioned lower than the bottom surface 425*a* of the housing 425. However, the bottom portion 450*a* of one side case 418 may be arranged so as to be positioned lower than the bottom surface 425*a* of the housing 425.

The sheet cassette 429 and the sheet cassette 540 in the embodiment have a containing size different from each other. In this manner, it is possible to respectively contain the sheets having different sizes.

The sheet cassette 429 and the sheet cassette 540 may have the same containing size. In this manner, it is possible to respectively contain the sheets having the same size.

Embodiment 3

In Embodiment 2, the case 418 has been described in which the pivotal axis of the lid body 421 is disposed on the rear surface side and the front surface side is open. However, in Embodiment 3, a case will be described in which the pivotal axis extending in the longitudinal direction is disposed in the lower portion of the lid body and the side surface side of the housing is open.

Figure 30A:
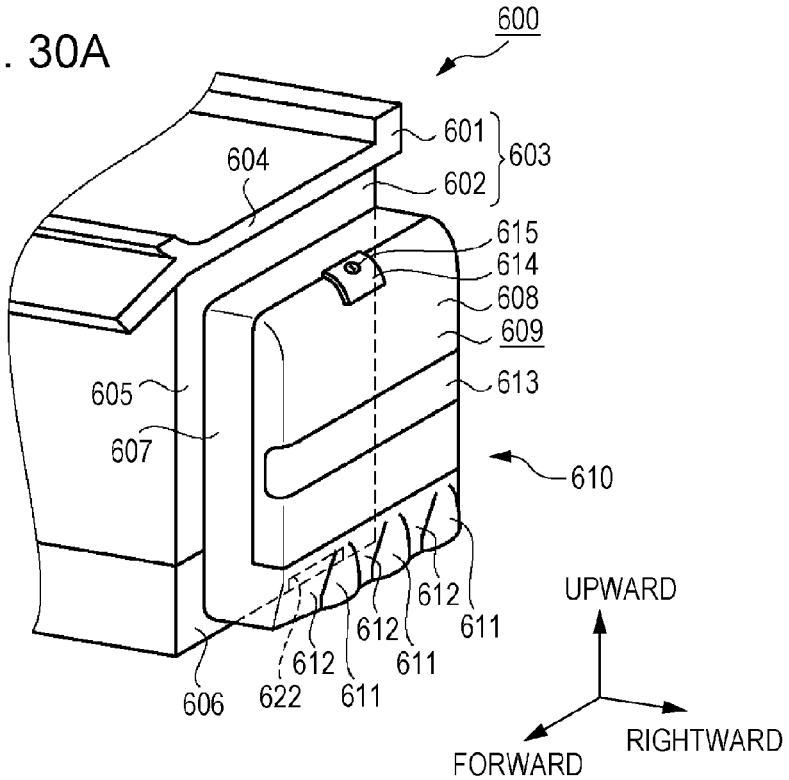
FIG. 30A is an external perspective view illustrating a side portion including an ink supply device in Embodiment 3.
Figure 30B:
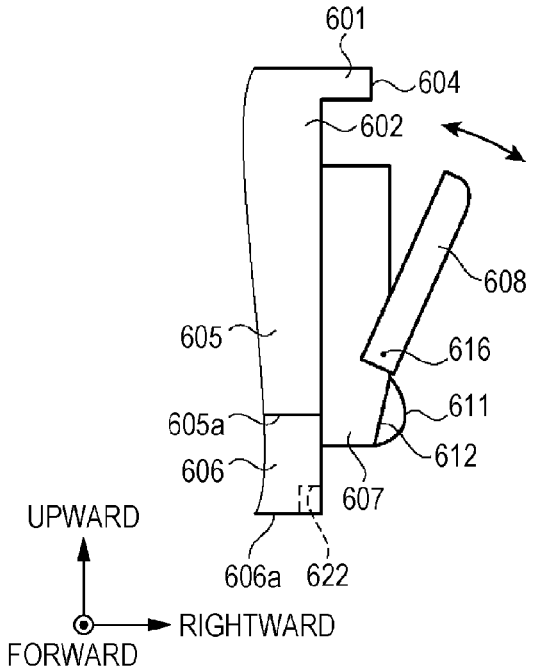
FIG. 30B is a view when the side portion including the ink supply device is viewed from the front.

FIG. 30A is an external perspective view illustrating a portion of a side including an ink supply device 610 according to Embodiment 3. FIG. 30B is a view when a portion of the side including the ink supply device 610 is viewed from the front surface side. A case 609 of the ink supply device 610 is configured to have a container body 607 and a lid body 608.

As illustrated in FIG. 30B, the lid body 608 is pivotally moved in the arrow direction, about a pivotal axis 616 serving as a fulcrum, which is disposed in the lower portion in the lid body 608 and whose axial direction extends in the longitudinal direction. In this manner, the right side of the lid body 608 is provided so as to be openable.

A main apparatus body 603 is configured to have a reading unit 601 and a printing unit 602. An eaves portion 604 protruding rightward from a wall surface of a housing 605 containing the printing unit 602 is formed on a right side of the reading unit 601. That is, as illustrated in FIG. 30B, the eaves portion 604 is positioned at a position overlapping with the container body 607 in the lateral direction. This can suppress the increase in the size of the printer 600.

In the lid body 608, the lower portion has a thickness thinner than that of the other portions, and the lid body 608 has a shape whose lower portion is narrowed. A convex portion 611 protruding outward in a convex shape from a narrowed wall surface 612 of the lid body 608 is formed in the lower portion of the narrowed lid body 608. A protruding amount of the convex portion is the same as that of the other region which is not narrowed. In other words, the narrowed region causes the convex portion to relatively have a protruding shape. A concave portion (not illustrated) formed along the shape of the convex portion 611 is formed on an inner side wall surface of the lower portion of the lid body 608. This enables the concave portion to hold one end side of the lower portion of the ink container (refer to FIG. 28) contained in the container body 607.

A transparent member 613 having transparency is disposed in the lid body 608. This functions as a window through which the ink container contained in the container body 607 is visibly checked. Therefore, deflated conditions of the ink bag of all the ink containers inside the case 609 are visibly checked from the front side of the case 609 (from outside of the transparent member 613). Therefore, based on the deflated conditions of the ink bag 490 of each ink container, it is possible to estimate the replacement time for each ink container.

An opening/closing lever 614 used when the lid body 608 is opened and closed is disposed in the lid body 608 in FIG. 30A. The opening/closing lever 614 is disposed at a position between multiple ink containers contained in the container body 607. The opening/closing lever 614 includes a locking mechanism for fixing the container body 607 and the lid body 608 to be in a closed state, and a structure such as a hook (not illustrated), thereby requiring an installation space for these. Even in this case, the opening/closing lever 614 is disposed at the position between the multiple ink containers contained in the container body 607, thereby enabling the width length of the case 609 to be shortened.

Figure 30C:
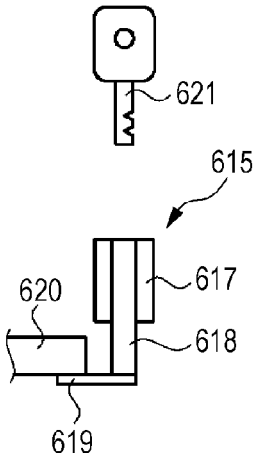
FIG. 30C is a view illustrating a schematic configuration of a locking mechanism.

A locking mechanism 615 which can maintain the lid body 608 to be in the closed state is provided in the lid body 608 and the container body 607. FIG. 30C illustrates a schematic configuration of the locking mechanism 615. The locking mechanism 615 is configured to have a so-called cylinder lock.

A holding member 617 is provided in the upper portion of the lid body 608. A pivotal movement member 618 is provided in the holding member 617 so as to be pivotally movable. A lever 619 is provided in an end portion of the pivotal movement member 618. If a user inserts a key 621 into an opening of the pivotal movement member 618 and pivotally moves the key 621, the lever 619 is pivotally moved and engages with an engagement portion 620 disposed in the container body 607. In this manner, the lid body 608 is in a state of closing the container body 607.

An additional cassette unit 606 is provided below the housing 605, separately from a sheet cassette (not illustrated) removably inserted into an insertion port of the housing 605. The lower end portion of the case 609 is positioned at a position below a bottom surface 605*a* of the housing 605, and the lower end portion of the case 609 is positioned at a position above a bottom surface 606*a* of the additional cassette unit 606.

A concave finger hooking portion 622 which is long in the longitudinal direction is disposed in a right side corner portion of the bottom surface 606*a* of the additional cassette unit 606. The finger hooking portion 622 is disposed at a position which is not vertically overlapped with the lid body 608 and the container body 607. In a state where the ink supply device 610 is mounted on the housing 605, a user grips the finger hooking portion 622. In this manner, the user can move the printer by lifting up the printer 600 in a state of holding the additional cassette unit 606 and the main apparatus body 603 on which the additional cassette unit 606 is mounted. The finger hooking portion 622 is clearly shown. Accordingly, it is possible to prevent damage to the ink supply devices 615*a* and 615*b* which is caused by erroneous holding of the ink supply devices 615*a* and 615*b* when moved.

Embodiment 4

Figure 32A:
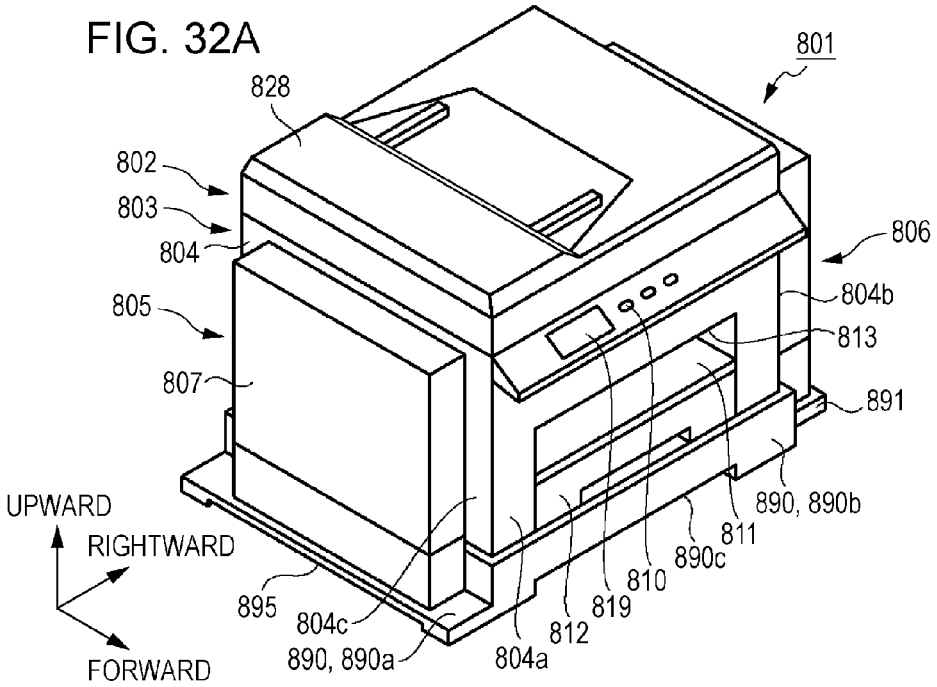
FIGS. 32A and 32B are external perspective views of a recording apparatus in Embodiment 4.

Embodiment 4 will be described with reference to the drawings. FIG. 32A is an external perspective view when an ink jet type printer (hereinafter, referred to as a printer) 801 serving as a recording apparatus according to Embodiment 4 is viewed from the front surface left side. The printer 801 includes a printing unit 803 which forms an image by ejecting the ink (liquid), a reading unit 802 which reads a document (not illustrated), and cases 805 and 806 serving as a holder. The main apparatus body is configured to have the printing unit 803 and the reading unit 802.

The case 805 is detachably attached to a side surface 804*c* on the left side of a housing 804 in the main apparatus body, and the case 806 is detachably attached to a side surface 804*b* on the right side of the housing 804. An ink container 830 (refer to FIG. 34) serving as a liquid container which contains the ink is stored in the cases 805 and 806. The case 805 stores one ink container 830 which contains the monochrome ink. The case 806 stores three ink containers 830 which respectively contain the color inks of the yellow ink, the magenta ink, and the cyan ink.

The reading unit 802 is arranged on the printing unit 803. The reading unit 802 includes a document table (not illustrated) formed of a transparent plate-shaped member such as glass, and can read the document mounted on the document table. An automatic document feeder 828 connected to an upper end portion on a rear surface of the reading unit 802 via a hinge portion (not illustrated) is arranged on the reading unit 802. The automatic document feeder 828 can read the document by sequentially feeding the document onto a reading window (not illustrated) formed of a transparent plate-shaped member such as the glass while reversing multiple documents stacked on a document mounting unit one by one.

An opening 813 is formed on a side surface 804*a* on the front surface side of the housing 804. In a lower side region in the opening 813, a sheet cassette 812 serving as recording medium holding unit is removably inserted in the longitudinal direction. That is, the lower side region in the opening 813 serves as an insertion port for detachably attaching the sheet cassette 812 to the housing 804. A transport path 811 through which a sheet (not illustrated) printed inside the printing unit 803 is transported is disposed on the upper side of the sheet cassette 812. A sheet discharge port for the printed sheet is formed in an upper side region in the opening 813.

Multiple sheets in a stacked state are mounted on the sheet cassette 812. The sheets mounted on the sheet cassette 812 are supplied into the housing 804 one by one. The printed sheet is discharged from the sheet discharge port formed on the upper side in the opening 813, and is mounted on a sheet discharge tray (not illustrated).

An operation button 810 for switching on and off power or for setting printing conditions or reading conditions is provided on the front surface side of the main apparatus body. A display unit 819 configured to have a liquid crystal panel for displaying the printing conditions or the reading conditions is provided on the front surface side of the main apparatus body.

A support stand 890 is provided on the lower side of the housing 804 and the case 805 so as to be attachable to and detachable from the housing 804 and the case 805. The support stand 890 is configured to have a main body portion 890*b* and extension portion 890*a* extending leftward from the main body portion 890*b*. The main body portion 890*b* and the extension portion 890*a* are formed integrally with each other. The extension portion 890*a* extends further outward from a position of the side surface 804*c* of the housing 804.

The main body portion 890*b* is positioned on the lower side of the housing 804 to support the housing 804. The extension portion 890*a* is positioned on the lower side of the case 805 to support the case 805. A stepped portion is formed between the main body portion 890*b* and the extension portion 890*a*. The extension portion 890*a* is formed to be lower than the main body portion 890*b*.

Therefore, the position of the bottom surface of the case 805 is lower than the position of the bottom surface of the housing 804, and the position of the bottom surface of the case 805 is lower than the position of the upper end of the main body portion 890*b* in the support stand 890. That is, the case 805 is arranged over the housing 804 and the support stand 890.

A support 891 is provided on the lower side of the case 806 so as to be attachable to and detachable from the case 806. The support 891 is formed separately from the support stand 890. The height of the support surface of the support 891 is lower than that of the main body portion 890*b*. Therefore, the position of the bottom surface of the case 806 is lower than the position of the bottom surface of the housing 804, and the position of the bottom surface of the case 806 is lower than the position of the upper end of the main body portion 890*b* in the support stand 890. That is, the case 806 is arranged over the housing 804 and the support stand 890.

The position of the upper surface of the cases 805 and 806 is positioned at a position below the document table of the reading unit 802. In this manner, when a user pivotally moves the automatic document feeder 828 to leave the document table in an exposed state, and places the document on the document table, or removes the document from the document table, the cases 805 and 806 do not hinder the user.

A finger hooking portion 895 serving as a first finger hooking portion is formed in a left side bottom portion of the extension portion 890*a*. The finger hooking portion 895 is a cut-out portion which is cut out so that a corner portion of the bottom portion of the extension portion 890*a* extends to be long in the longitudinal direction. A user can put and hook the user's several fingers into the finger hooking portion 895 in a state where the user's palm faces upward.

Figure 32B:
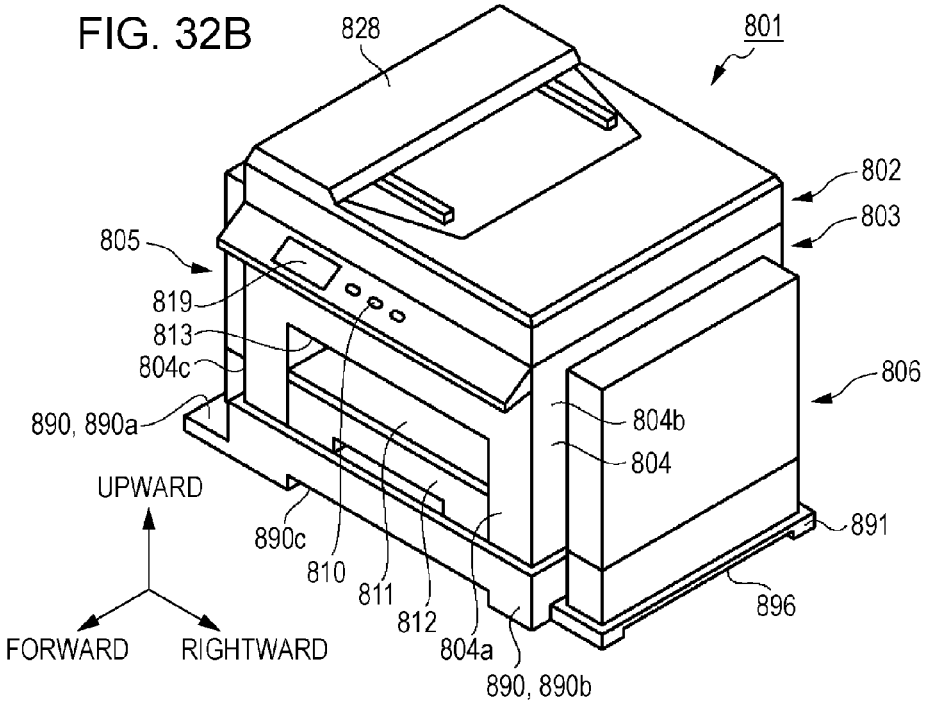

FIG. 32B is an external perspective view when the printer 801 is viewed from the front surface right side. A finger hooking portion 896 serving as a second finer hooking portion is formed in a right side bottom portion of the support 891. The finger hooking portion 896 is a cut-out portion which is cut out so that a corner portion of the bottom portion of the support 891 extends to be long in the longitudinal direction. A user can put and hook several fingers into the finger hooking portion 896 in a state where the user's palm faces upward.

A cut-out portion extending in the lateral direction is also formed in a front side bottom portion of the main body portion 890*b* of the support stand 890, thereby configuring a finger hooking portion 890*c* for hooking the user's fingers. A cut-out portion extending in the lateral direction is also formed in a rear side bottom portion of the main body portion 890*b* of the support stand 890, thereby configuring a finger hooking portion (not illustrated) for hooking the user's fingers.

Figure 33:
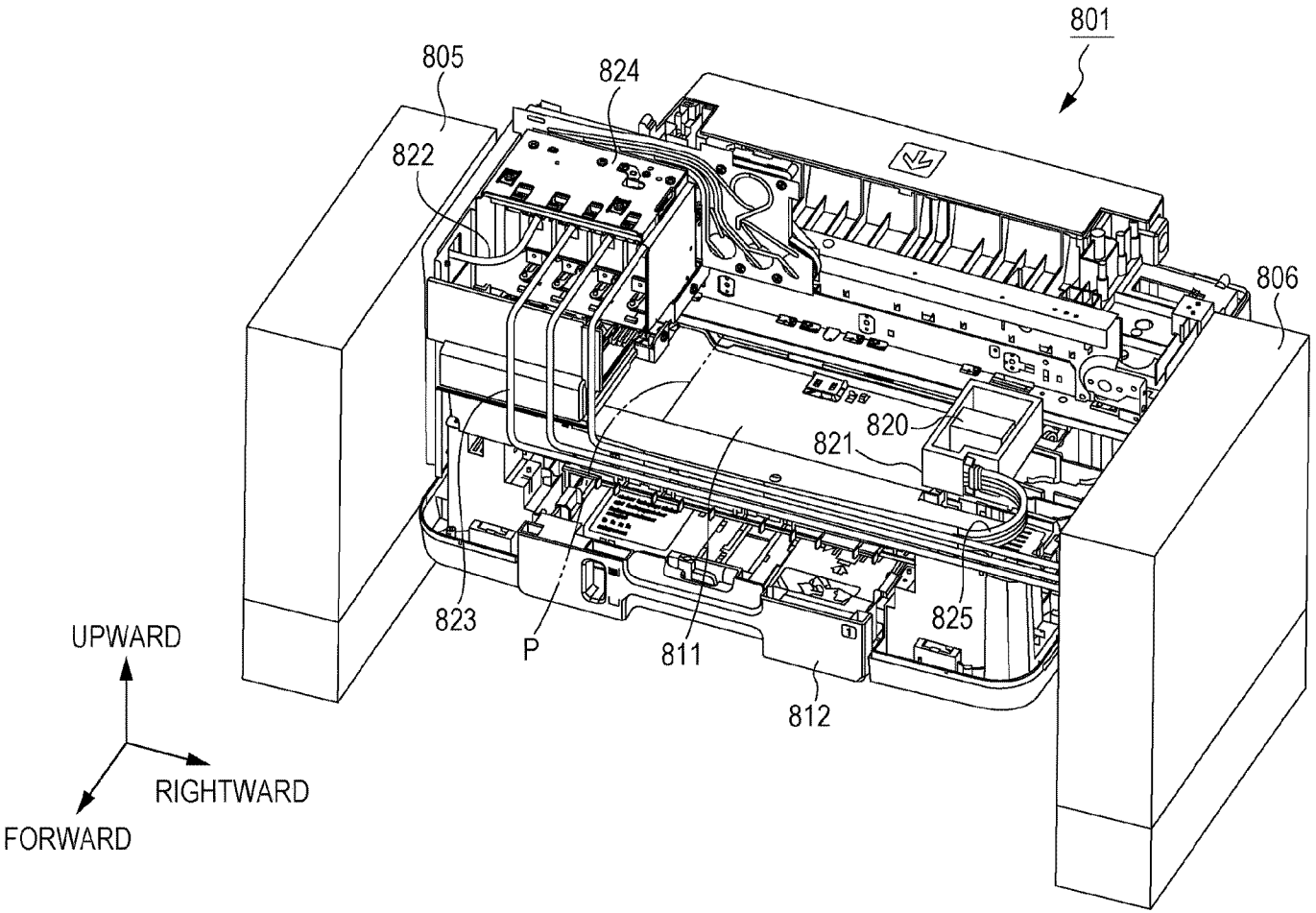
FIG. 33 is a perspective view of a recording apparatus in a state where an upper portion of a housing is detached therefrom.

FIG. 33 is a perspective view of the printer 801 in a state where the upper portion of the housing 804 is removed. A carriage 821 reciprocally movable in the lateral direction which is the main scanning direction is disposed above a transport path 811. A recording head 820 ejecting the ink is provided inside the carriage 821 so as to be exposed from the lower surface of the carriage 821.

A reversing unit (not illustrated) which reverses the sheet is provided in the printer 801. The sheet P inside the sheet cassette 812 provided on the lower side of the transport path 811 is fed from the rear side onto the transport path 811 while being reversed one by one by the reversing unit.

The printer 801 includes a transport unit configured to have a transport roller and a sheet feeding motor (both of these are not illustrated). The sheet P is transported from the rear side to the front side along the transport path 811 by the transport unit. The ink is ejected onto the transported sheet P through the recording head 820 which is provided in the carriage 821 and is reciprocally moved, thereby performing the printing on the sheet P.

As described above, the sheet P printed on the transport path 811 is sequentially discharged from a sheet discharge port configured to have a further upper side region from the sheet cassette 812 in the opening 813.

Four hollow ink supply needles (not illustrated) juxtaposed in the lateral direction are provided inside a holder case 824 whose front side is open and which forms a rectangular box shape.

Each ink supply needle extends in the longitudinal direction, and passes through a side wall of the holder case 824. One end side of a flexible ink supply tube 825 is connected to a rear end portion of each ink supply needle, and the other end side of the ink supply tube 825 is connected to the recording head 820.

Figure 34:
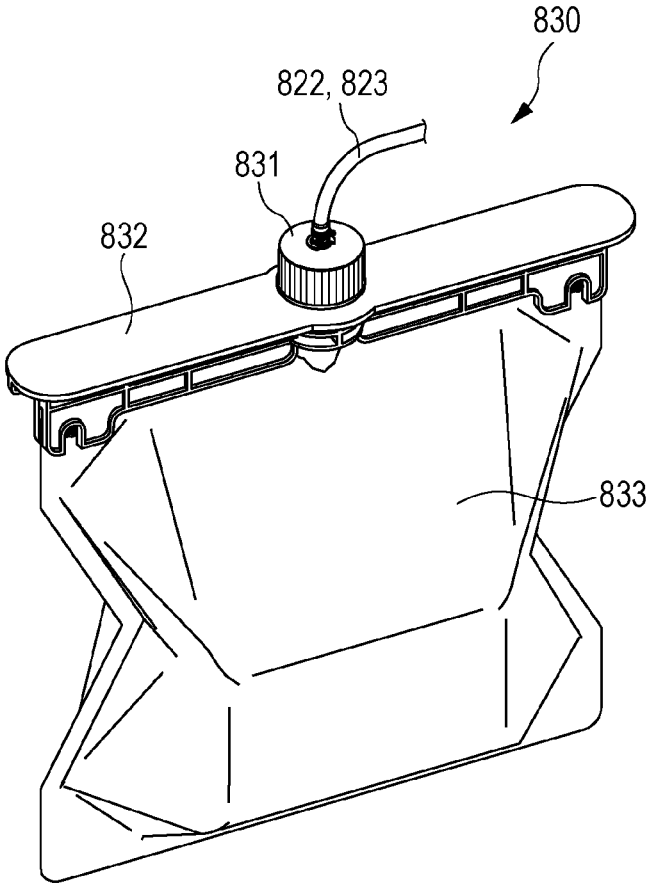
FIG. 34 is a perspective view of an ink container.

One end side of one flexible connection tube 822 is connected to a front end portion of the ink supply needle, and the other end side of the connection tube 822 is connected to an ink container 830 contained in the case 805 (refer to FIG. 34).

One end side of three flexible connection tubes 823 is connected to the front end portion of each ink supply needle, and the other end side of the connection tubes 823 is connected to each ink container 830 contained in the case 806 (refer to FIG. 34).

FIG. 34 is a perspective view of the ink container 830. The ink container 830 includes an ink bag 833 containing the ink. A support member (hanger member) 832 is fixed to the upper end side in the ink bag 833.

The ink bag 833 is formed by welding peripheral edges of two flexible films in a state where a cylindrical ink outlet portion (not illustrated) is interposed between the peripheral edges of the two rectangular flexible films.

A valve body (not illustrated) is disposed in an upper portion of the ink container 830. The valve body is operated by rotating a cap 831 in a pressing-down direction, thereby allowing a communication state between the inside of the ink container 830 and connection tubes 822 and 823.

A monochrome ink is supplied to the recording head 820 from the ink container 830 contained in the case 805 in FIG. 33 via the connection tube 822, the ink supply needle, and an ink supply tube 825. The color inks of the yellow ink, the magenta ink, and the cyan ink are respectively supplied to the recording head 820 from the ink containers 830 contained in the case 806 via the connection tube 823, the ink supply needle, and an ink supply tube 825.

Figure 35A:
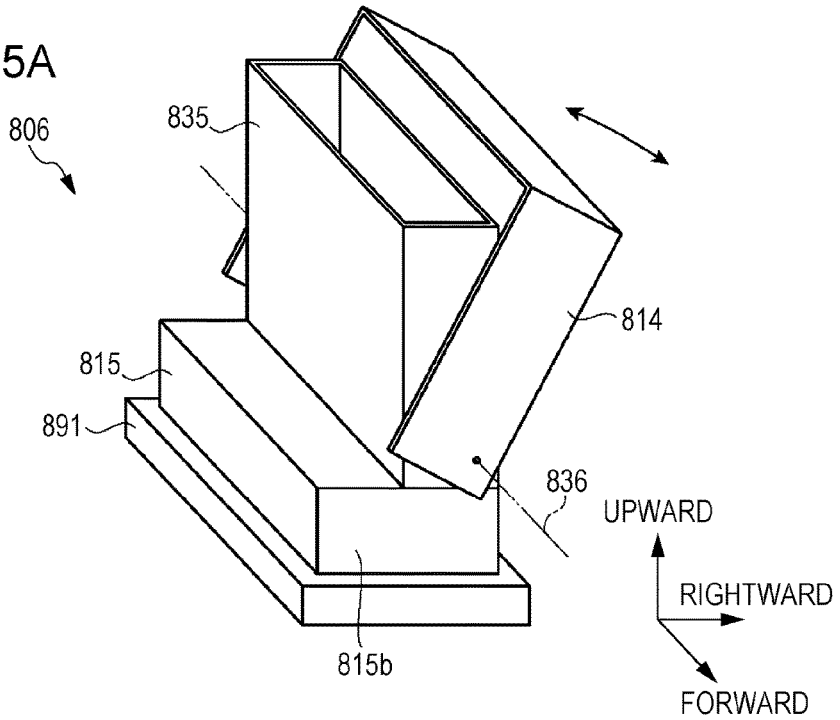
FIG. 35A is an external perspective view of a case.

FIG. 35A is an external perspective view of the case 806. The case 806 includes a storage portion 835 for storing the ink container 830. A lower end of the storage portion 835 is fixed to a fixing portion 815. An upper side of the storage portion 835 is open. Accordingly, a user can attach the ink container 830 to the inside of the storage portion 835, or can remove the ink container 830 from the inside of the storage portion 835.

A lid body 814 is provided so as to be pivotally movable in the arrow direction, about a pivotal axis 836 serving as a fulcrum, which is illustrated by a dashed line. The housing 804 side of the lid body 814 is opened, and the lid body 814 is pivotally moved from the state in FIG. 35A to the closed state in FIG. 32B. In this manner, the lid body 814 covers the storage portion 835. The support 891 is provided on the lower side of the fixing portion 815 so as to be attachable and detachable.

Figure 35B:
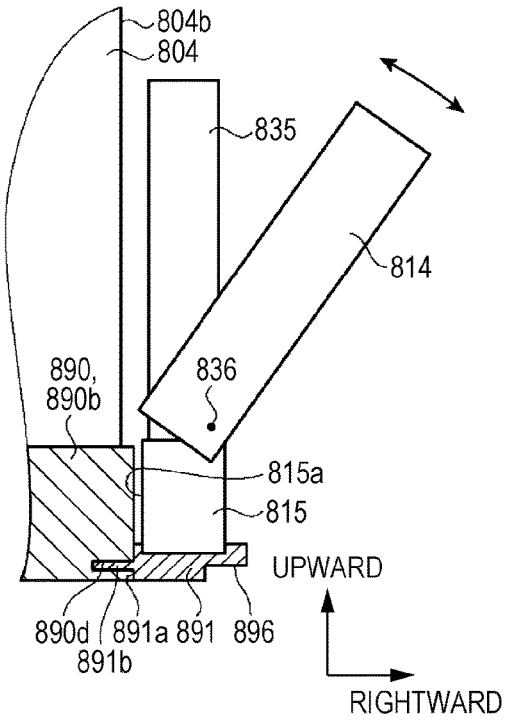
FIG. 35B is a view when a portion where a case is mounted on a housing is viewed from a front surface side.

FIG. 35B is a view when a portion where the case 806 is mounted on the housing 804 is viewed from the front surface side, illustrates an external shape of the lid body 814 and the storage portion 835 when viewed from the front surface side, and illustrates a cross-sectional view of a portion having a protruding portion 891*b* in the support 891.

The protruding portion 891*b* serving as an engagement portion which protrudes from a side surface 891*a* of the support 891 is disposed on the housing 804 side of the support 891. A concave portion 890*d* recessed inward from the side surface 804*b* is formed in the main body portion 890*b* of the support stand 890.

The protruding portion 891*b* of the support 891 is inserted into and engages with the concave portion 890*d*, and the support 891 is fixed to the support stand 890 by an engagement member such as a screw (not illustrated). In the height direction, the position of the bottom surface of the support 891 is the same as the position of the bottom surface of the support stand 890.

Figure 35C:
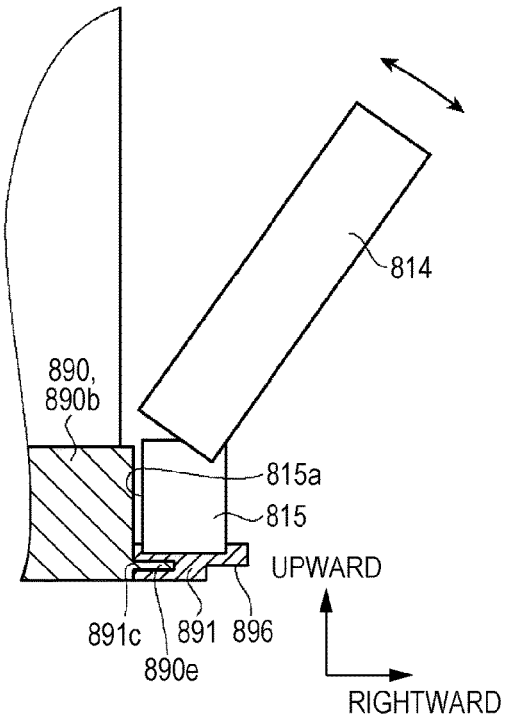
FIG. 35C is a cross-sectional view illustrating a portion where a protruding portion of a support stand is inserted into a recess disposed in a support.

FIG. 35C is a cross-sectional view illustrating a portion where a protruding portion 890*e* disposed in the main body portion 890*b* of the support stand 890 is inserted into a concave portion 891*c* disposed in the support 891. In FIG. 35C, the storage portion 835 is not illustrated. As illustrated in FIG. 35C, the protruding portion 890*e* disposed in the main body portion 890*b* may be inserted into the concave portion 891*c* disposed in the support 891, and the support 891 may be configured to engage with the main body portion 890*b* of the support stand 890.

As described above, the printer 801 of the embodiment includes the recording head 820 which can eject the ink onto the sheet P, the sheet cassette 812 which holds the sheet P, the transport unit which transports the sheet P to the recording head 820, the housing 804 which contains the recording head 820 and the transport unit and into which the sheet cassette 812 is inserted, the opening 813 which is formed on the side surface 804*a* of the housing 804 and into which the sheet cassette 812 is inserted, the ink container 830 which contains the ink, the cases 805 and 806 which are mounted on the side surfaces 804*b* and 804*c* adjacent to the side surface 804*a* having the opening 813 of the housing 804 so as to be attachable and detachable and store the ink container 830, the support stand 890 which is arranged below the housing 804 and supports the housing 804, and the supply unit (connection tubes 822 and 823) which supplies the ink into the housing 804 from the ink container 830. The cases 805 and 806 are arranged over the housing 804 and the support stand 890.

According to this configuration, the vertical length of the cases 805 and 806 can be lengthened. Therefore, it is possible to increase the ink containing capacity of the ink container 830 contained inside the cases 805 and 806, and it is possible to shorten the width length or the depth length of the cases 805 and 806. Therefore, it is possible to suppress the increase in the overall size of the printer 801 including the cases 805 and 806.

The extension portion 890*a* extending outward from the position of the side surface 804*c* of the housing 804 is integrally formed in the support stand 890, and the extension portion 890*a* supports the case 805 from below. According to this configuration, the case 805 can be fixed to the housing 804 via the extension portion 890*a*. Therefore, the case 805 and the housing 804 are integrated with each other.

In the embodiment, the extension portion 890*a* extending to one side of the main body portion 890*b* is formed, but the extension portion extending both sides of the main body portion 890*b* may be formed. That is, the cases 805 and 806 may be respectively arranged on both sides of the housing 804, and the respective extension portions 890*a* may extend further outward from the position of the side surfaces 804*b* and 804*c* on both sides of the housing 804. In this manner, the bottom portion of the cases 805 and 806 respectively arranged on both sides may be configured to be supported by the extension portion.

According to this configuration, the cases 805 and 806 can be fixed to the housing 804 via the extension portion. Therefore, the cases 805 and 806, and the housing 804 are integrated with each other.

The cases 805 and 806 in FIG. 32A are respectively arranged on both sides of the housing 804, the bottom portion of the case 805 between the cases 805 and 806 respectively arranged on both sides is supported by the extension portion 890*a*, and the support 891 which supports the bottom portion of the other case 806 is arranged on the lower side of the case 806.

According to this configuration, the case 805 is supported by the extension portion 890*a* in the support stand 890 supporting the housing 804. Therefore, the case 805 can be fixed to the housing 804, and the case 806 is supported by the support 891, thereby being installed in a stabilized posture.

The support 891 in FIG. 35C and a portion of the support stand 890 (main body portion 890*b*) are arranged at a position of being overlapped with each other in the height direction. The concave portion 890*d* recessed inward is disposed in the main body portion 890*b*. The protruding portion 891*b* serving as the engagement portion which protrudes outward is disposed in the support 891. The protruding portion 891*b* is inserted into and engages with the concave portion 890*d* of the main body portion 890*b*. According to this configuration, the support 891 is fixed to the main body portion 890*b*, and the case 806 supported by the support 891 can be integrated with the housing 804.

If a usage amount of the monochrome ink contained in the ink container 830 inside the case 805 is less than a usage amount of the color ink contained in the ink container 830 inside the case 806, the case 805 supported by the extension portion 890*a* may be smaller than the case 806 supported by the support 891. According to this configuration, it is possible to suppress the increase in the size of the printer 801.

The finger hooking portion 895 is formed in the support stand 890. According to this configuration, in a state where the case 805 and the housing 804 are integrated with each other, a user grips the finger hooking portion 895 with the user's finger. In this manner, the user can move the printer by lifting up the printer 801.

The finger hooking portion 896 is formed in the support 891. The support 891 is fixed to the support stand 890. According to this configuration, in a state where the cases 805 and 806 and the housing 804 are integrated with each other, one or more users grip the finger hooking portions 895 and 896 by the user finger or the users fingers. In this manner, the user or the users can move the printer by lifting up the printer 801.

In the height direction, the position of the bottom surface of the support 891 is the same as the position of the bottom surface of the support stand 890. According to this configuration, the cases 805 and 806 on both sides and the housing 804 can be installed in a stabilized posture.

In the ink container 830, the ink bag 833 is configured to have the flexible film. According to this configuration, the ink bag 833 of the ink container 830 contracts in response to the consumption of the ink. Therefore, it is possible to prevent the ink from not being supplied to the recording head 820 due to the negative pressure generated inside the ink container 830.

Embodiment 5

Figure 36:
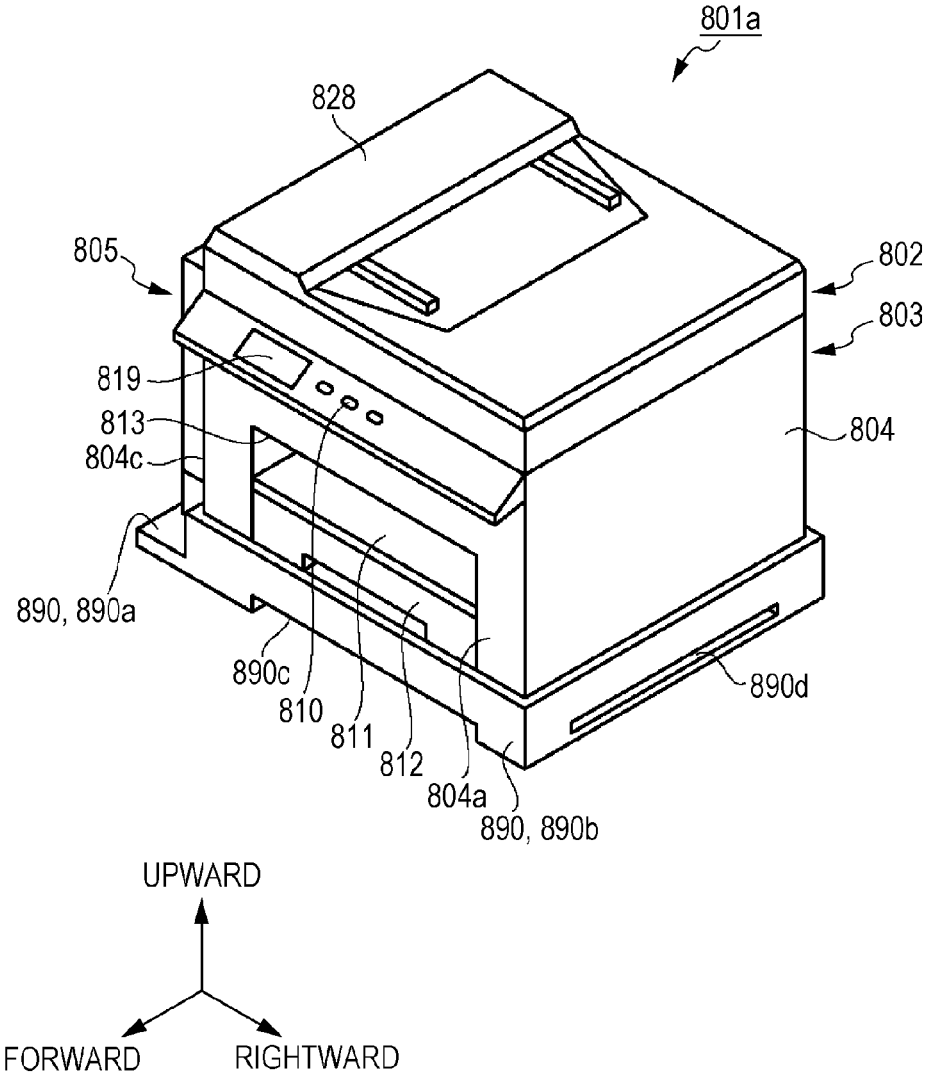
FIG. 36 is an external perspective view of a recording apparatus in Embodiment 5.

In Embodiment 5, a printer will be described which includes a case on one side of the housing and does not include a case on the other side. FIG. 36 is an external perspective view of a printer 801*a* according to Embodiment 5. The printer 801*a* in FIG. 36 has a configuration where the case 806 supported by the support 891 is removed from the configuration of the printer 801 in FIG. 32B which has been described in Embodiment 4.

A monochrome liquid is contained in the ink container 830 contained in the case 805. According to this configuration, the printer 801*a* can be used as a dedicated printer using the monochrome ink. The other configurations of the printer 801*a* are the same as the configurations of the printer 801 which have been described in Embodiment 4.

Embodiment 6

Figure 37:
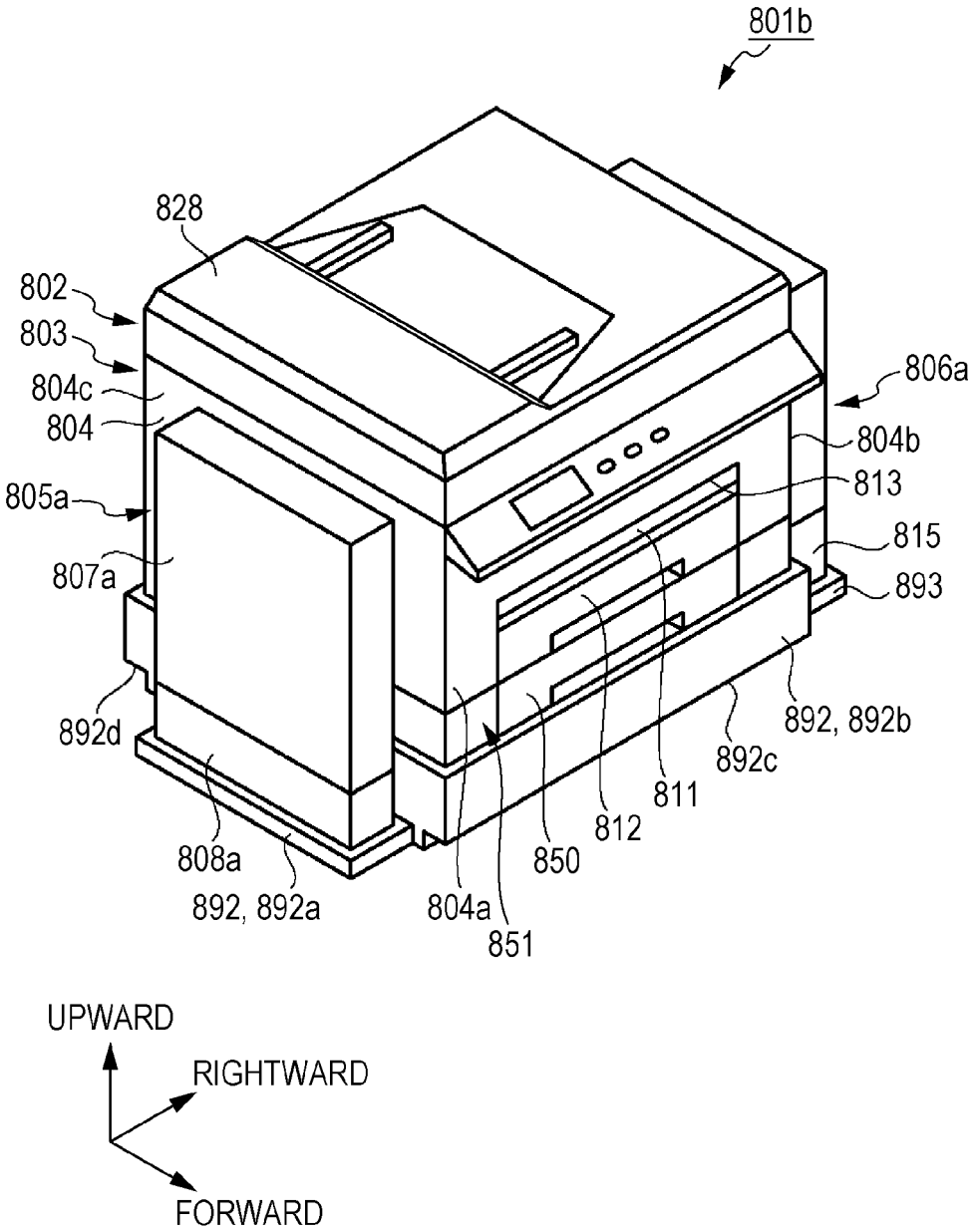
FIG. 37 is an external perspective view of a recording apparatus in Embodiment 6.

FIG. 37 is an external perspective view of a printer 801*b* according to Embodiment 6. The printer 801*b* includes an additional cassette unit 851 serving as an external recording medium holding unit on the lower side of the main apparatus body configured to have the printing unit 803 and the reading unit 802 in Embodiment 4. The additional cassette unit 851 is configured as a part of the housing 804. A sheet cassette 850 which can be inserted and removed in the longitudinal direction is disposed in the additional cassette unit 851. The sheets P are stacked on the sheet cassette 850, and the sheets P are fed to the printing unit 803 one by one by a feeding unit (not illustrated).

A support stand 892 supporting the additional cassette unit 851 and a case 805*a* is provided so as to be attachable and detachable, on the lower side of the additional cassette unit 851 and the case 805*a* serving as a holder. The support stand 892 has a main body portion 892*b* and an extension portion 892*a* extending to the left side of the main body portion 892*b*, and these are formed integrally with each other. The extension portion 892*a* extends further outward from the position of the side surface 804*c*.

The main body portion 892*b* supports the additional cassette unit 851, and the extension portion 892*a* supports the case 805*a*. A stepped portion is formed between the main body portion 892*b* and the extension portion 892*a*. The extension portion 892*a* is positioned lower than the main body portion 892*b*. Therefore, the position of the bottom surface of the case 805*a* is lower than the position of the bottom surface of the additional cassette unit 851, and is lower than the upper end of the main body portion 892*b*.

A support 893 is provided so as to be attachable to and detachable from the case 806*a*, on the lower side of the case 806*a* serving as the holder. The support 893 is disposed separately from the support stand 892. The support 893 is positioned lower than the main body portion 892*b*. Therefore, the position of the bottom surface of the case 806*a* is lower than the position of the bottom surface of the additional cassette unit 851, and is lower than the upper end of the main body portion 892*b*.

According to this configuration, the cases 805*a* and 806*a* are arranged from the housing 804 over to the support stand 892. Therefore, since the position of the bottom surface of the cases 805*a* and 806*a* can be lowered, the vertical length of the cases 805*a* and 806*a* can be further lengthened. Therefore, it is possible to further increase the ink containing capacity of the ink container 830 contained inside the cases 805*a* and 806*a*.

The additional cassette unit 851 and the cases 805*a* and 806*a* may be supported from below by the support stand 890 and support 891 in FIG. 32A which have been described in Embodiment 4. According to this configuration, the support stand 890 and the support 891 can be shared in use. Therefore, it is possible to suppress an increase in the manufacturing cost of the printers 801, 801*a*, and 801*b*.

A cut-out portion where a corner portion is cut out over the lateral direction is formed in a front side bottom portion of the main body portion 892*b*, and functions as a finger hooking portion 892*c* for hooking the user's fingers. A cut-out portion where a corner portion is cut out over the lateral direction is also formed in a rear side bottom portion of the main body portion 892*b* of the support stand 892, and functions as a finger hooking portion 892*d*.

According to this configuration, in a state where the cases 805*a* and 806*a* and the main apparatus body are integrated with each other, one or more users grip the finger hooking portions 892*c* and 892*d* by the user finger or the users fingers. In this manner, the user or the users can move the printer by lifting up the printer.

FIGS. 38A to 38D are perspective views of a case whose height is changed. A case 880 as a holder in FIG. 38A has a fixing portion 884 which supports a lid body 883 and a storage portion (not illustrated) containing the lid body 883 and an ink container (not illustrated). The lid body 883 is configured to have an inner side fixing portion 882 and an outer side sliding portion 881. For example, when the lid body 883 is opened and closed by being pivotally moved in the arrow direction in FIGS. 35A to 35C, the inner side fixing portion 882 and the outer side sliding portion 881 can be integrally operated.

Figure 38A:
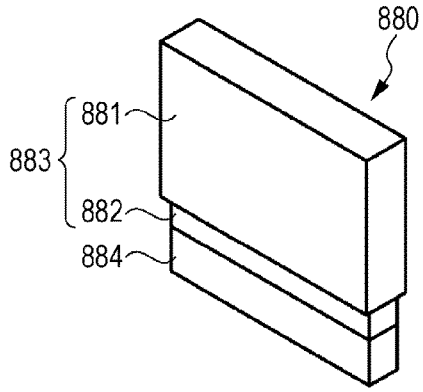
FIGS. 38A to 38F are perspective views of a case whose height is changed.
Figure 38B:
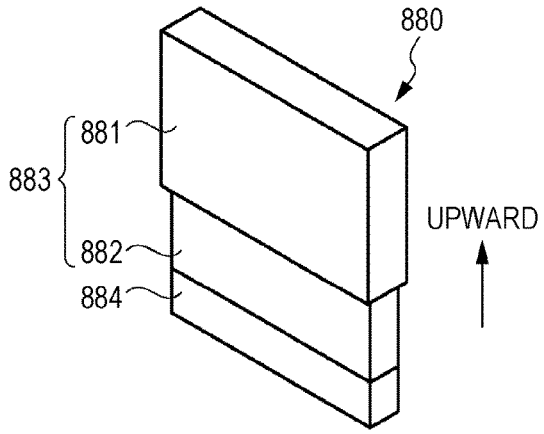

An outer side sliding portion 881 is positioned further outside from the inner side fixing portion 882, and is provided so as to be vertically slidable with respect to the inner side fixing portion 882. FIG. 38B illustrates a state where the outer side sliding portion 881 in FIG. 38A is moved upward. The case 880 in the state in FIG. 38B is positioned higher than the case 880 in the state in FIG. 38A.

According to this configuration, it is possible to change the height of the case 880. Therefore, in accordance with a change in the height of the housing 804 when the housing 804 in FIG. 32A is provided with the case 880, or when the housing 804 in FIG. 32A is provided with the additional cassette unit 851 in FIG. 37, it is possible to change the height of the case 880 by stretching the lid body 883 of the case 880. In accordance with the height of the additional cassette unit 851 whose height varies, it is possible to change the height of the case 880 by stretching the lid body 883 of the case 880.

Figure 38C:
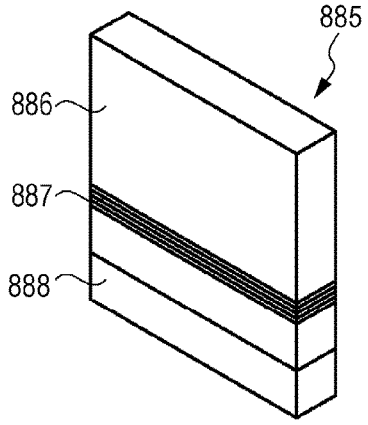
Figure 38D:
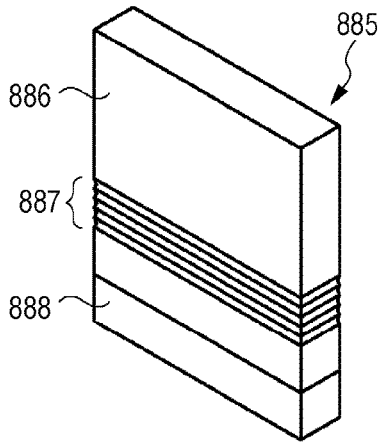

A case 885 as a holder in FIG. 38C has a fixing portion 888 which supports a lid body 886 and a storage portion (not illustrated) containing the lid body 886 and an ink container (not illustrated). For example, the lid body 886 is opened and closed by being pivotally moved in the arrow direction in FIGS. 35A to 35C. A so-called bellows portion 887 which is vertically stretchable is formed in the lid body 886. FIG. 38D illustrates a state where the bellows portion 887 in FIG. 38C is extended upward. The case 885 in the state in FIG. 38D is positioned higher than the case 885 in the state in FIG. 38C.

Figure 38E:
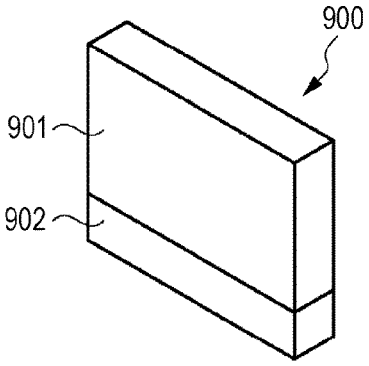

A case 900 serving as a holder in FIG. 38E has a lid body 901 and a fixing portion 902 supporting the lid body 901. The lid body 901 is pivotally moved with respect to the case 900. In this manner, a user can attach or detach an ink container (not illustrated) to or from a storage portion (not illustrated).

Figure 38F:
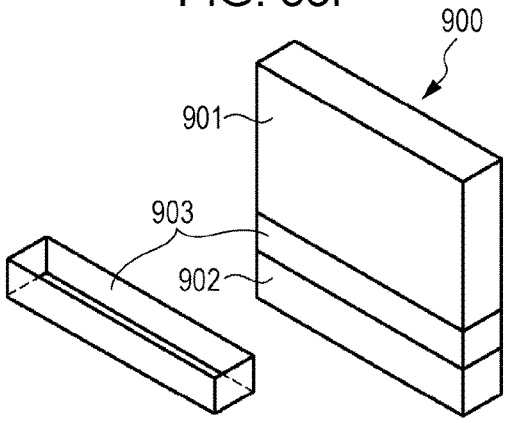

An intermediate fixing portion 903 in FIG. 38F has a rectangular box shape. The case 900 in FIG. 38F illustrates a state where the intermediate fixing portion 903 is provided between a lid body 901 and a fixing portion 902. The lid body 901 is supported so as to be pivotally movable with respect to the intermediate fixing portion 903. The case 900 in the state in FIG. 38F is positioned higher than the case 900 in the state in FIG. 38E.

In this manner, in accordance with the height of the main apparatus body side, it is possible to change the height of the cases 880, 885, and 900. Therefore, it is not necessary to separately provide the case in accordance with the height of the main apparatus body side. Accordingly, it is possible to suppress the increase in the manufacturing cost of the case.

What is claimed is:

1. A recording apparatus comprising:

a recording head that can eject a liquid onto a recording medium;

a transport unit that transports the recording medium to the recording head;

a housing that contains the recording head and the transport unit;

a liquid container that contains the liquid, a holder that is arranged on at least one outer surface adjacent to an outer surface having a recording medium discharge port of the housing, and that holds the liquid container, the holder including a lid member that opens at least part of an upper surface of the holder;

a supply unit that supplies the liquid into the housing from the liquid container; and an image forming apparatus that is arranged on the housing and has a reading device having a reading surface for reading a medium, wherein the upper surface of the holder is lower than the reading surface while the lid member selectively supports the medium partially supported by the image forming apparatus.

2. The recording apparatus according to claim 1, the housing comprising sides, wherein the holder is arranged on an outer surface of one side and another holder is arranged on an outer surface of another of the both sides.

3. The recording apparatus according to claim 2, wherein multiple liquid containers are held in the holder, wherein a different number of the liquid containers are respectively held by the holder arranged on both sides.

4. The recording apparatus according to claim 3, wherein the multiple liquid containers are held, and at least one liquid container within the multiple liquid containers has a containing capacity different from that of another liquid container.

5. The recording apparatus according to claim 4, wherein the multiple liquid containers include a liquid container containing at least a black liquid, and the liquid container containing the black liquid has a containing capacity larger than that of the other liquid container.

6. The recording apparatus according to claim 2, wherein each holder has a different length in the height direction.

7. The recording apparatus according to claim 1, further comprising:

a recording medium holding unit that is inserted into the housing and holds the recording medium; and an insertion port that is formed on an outer surface of the housing and into which the recording medium holding unit is inserted.

8. The recording apparatus according to claim 1, wherein the liquid container comprises a flexible container.

9. A recording apparatus comprising:

a recording head that can eject a liquid onto a recording medium;

a transport unit that transports the recording medium to the recording head;

a housing that contains the recording head and the transport unit;

a liquid container that contains the liquid, a holder that is arranged on at least one outer surface adjacent to an outer surface having a recording medium discharge port of the housing, and that holds the liquid container, the holder including an opening and closing member that opens at least part of an upper surface of the holder for replacing the liquid container;

a supply unit that supplies the liquid into the housing from the liquid container; and an image forming apparatus that is arranged on the housing and has a reading device having a reading surface for reading a medium, wherein the upper surface of the holder is lower than the reading surface while the upper surface of the holder including the opening and closing member selectively supports the medium partially supported by the image forming apparatus.

* * * * *